US006260840B1

(12) United States Patent
Suga et al.

(10) Patent No.: US 6,260,840 B1
(45) Date of Patent: Jul. 17, 2001

(54) SHEET FEEDING APPARATUS, IMAGE FORMING APPARATUS HAVING THE SAME AND IMAGE READING APPARATUS HAVING THE SAME

(75) Inventors: Takeshi Suga, Mishima; Takashi Yano, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/416,948

(22) Filed: Oct. 13, 1999

(30) Foreign Application Priority Data

Oct. 14, 1998 (JP) ..... 10-291960
May 13, 1999 (JP) ..... 11-132397

(51) Int. Cl.[7] ..... B65H 5/00

(52) U.S. Cl. ..... 271/10.12; 271/10.01; 271/10.09; 271/10.11; 271/10.13

(58) Field of Search ..... 271/114, 10.01, 271/10.09, 10.11, 10.12, 10.13, 117, 118, 121, 125, 122

(56) References Cited

U.S. PATENT DOCUMENTS 4,523,832 * 6/1985 Strutt et al. ..... 399/388
4,526,358 7/1985 Ura et al. ..... 271/34

(List continued on next page.)

FOREIGN PATENT DOCUMENTS 33 34 522 3/1984 (DE) .
0 567 112 10/1993 (EP) .
0 754 637 1/1997 (EP) .
62-153027 7/1987 (JP) .
64-002951 1/1989 (JP) .
1-032134 2/1989 (JP) .
1-32134 6/1989 (JP) .
1-162440 11/1989 (JP) .
3-018532 1/1991 (JP) .
5-32334 2/1993 (JP) .
6-064769 3/1994 (JP) .
6-64769 3/1994 (JP) .
7-017652 1/1995 (JP) .
9-226963 9/1997 (JP) .

*Primary Examiner*—Christopher P. Ellis
*Assistant Examiner*—Jeffrey A. Shapiro
(74) *Attorney, Agent, or Firm*—Fitzpatrick, Cella, Harper & Scinto

(57) ABSTRACT

A sheet feeding apparatus including a movable sheet supporting device for supporting a sheet, a sheet feeding device urged against the sheet supported by the sheet supporting device and adapted to rotate in a sheet feeding direction to feed the sheet, a feeding device disposed at a downstream side of the sheet feeding device in the sheet feeding direction and adapted to feed the sheet fed from the sheet feeding device, a separating roller adapted to rotate in a sheet restoring direction to restore the sheet fed from the sheet feeding device, a drive transmitting device for stopping rotation of the sheet feeding device toward the sheet feeding direction before a leading end of the sheet fed out from the sheet supporting device by the sheet feeding device reaches the feeding device and then for rotating the sheet feeding device in the sheet feeding direction again, and a pressing and retracting device for moving the sheet supporting device which abutted the sheet against the sheet feeding device before the leading end of the sheet fed out from the sheet supporting device by the sheet feeding device reaches the feeding device, thereby effecting the abutment-releasing between the sheet feeding device and the sheet.

21 Claims, 35 Drawing Sheets

U.S. PATENT DOCUMENTS

| | | | | |
|---|---|---|---|---|
| 5,016,866 | | 5/1991 | Takahashi | 271/122 |
| 5,104,113 | * | 4/1992 | Kameyama et al. | 271/124 |
| 5,199,696 | * | 4/1993 | Kato | 371/10.13 |
| 5,312,098 | | 5/1994 | Inoue | 271/122 |
| 5,344,134 | * | 9/1994 | Saeki et al. | 271/122 |
| 5,386,983 | * | 2/1995 | Ando | 271/118 |
| 5,443,359 | * | 8/1995 | Miller et al. | 414/798.9 |
| 5,628,042 | * | 5/1997 | Less | 399/78 |
| 5,678,127 | | 10/1997 | Suga | 399/45 |
| 5,678,817 | * | 10/1997 | Saito et al. | 271/122 |
| 5,681,036 | * | 10/1997 | Wakahara et al. | 271/10.12 |
| 5,863,036 | * | 1/1999 | Tanaka et al. | 271/10.11 |
| 5,984,297 | | 11/1999 | Tanaka | 271/118 |
| 6,055,409 | * | 4/2000 | Richards et al. | 399/388 |
| 6,168,146 | * | 1/2001 | Komuro et al. | 271/10.12 |

* cited by examiner

INITIAL POSITION

INTERMEDIATE PLATE PRESSURE COMPLETE POSITION ( θ1 REVOLUTION)

PRE-FEED START POSITION ( θ2 REVOLUTION)

INTERMEDIATE PLATE PRESSURE RELEASE COMPLETE POSITION ($\theta 4$ REVOLUTION)

PRE-FEED COMPLETE POSITION ($\theta 3$ REVOLUTION)

RE-FEED COMPLETE POSITION (INITIAL POSITION) (ONE REVOLUTION) (COMPLETION

RE-FEED START POSITION ($\theta 5$ REVOLUTION)

INITIAL STATE
(DRAW CLUTCH ON)

INTERMEDIATE PLATE 70
PRESSURE COMPLETION

PRE-FEED START

PRE-FEED COMPLETION

RE-FEED START

INTERMEDIATE PLATE 70
RELEASE COMPLETION

REGISTRATION LOOP
FORMATION COMPLETION

RE-FEED COMPLETION

INITIAL POSITION

INTERMEDIATE PLATE PRESSURE COMPLETE POSITION ($\theta$1 REVOLUTION)

PRE-FEED START POSITION ($\theta$2 REVOLUTION)

INTERMEDIATE PLATE PRESSURE RELEASE COMPLETE POSITION (θ4 REVOLUTION)

RE-FEED COMPLETE POSITION (INITIAL POSITION) (ONE REVOLUTION) (COMPLETION

PRE-FEED COMPLETE POSITION (θ3 REVOLUTION)

RE-FEED START POSITION (θ5 REVOLUTION)

INITIAL STATE

INTERMEDIATE PLATE 70
PRESSURE COMPLETION

PRE-FEED START AT SHEET
FEEDING SPEED V1

PRE-FEED COMPLETION
(SHEET FEEDING
(ROLLER STOP)

RE-FEED START AT SHEET FEEDING SPEED V2

REGISTRATION LOOP FORMATION COMPLETION (DRAW CLUTCH STOP)

INTERMEDIATE PLATE 70 RELEASE COMPLETION

RE-FEED COMPLETION

INITIAL POSITION

INTERMEDIATE PLATE PRESSURE COMPLETE POSITION ( θ1 REVOLUTION)

PRE-FEED START POSITION ( θ2 REVOLUTION)

INTERMEDIATE PLATE PRESSURE RELEASE COMPLETE POSITION (θ4 REVOLUTION)

RE-FEED COMPLETE POSITION (INITIAL POSITION) (ONE REVOLUTION) (COMPLETION

PRE-FEED COMPLETE POSITION (θ3 REVOLUTION)

RE-FEED START POSITION (θ5 REVOLUTION)

INITIAL STATE
(DRAW CLUTCH ON)

INTERMEDIATE PLATE 70
PRESSURE COMPLETION

PRE-FEED START

PRE-FEED COMPLETION

INTERMEDIATE PLATE 70 RELEASE COMPLETION

RE-FEED START

RE-FEED COMPLETION

REGISTRATION LOOP FORMATION COMPLETION

INITIAL POSITION

INTERMEDIATE PLATE PRESSURE COMPLETE POSITION ( θ1 REVOLUTION)

PRE-FEED START POSITION ( θ2 REVOLUTION)

INTERMEDIATE PLATE PRESSURE RELEASE COMPLETE POSITION ($\theta 4$ REVOLUTION)

RE-FEED COMPLETE POSITION (INITIAL POSITION) (ONE REVOLUTION) (COMPLETION

PRE-FEED COMPLETE POSITION ($\theta 3$ REVOLUTION)

RE-FEED START POSITION ($\theta 5$ REVOLUTION)

INTERMEDIATE PLATE 70 PRESSURE COMPLETION

INITIAL STATE

PRE-FEED COMPLETION (SHEET FEEDING (ROLLER STOP)

PRE-FEED START AT SHEET FEEDING SPEED V1

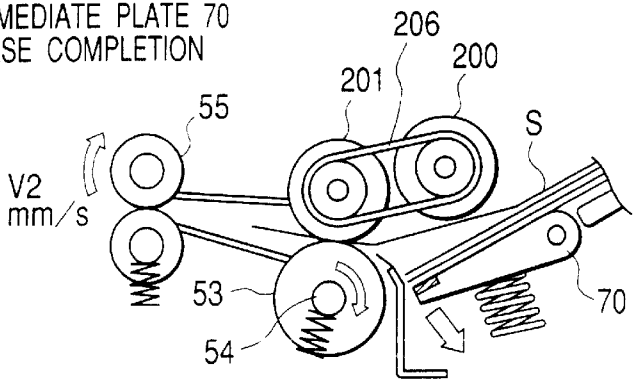
FIG. 20E
INTERMEDIATE PLATE 70 RELEASE COMPLETION
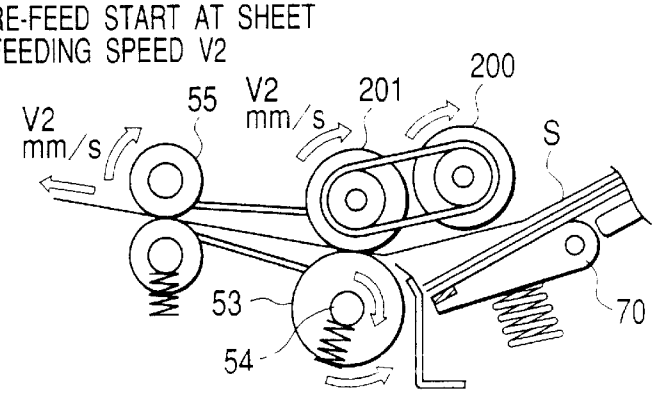
FIG. 20F
RE-FEED START AT SHEET FEEDING SPEED V2
FIG. 20G
RE-FEED COMPLETION
FIG. 20H
REGISTRATION LOOP FORMATION COMPLETION (DRAW CLUTCH STOP)

| | CONDITION | THE FIRST EARLIER TECHNOLOGY |
|---|---|---|
| EXPRESSION (1) | SHEET FEED CONDITION | Pb>0.633Ta−0.671Pa |
| EXPRESSION (2) | SEPARATION CONDITION | Pb<1.92Ta−2Pa |

| | CONDITION | THE FIRST EARLIER TECHNOLOGY |
|---|---|---|
| EXPRESSION (1) | SHEET FEED CONDITION | Pb>0.633Ta−0.671Pa |
| EXPRESSION (2) | SEPARATION CONDITION | Pb<1.43Ta−2Pa |

| | CONDITION | THE INVENTION |
|---|---|---|
| EXPRESSION (4) | SHEET FEED CONDITION | Pb>0.633Ta |
| EXPRESSION (5) | SEPARATION CONDITION | Pb<1.92Ta |
| EXPRESSION (3) | PRE-FEED CONDITION | Pb>0.633Ta−0.671Pa |

| | CONDITION | THE INVENTION |
|---|---|---|
| EXPRESSION (4) | SHEET FEED CONDITION | Pb>Ta |
| EXPRESSION (5) | SEPARATION CONDITION | Pb<1.43Ta |
| EXPRESSION (3) | PRE-FEED CONDITION | Pb>0.633Ta−0.671Pa |

SHEET FEEDING APPARATUS, IMAGE FORMING APPARATUS HAVING THE SAME AND IMAGE READING APPARATUS HAVING THE SAME

BACKGROUND OF THE INVENTION

1. Field of the Invention

The present invention relates to a sheet feeding apparatus used in an image forming apparatus such as a copying machine, a printer and the like or in an image reading apparatus such as a facsimile, a scanner and the like.

2. Related Background Art

In the past, for example, in the sheet feeding portion of a copying machine or the like, sheet separation using a retard roller rotated in a direction opposite to a sheet feeding direction has mainly been used as sheet feeding means for preventing more than one sheets from being fed simultaneously (referred to as "double-feed" hereinafter).

Now, a conventional sheet feeding apparatus using a retard separation system will be briefly described.

FIG. 26 is a schematic side view of a sheet feeding apparatus of retard separation type comprising a sheet feeding roller (sheet pick-up roller) and a separating roller (refer to Japanese Patent Application Laid-open No. 3-18532, U.S. Pat. No. 5,016,866). This is referred to as a first earlier technology hereinafter.

As shown in FIG. 26, sheets S stacked on an intermediate plate 506 in a cassette 507 are lifted together with the intermediate plate 506 by a pressing arm 508 and a sheet pressing spring 505 to be always urged against a sheet feeding roller 501, thereby providing sheet feeding pressure.

Further, the sheet feeding roller 501 receives retard pressure from a separating roller 502. In this state, when the sheet feeding roller 501 is rotated in a sheet feeding direction, the sheet S urged against the sheet feeding roller 501 is picked up to reach a nip between the sheet feeding roller 501 and the separating roller 502. At this time, if a single sheet is pinched by the nip, the separating roller 502 is rotatingly driven in the sheet feeding direction by rotation of the sheet feeding roller 501 due to the presence of a torque limiter 503 formed integrally with a shaft of the separating roller, thereby feeding the sheet S.

However, if a plurality of sheets are pinched by the nip, the separating roller 502 is rotated with predetermined torque in a direction along which the double-fed sheets are returned, with the aid of the torque limiter 503, thereby preventing the sheet double-feed.

FIGS. 27 and 28 are schematic side views of a sheet feeding apparatus using a retard separation system constituted by a planetary gear mechanism (refer to Japanese Patent Publication No. 1-32134). This is referred to as a second earlier technology hereinafter.

As shown in FIG. 27, the sheet feeding apparatus utilizes a planetary gear mechanism comprising a sun gear 601, an intermediate gear 602, a planetary gear 603 and a connecting arm 604, and a sheet feeding roller 607 is connected to the planetary gear 603. Further, a separating roller 609 is connected to a drive shaft 606 through a torque limiter, and a pair of draw rollers 610 for feeding a sheet S at a speed higher than a speed at which the sheet feeding roller 607 feeds the sheets S are disposed at a downstream side of the sheet feeding roller 607 in a sheet feeding direction.

Now, an operation of the sheet feeding apparatus will be briefly described with reference to FIG. 28.

First of all, by rotating the drive shaft 606, the planetary gear 603 and the sheet feeding roller 607 are revolved in a direction indicated by the arrow A, with the result that the sheet feeding roller 607 abuts against an uppermost sheet S of a sheet stack contained within a sheet cassette. Further, in synchronous with such revolution, a lever 618 lifts an intermediate plate 623 on which the sheets are stacked toward the sheet feeding roller (in a direction indicated by the arrow G).

By this operation, the sheet S urged against the sheet feeding roller 607 is sent to a nip between the sheet feeding roller 607 and the separating roller 609, thereby effecting separation and feed of the sheet. Further, the sheet S left the nip enters into the pair of draw rollers 610, and the planetary gear mechanism and the sheet feeding roller 607 are returned to their original positions by transmitting a driving force of the pair of draw rollers 610 to the planetary gear mechanism through the sheet S. And, such operation is repeated.

Although two earlier technologies in the sheet feeding mechanism are shown, it is considered that such technologies can be improved in several points.

First, in the mechanism according to the first earlier technology, the sheets S stacked on the intermediate plate 506 within the cassette 507 are lifted together with the intermediate plate 506 by the sheet pressing spring 505 to be always urged against the sheet feeding roller 501. Thus, a sheet feed/separation condition greatly depends upon the pressure of the intermediate plate, with the result that an optimum sheet feeding area is limited in consideration of the pressure of the intermediate plate as a function.

In particular, since the pressures of the intermediate plate generated by the sheet pressing spring 505 vary with the number of sheets stacked within the cassette 507, the sheet feed/separation condition differs between a case where the cassette 507 is loaded up with the sheets and a case where a several number of sheets are stacked. Further, since the sheet S is always urged against the sheet feeding roller 501, the pressure of the intermediate plate always acts on the stacked sheets S. Thus, while the uppermost sheet S is being fed, a next or succeeding sheet S' is subjected to a feeding force due to friction between the sheets, with the result that the double-feed of sheet S' will easily occur.

In addition, even if the double-fed sheets are separated and tried to be restored, the sheets are pinched between the sheet feeding roller 501 and the intermediate plate 506 so that the double-fed sheets may not be restored smoothly.

Further, an allowable range of the appropriate sheet feed area is further limited in dependence upon the kind of sheet (for example, sheet having great coefficient of friction) and reduction of coefficients of friction of the sheet feeding roller and the separating roller due to wears of the sheet feeding roller and the separating roller, thereby worsening the stability.

Therefore, it is hard to say that this mechanism is a sheet feeding mechanism having high stability and high reliability.

Incidentally, in this mechanism, in order to make it so the double-feed is hard to occur and the double-fed sheets can easily be restored, the restoring force provided by the torque limiter 503 must be set to a greater value or the retard force of the retard spring must be decreased considerably or the feeding pressure provided by the sheet pressing spring 505 must be decreased considerably.

However, in many cases, slip between the sheet feeding roller 501 and the sheet and/or between the separating roller 502 and the sheet may easily be generated, with the result that the wear of the sheet feeding roller 501 and the separating roller 502 is accelerated, thereby reducing the service life of the sheet feeding roller 501 and the separating roller 502 greatly. As a result, the number of periodical replacing operation for worn parts is increased to increase the maintenance cost of the apparatus. Further, torque of driving force applying means (motor) must be increased, thereby making the apparatus expensive and increasing power consumption.

Further, when the restoring force of the torque limiter 503 is set to a greater value, in a space Z formed between a nip X (between the sheet feeding roller 501 and the separating roller 502) and an abutment area between the sheet feeding roller 501 and the intermediate plate 506, it is considered that the double-fed sheet (particularly, thin sheet having poor rigidity) may be buckled, thereby causing sheet jam.

In addition, when a pair of feeding rollers are provided at a downstream side of the sheet feeding roller 501 and the separating roller 502 in the sheet feeding direction, the pair of feeding rollers must draw the sheet S (always pressurized) from the intermediate plate 506 and the nip between the sheet feeding roller 501 and the separating roller 502, with the result that greater load will act on the pair of feeding rollers, thereby shortening the service life of the pair of feeding rollers.

Furthermore, since the intermediate plate 506 is always urged against the sheet feeding roller 501 by the sheet pressing spring 505, if this conventional technology is applied to a manual sheet feeding portion, when the operator sets the sheets, he must press the intermediate plate 506 down against the sheet pressing spring 505 to create a gap between the intermediate plate 506 and the sheet feeding roller 501 and insert the sheets into the gap.

This results in poor operability, so that an operator sheet setting failure may easily occur, which would lead to sheet jam and skew feed.

Next, in the mechanism according to the second earlier technology, the sheet feeding roller 607 is urged against and separated (retracted) from the stacked sheets S so that the intermediate plate 623 is pivotally moved by the lever 618 in upward and downward directions accordingly, thereby effecting pressurizing and releasing operations with respect to the sheet feeding roller 607. Namely, when the sheets S stacked on the intermediate plate 623 are fed, the sheets S are pinched by the sheet feeding roller 607 and the intermediate plate 623 from above and below.

Further, the retracting operation of the sheet feeding roller 607 and the lowering operation of the lower 618 are effected by utilizing the feeding force obtained when the fed sheet S is pinched between the pair of draw rollers 610. Accordingly, the stacked sheets S are pinched between the sheet feeding roller 607 and the intermediate plate 623 until a leading end of the fed sheet S reaches the nip of the pair of draw rollers 610.

Since the sheet feeding roller 607 is urged against the sheets S during the separating operation, the sheet are hard to be separated, and, further, since the leading end of the sheet S reaches the nip of the pair of draw rollers 610 during the urge, there is no timing for restoring the double-fed sheets.

In consideration of the sheet feed/separation condition, the sheet feeding mechanism according to the second earlier technology is the same as the sheet feeding mechanism according to the first earlier technology. Thus, as is in the first earlier technology, in this mechanism, since the appropriate sheet feed area is narrow, it is hard to say that it has high stability and high reliability. Further, the construction is very complicated and the number of parts is great.

Further, since the releasing of the pressure of the sheet feeding roller 607 against the sheet S and the revolving operation of the planetary gear mechanism and the sheet feeding roller 607 are effected by the feeding force of the pair of draw rollers 610, great feeding load acts on the pair of draw rollers, thereby reducing the service life of the draw rollers.

As a problem common to the above two earlier technologies, there is a problem that stability and reliability of sheet feeding and separating operations cannot be maintained adequately because the pressure of the intermediate plate influences the sheet feeding/separation condition. Further, during the separating operation, since the sheets stacked on the intermediate plate are urged against the sheet feeding roller, double-feed occurs easily and there is no timing for restoring the double-fed sheets, and, in dependence upon the kind of sheet, the sheet may be buckled to cause sheet jam.

SUMMARY OF THE INVENTION

The present invention aims to eliminate the above-mentioned conventional drawbacks, and an object of the present invention is to ensure sheet feeding and separating operations, to improve stability and reliability of a sheet feeding apparatus, to reduce a maintenance cost of the apparatus and to make the apparatus simpler, more compact and inexpensive.

According to the present invention, there is provided a sheet feeding apparatus comprising movable sheet supporting means for supporting a sheet, sheet feeding means to be urged against the sheet supported by the sheet supporting means to rotate in a sheet feeding direction to feed the sheet, feeding means disposed at a downstream side of the sheet feeding means in the sheet feeding direction to feed the sheet fed from the sheet feeding means, a separating roller for rotating in a sheet restoring direction to restore the sheet to separate the sheet fed from the sheet feeding means, drive transmitting means for stopping rotation of the sheet feeding means in the sheet feeding direction before a leading end of the sheet fed out from the sheet supporting means by the sheet feeding means reaches the feeding means and then for rotating the sheet feeding means in the sheet feeding direction again, and pressing and retracting means for moving the sheet supporting means which places the sheet into pressure contact with the sheet feeding means to release the pressure contact between the sheet feeding means and the sheet before the leading end of the sheet fed out from the sheet supporting means by the sheet feeding means reaches the feeding means.

BRIEF DESCRIPTION OF THE DRAWINGS

FIGS. 20A, 20B, 20C, 20D, 20E, 20F, 20G and 20H are views showing operations of a roller and an intermediate plate in the alteration;

DESCRIPTION OF THE PREFERRED EMBODIMENTS

Now, a sheet feeding apparatus according to the present invention will be fully described.

Figure 1:
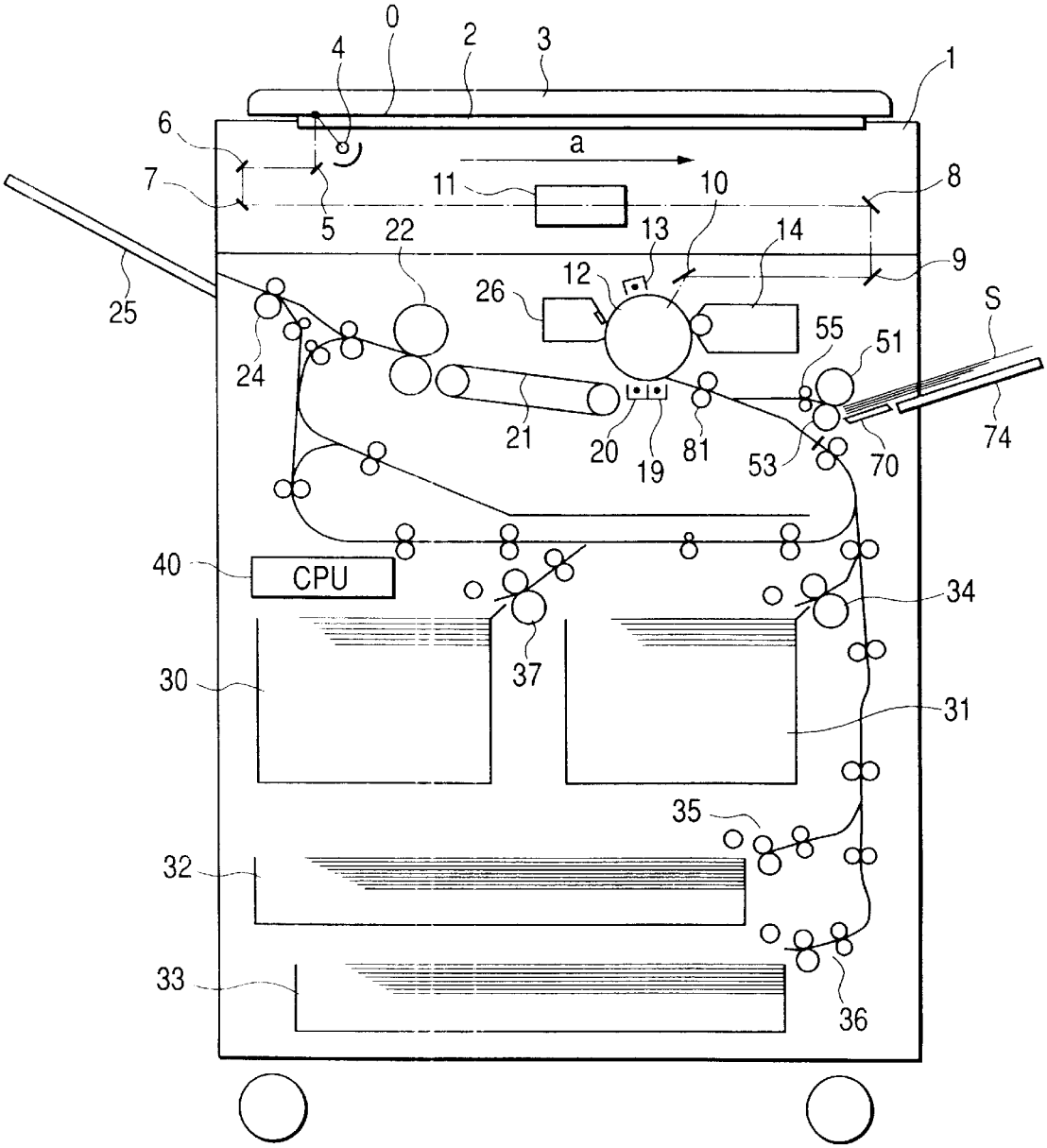
FIG. 1 is a schematic sectional view of a copying machine having a sheet feeding apparatus according to the present invention.

First of all, an image forming apparatus having a sheet feeding apparatus according to the present invention will be briefly explained. FIG. 1 is a schematic sectional view of a copying machine as image forming apparatus. In FIG. 1, an original glass plate 2 formed from a transparent glass plate is secured to an upper part of a main body 1 of the copying machine. An original pressure cover 3 serves to press and fix an original 0 resting on the original glass plate 2 at a predetermined position thereof with an imaged surface facing downwardly.

Below the original glass plate 2, there is provided an optical system comprising a lamp 4 for illuminating the original 0, reflection mirrors 5, 6, 7, 8, 9, 10 for directing a light image of the illuminated original 0 to a photosensitive drum 12, and an imaging lens 11 for imaging the light image. Incidentally, the lamp and the reflection mirrors 4, 5, 6, 7 are moved at a predetermined speed in a direction indicated by the arrow a to scan the original 0.

As sheet feeding portions, there are provided cassette sheet feeding portions 34, 35, 36, 37 for feeding sheets stacked in sheet cassettes 30, 31, 32, 33 contained within the main body 1 of the copying machine to an image forming portion, a sheet feeding portion 51, 53, 55, 70 (referred to as "multi sheet feeding portion" hereinafter) for continuously feeding sheets having various materials and sizes from a sheet feeding tray 74 to the image forming portion.

The image forming portion includes the photosensitive drum 12, a charger 13 for uniformly charging a surface of the photosensitive drum 12, a developing unit 14 for forming a toner image to be transferred to the sheet S, by developing an electrostatic latent image formed by the light image illuminated on the surface of the photosensitive drum 12 charged by the charger 13 from the optical system, a transfer charger 19 for transferring the toner image developed on the surface of the photosensitive drum 12 onto the sheet S, a separation charger 20 for separating the sheet S to which the toner image is transferred from the photosensitive drum 12, and a cleaner 26 for removing residual toner from the photosensitive drum 12 after the transferring of the toner image.

At a downstream side of the image forming portion, there are provided a transporting portion 21 for transporting the sheet S to which the toner image is transferred, and a fixing unit 22 for fixing the image on the sheet S transported by the transporting portion 21 as a permanent image. Further, there are provided discharge rollers 24 for discharging the sheet S to which the image is fixed by the fixing unit 22 out of the main body 1 of the copying machine, and a discharge tray 25 for receiving the sheet S discharged by the discharge rollers 24 is also provided outside of the main body 1 of the copying machine.

Next, the multi sheet feeding portion of the image forming apparatus according to an embodiment of the present invention will be fully explained.

Figure 2:
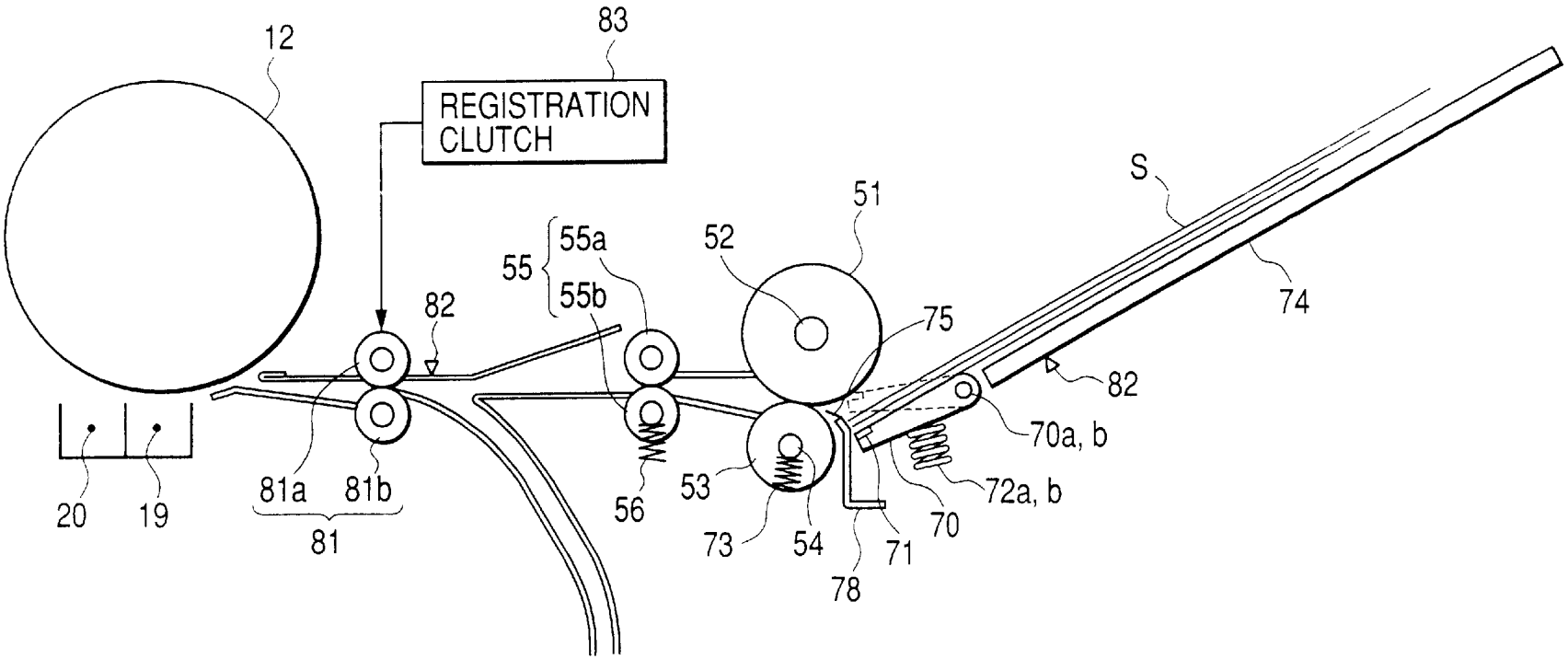
FIG. 2 is a sectional view of the sheet feeding apparatus according to an embodiment of the present invention.
Figure 3:
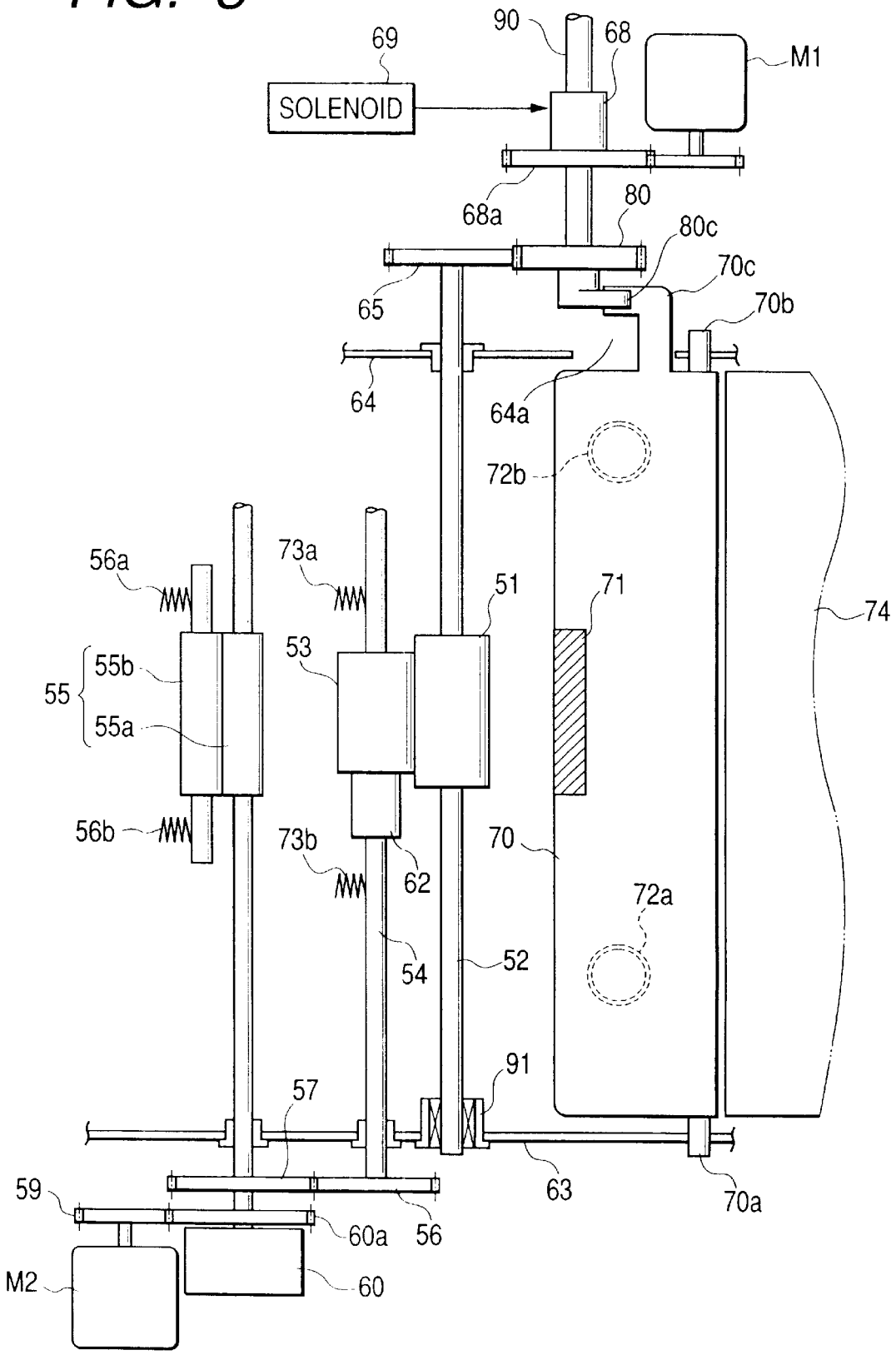
FIG. 3 is a drive development view (plan view) of the sheet feeding apparatus according to the embodiment of the present invention.

FIG. 2 is a sectional view showing the multi sheet feeding portion and a drum portion, and FIG. 3 is a drive development view (plan view) of the multi sheet feeding portion. The main body 1 of the copying machine is provided with a multi sheet feeding tray 74 for stacking and supporting a sheet bundle S. The multi sheet feeding tray 74 is provided with a sheet detecting sensor 82 comprising a photo-interrupter or the like for detecting presence/absence of the sheet S on the tray 74.

An intermediate plate (sheet supporting means) 70 is pivotally movable around fulcrums 70*a*, 70*b* with respect to front and rear side plates 63, 64 and is biased toward a clockwise direction (FIG. 2) (direction along which the intermediate plate is urged against a sheet feeding roller 51) by compression springs (pressing and retracting means) 72*a*, 72*b* so that the sheet supported by the intermediate plate can be brought into pressure contact with the sheet feeding roller 51 as sheet feeding means (as shown by the broken line in FIG. 2) and released from the pressure contact (as shown by the solid line in FIG. 2) by a pressing and retracting portion which will be described later.

Further, a felt 71 for preventing double-feed of sheets S and for relieving shock on pressing the intermediate plate 70 against the sheet feeding roller 51 is provided on an abutment portion (against the sheet feeding roller 51) of a distal end of the intermediate plate 70. The sheet feeding roller 51 is secured to a sheet feeding roller support shaft 52, and the support shaft 52 is rotatably supported by the front and rear side plates 63, 64 in such a manner that the sheet feeding roller 51 is not rotated reversely (in an anti-clockwise direction in FIG. 2) by the action of a one-way clutch 91 disposed between the front side plate 63 and the support shaft 52.

Further, a sheet feeding drive gear (serving in parts as drive transmitting means) 65 is secured to a rear end of the support shaft 52. A control gear (serving in part as drive transmitting means) 80 engageable with the sheet feeding drive gear 65 and having two toothless portions 80*a*, 80*b* opposed to the sheet feeding drive gear 65.

Further, a cam (pressing and retracting means) 80*c* for bringing the sheets supported by the intermediate plate 70 into pressure contact with the sheet feeding roller 51 and releasing the pressure contact is integrally formed with the control gear 80.

A cam follower (pressing and retracting means) 70*c* is integrally formed on a rear end of the intermediate plate 70. The cam follower 70*c* extends up to the cam 80*c* through a hole 64*a* formed in the rear side plate 64 to engage with the cam 80*c* so that the clockwise rotation (FIG. 2) of the intermediate plate 70 is regulated.

Further, the control gear 80 is secured to a drive shaft 90 having a spring clutch 68. One revolution of the spring clutch 68 is controlled by turning ON a control solenoid 69 for the spring clutch 68 by a time of $T_1$ (sec). The phase angles of the spring clutch 68 and the toothless portion 80*a* are selected so that the toothless portion 80*a* of the control gear 80 is normally opposed to the sheet feeding drive gear 65.

With this arrangement, in an initial state, the sheet feeding drive gear 65, the support shaft 52 and the sheet feeding roller 51 can be rotated in a sheet feeding direction with no load.

A pair of draw rollers (conveying means) 55 are disposed at a downstream side of the sheet feeding roller 51 in the sheet feeding direction. A drive shaft of the drive draw roller 55*a* is rotatably supported by the front and rear side plates 63, 64 via bearings (not shown), and an electromagnetic clutch 60 is provided on an end of the drive shaft so that a driving force from a draw motor M2 can be connected to and disconnected from the drive shaft via gears 59, 60*a*.

The driven draw roller 55*b* is urged against the drive draw roller 55*a* via bearings (not shown) by springs 56*a*, 56*b*. Further, a gear 57 is secured to the drive shaft of the drive draw roller 55*a* so that a driving force can be transmitted to a drive shaft 54 of a separating roller via a gear 56.

Incidentally, since the gears 57, 56 are secured to the drive shaft of the drive draw roller 55*a* and the drive shaft 54 of a separating roller 53, respectively, the pair of draw rollers 55 are rotated synchronously with the drive shaft 54 of the separating roller 53. Further, the gears 57, 56 are selected so that the drive draw roller 55*a* is rotated in the sheet feeding direction (clockwise direction in FIG. 2) and the drive shaft 54 of the separating roller 53 is rotated in a direction opposite to the sheet feeding direction (clokwise direction in FIG. 2).

Namely, when the electromagnetic clutch 60 is turned ON, the driving force of the draw motor M2 is transmitted, with the result that the drive draw roller 55*a* is rotated in the sheet feeding direction and at the same time the drive shaft 54 of the separating roller 53 is rotated in the direction opposite to the sheet feeding direction.

Further, the separating roller 53 is rotatably supported on the drive shaft 54 via a torque limiter 62 for generating predetermined torque. The separating roller 53 is opposed to the sheet feeding roller 51 and is urged against the sheet feeding roller 51 with predetermined retard pressure by springs 73*a*, 73*b* via bearings (not shown).

Incidentally, a torque value of the torque limiter 62 and retard pressure of the separating roller 53 provided by the springs 73*a*, 73*b* are selected so that, when only a single sheet or no sheet exists in a nip between the sheet feeding roller 51 and the separating roller 53, the separating roller 53 follows the sheet feeding roller 51 by a friction force (also, the separating roller is stopped when the sheet feeding roller 51 is stopped) and, only when two or more sheets exist in the nip, the separating roller 53 is rotated reversely to generate a restoring force.

Further, an abutment plate 78 against which the sheets abut when the operator sets the sheets on the sheet feeding tray is secured between the separating roller 53 and the intermediate plate 70. A guide 75 formed from a thin plate made of polyethylene or SUS and adapted to guide a leading end of the sheet to the nip between the sheet feeding roller 51 and the separating roller 53 is provided on a distal end of the abutment plate 78. With this arrangement, the leading end of the sheet is prevented from abutting against the separating roller 53 to prevent the leading end of the sheet from being wound or bent.

Next, the drive transmitting means and the pressing and retracting means for the sheet feeding roller 51 and the intermediate plate 70 will be fully explained.

As mentioned above, at the engagement position of the sheet feeding drive gear 65, there is provided the control gear 80 formed integrally with a first gear portion 80*d* and a second gear portion 80*e* engageable with the sheet feeding drive gear 65, two toothless portions 80*a*, 80*b* and a cam 80*c* through which the intermediate plate 70 is urged against and retracted from the sheet feeding roller 51. As mentioned above, one revolution of the control gear 80 can be controlled by the spring clutch 68 and the solenoid 69. Incidentally, since the construction of the spring clutch 68 does not relates to the present invention, detailed explanation thereof will be omitted.

Since the phase angle of the spring clutch 68 and the configuration and position of the first toothless portion 80*a* are selected so that the first toothless portion 80*a* of the control gear 80 is opposed to the sheet feeding drive gear 65 in the initial state, although the sheet feeding roller support shaft 52 can be rotated, the rotation of the support shaft 52 in the direction opposite to the sheet feeding direction is regulated by the one-way clutch 91.

Further, the cam 80*c* abuts against the cam follower 70*c* provided at the end of the intermediate plate 70, and the configuration of the cam 80*c* and the phase angle of the toothless portion 80*a* with the cam 80*c* are selected so that the intermediate plate 70 is retracted from the sheet feeding roller 51 against the compression springs 72*a*, 72*b* in the initial state. Thus, when the operator sets the sheet bundle, since the intermediate plate 70 is retracted from the sheet feeding roller 51 so that the pressure between the intermediate plate 70 and the sheet feeding roller 51 is released, the sheet bundle can easily be inserted until it abuts against the abutment plate 78.

Next, the sheet feeding operation and the separating operation effected by the drive transmitting means and the pressing and retracting means will be explained.

Figure 4A:
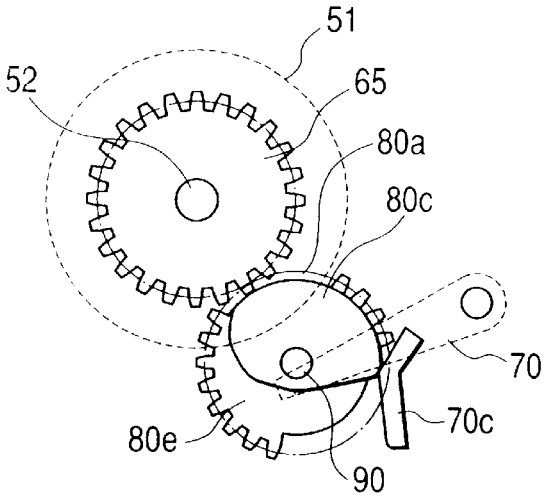
FIGS. 4A, 4B, 4C, 4D, 4E, 4F and 4G are views showing an operation of a control gear in an embodiment of the present invention.
Figure 4B:
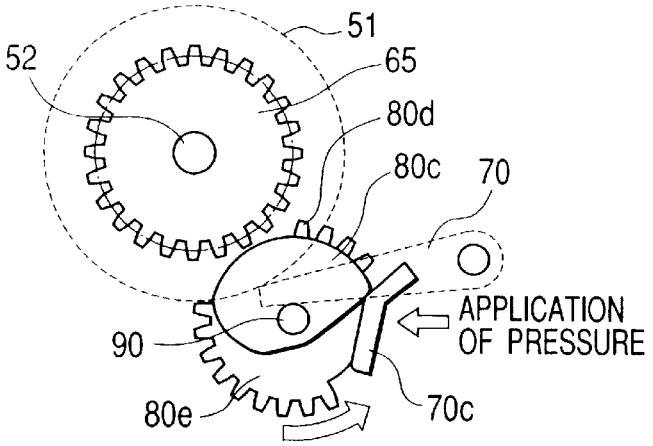
Figure 4C:
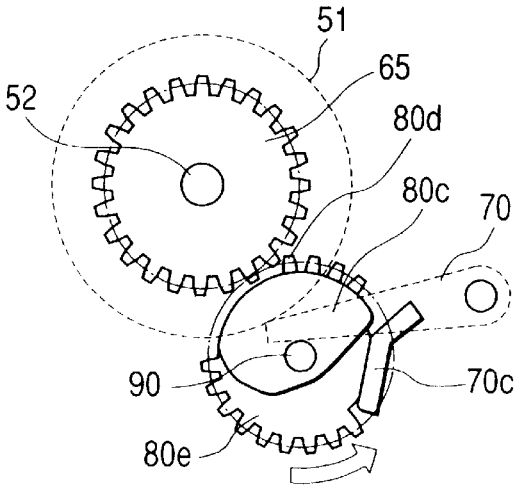
Figure 5A:
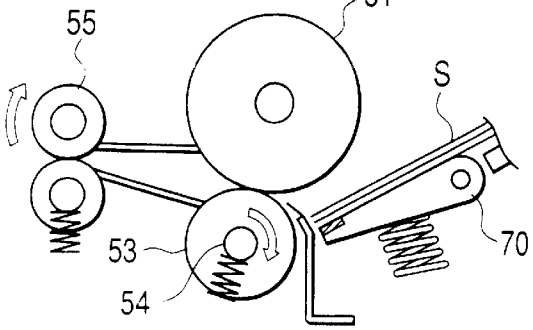
FIGS. 5A, 5B, 5C, 5D, 5E, 5F, 5G and 5H are views showing operations of a roller and an intermediate plate in an embodiment of the present invention.
Figure 5B:
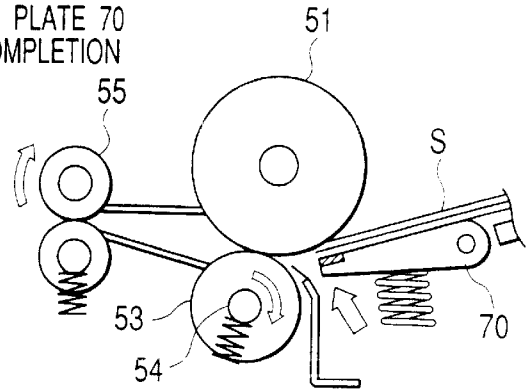
Figure 5C:
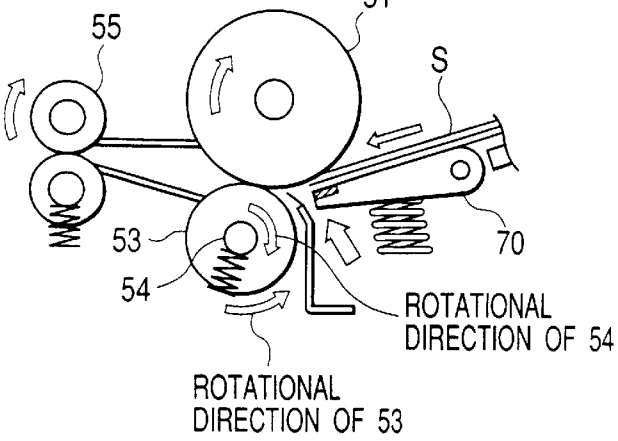
Figure 5D:
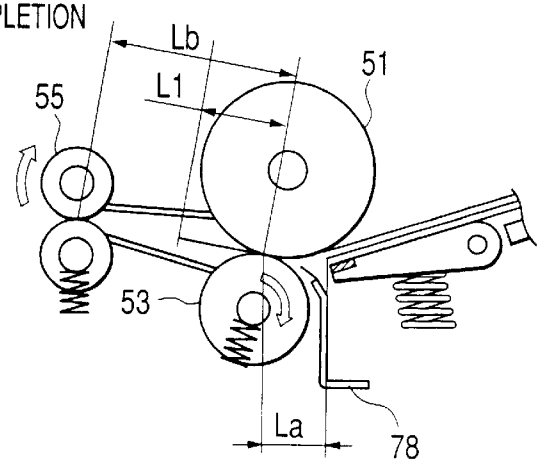

When the solenoid 69 is turned ON by the time of T1 (sec), under the action of the spring clutch 68, the control gear 80 starts to rotate. The control gear 80 is rotated in an anti-clockwise direction in FIG. 4A to rotate the cam 80*c* from an intermediate plate retracting position to an intermediate plate pressing position θ1. During this rotation, the cam 80*c* is separated from the cam follower 70*c,* with the result that the intermediate plate 70 is moved to be urged against the sheet feeding roller 51. As a result, an uppermost sheet S in the sheet bundle resting on the sheet feeding tray 74 is brought into pressure contact with the sheet feeding roller 51 (FIGS. 4B and 5B).

When the control gear 80 is further rotated up to a position θ2 the first gear portion 80*d* of the control gear 80 is engaged by the sheet feeding drive gear 65, thereby rotating the sheet feeding drive gear 65 through a predetermined angle A°.

In response to this rotation, the sheet feeding roller 51 is rotated through the angle A° to feed out the uppermost sheet S in the sheet bundle by a predetermined amount L1 (the sheet feeding operation till now is referred to as "pre-feeding operation" hereinafter) (FIGS. 4C, 4D and 5C, 5D).

Incidentally, when it is assumed that an outer diameter of the sheet feeding roller 51 is D, the feeding amount L1 in the pre-feeding operation is represented by the following expression:

$$L1=A^\circ\times\pi\times D/360^\circ \qquad \text{(Expression A)}$$

The number of teeth of the first gear 80*d* is selected so that the sheet feeding amount $L_1$ becomes greater than a distance La from the sheet abutment plate 78 to the nip between the sheet feeding roller 51 and the separating roller 53 and smaller than a distance Lb from the nip to the pair of draw rollers 55.

Further, the rotating speed of the sheet feeding drive gear 65 at this time is selected by determining the rotating speed of the sheet feeding motor M1 and the number of teeth of the gears and diameters of rollers so that the sheet feeding speed of the sheet feeding roller 51 becomes equal to the feeding speeds of the pair of draw rollers 55 and a pair of registration rollers 81.

When the control gear 80 continues to rotate up to a position θ3 to bring the second toothless portion 80*b* to the sheet feeding drive gear 65 (FIGS. 4D and 5D), the driving force is not transmitted to the sheet feeding drive gear 65, thereby stopping the sheet feeding roller 51 temporarily. Incidentally, since the number of teeth of the first gear 80*d* is selected as mentioned above, regardless of the sheet feeding start position of the sheet S, the leading end of the sheet S fed by the amount L1 in the pre-feeding operation can surely be stopped temporarily between the nip and the pair of draw rollers 55.

Figure 4E:
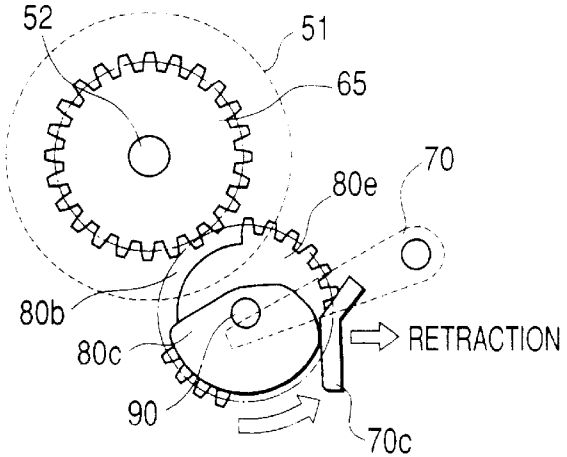
Figure 4D:
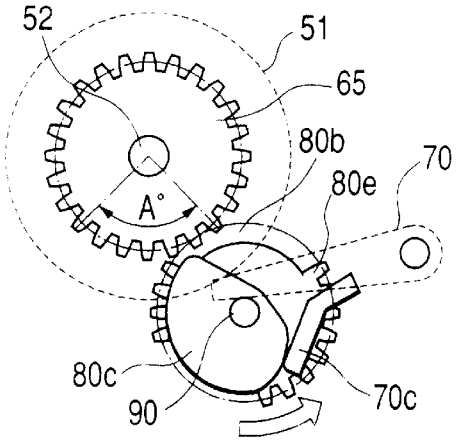
Figure 5F:
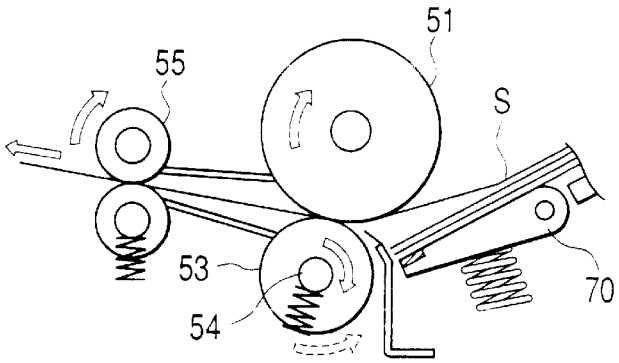
Figure 5E:
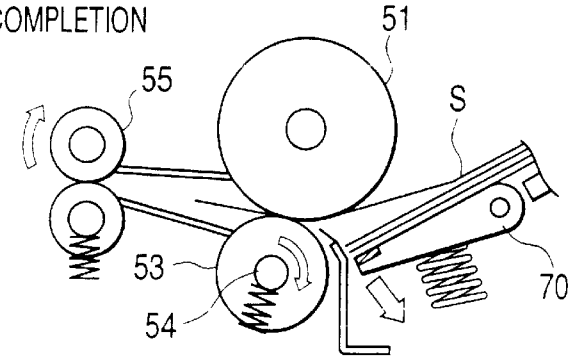
Figure 5H:
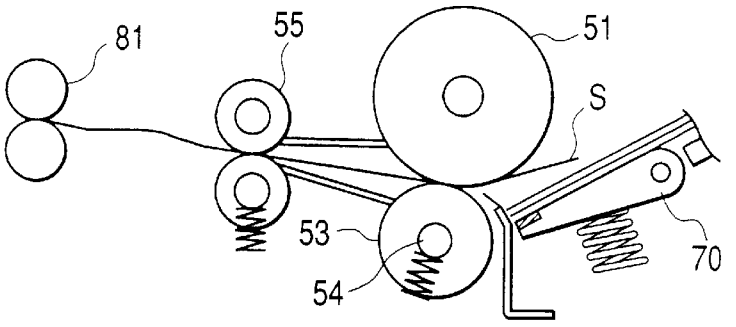

Thereafter, when the control gear 80 is rotated up to a position θ4 to restore the cam 80*c* to the intermediate plate retracting position, the cam 80*c* is engaged by the cam follower 70*c,* with the result that the pressure of the intermediate plate 70 against the sheet feeding roller 51 is released (FIGS. 4E and 5E). Incidentally, a time period for stopping the sheet feeding roller 51 after the pre-feeding operation is set as a separating operation time for surely restoring the sheet double-fed by the among L1 in the pre-feeding operation onto the intermediate plate 70.

When the control gear 80 is further rotated up to a position θ5 to engage the second gear portion 80*e* of the control gear 80 with the sheet feeding drive gear 65 (FIGS. 4F and 5F), the rotation of the sheet feeding drive gear 65 is started again, with the result that the sheet feeding drive gear 65 is rotated through a predetermined angle B°, thereby starting the sheet feeding operation of the sheet feeding roller 51 (the sheet feeding operation after the pre-feeding operation is referred to as "re-feeding" hereinafter).

Incidentally, the sheet feeding amount L2 of the sheet feeding roller 51 at this time becomes:

$$L_2=B^\circ\times\pi\times D/360^\circ \qquad \text{(Expression B)}$$

The feeding amount L2 in the re-feeding is selected by setting the number of teeth of the second gear portion 80*e* so that the leading end of the sheet S fed in front of the pair of draw rollers 55 in the pre-feeding operation is surely received by the pair of draw rollers 55 and does not reach the pair of registration rollers 81.

Figure 4G:
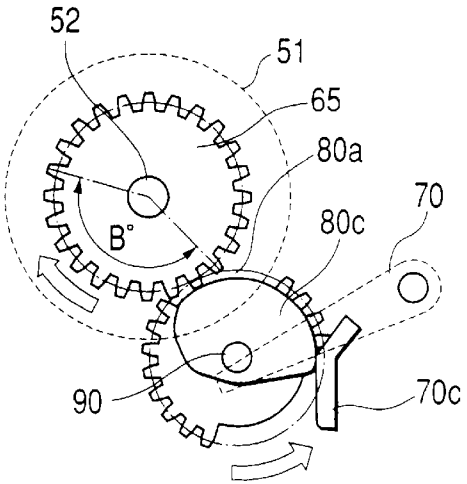
Figure 4F:
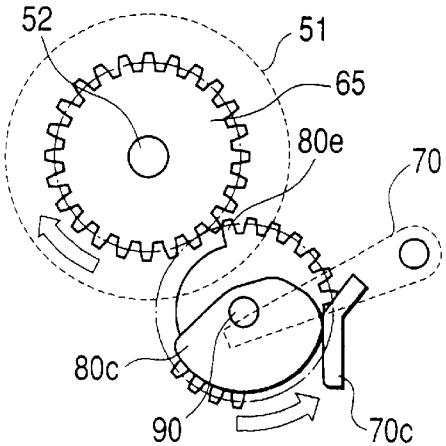
Figure 5G:
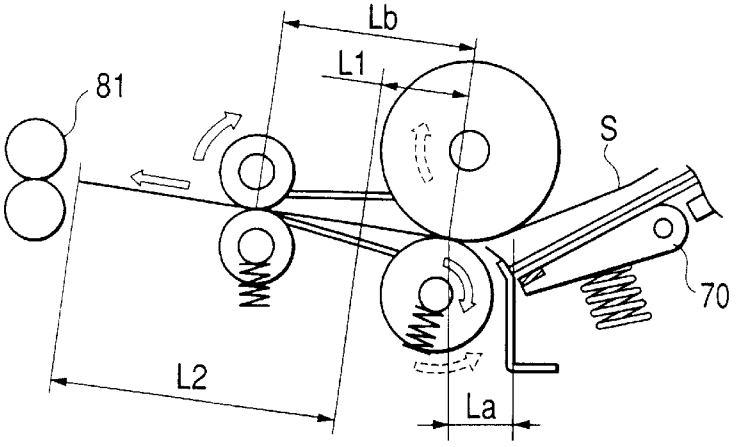

Further, when the rotation of the control gear 80 is continued to bring the first toothless portion 80*a* to a position opposite to the sheet feeding drive gear 65, the driving force is not transmitted to the sheet feeding drive gear 65, thereby stopping the sheet feeding roller 51. The rotation of the control gear 80 is finished and the control gear is stopped at the initial position (FIGS. 4G and 5G).

Now, a reason why the sheet S fed in the pre-feeding operation is temporarily stopped in front of the pair of draw rollers 55 will be described.

When the control gear 80 is not engaged by the sheet feeding drive gear 65, the sheet feeding roller 51 is not rotated. Thus, the sheet fed by the feeding amount L1 is also stopped in that state. Meanwhile, the cam 80*c* abuts against the cam follower 70*c,* thereby lowering the intermediate plate 70. If the sheet S double-fed in the pre-feeding operation exists in the nip between the sheet feeding roller 51 and the separating roller 53, after the separating roller 53 is rotated in the direction opposite to the sheet feeding direction to effect the separating operation, the sheet feeding roller 51 which is stopped for the predetermined time starts a re-feeding operation to feed the sheet S up to the pair of draw rollers 55.

Such a series of operations are performed always at predetermined timings by the control gear 80, the sheet feeding drive gear 65, the cam 80*c* and the cam follower 70*c*.

By stopping the sheet S temporarily, the series of operating timings from the pre-feeding to the re-feeding can always be kept constant. Thus, stability of sheet feed can be improved.

Further, when the pressure of the sheet supported on the intermediate plate 70 is released, the sheet S is stopped so that the position of the leading end of the sheet S can be controlled with high accuracy. Thus, the distance from the nip between the sheet feeding roller 51 and the separating roller 53 to the pair of draw rollers 55 can be shortened. Therefore, the apparatus can be made more compact. Further, by stopping the sheet S temporarily, the time period for separating the sheet can be preserved. Since the separating operation can be effected after the intermediate plate 70 urged against the sheet feeding roller 51 is retracted from the sheet feeding roller 51, the sheet can be separated surely and stably.

Figure 6:
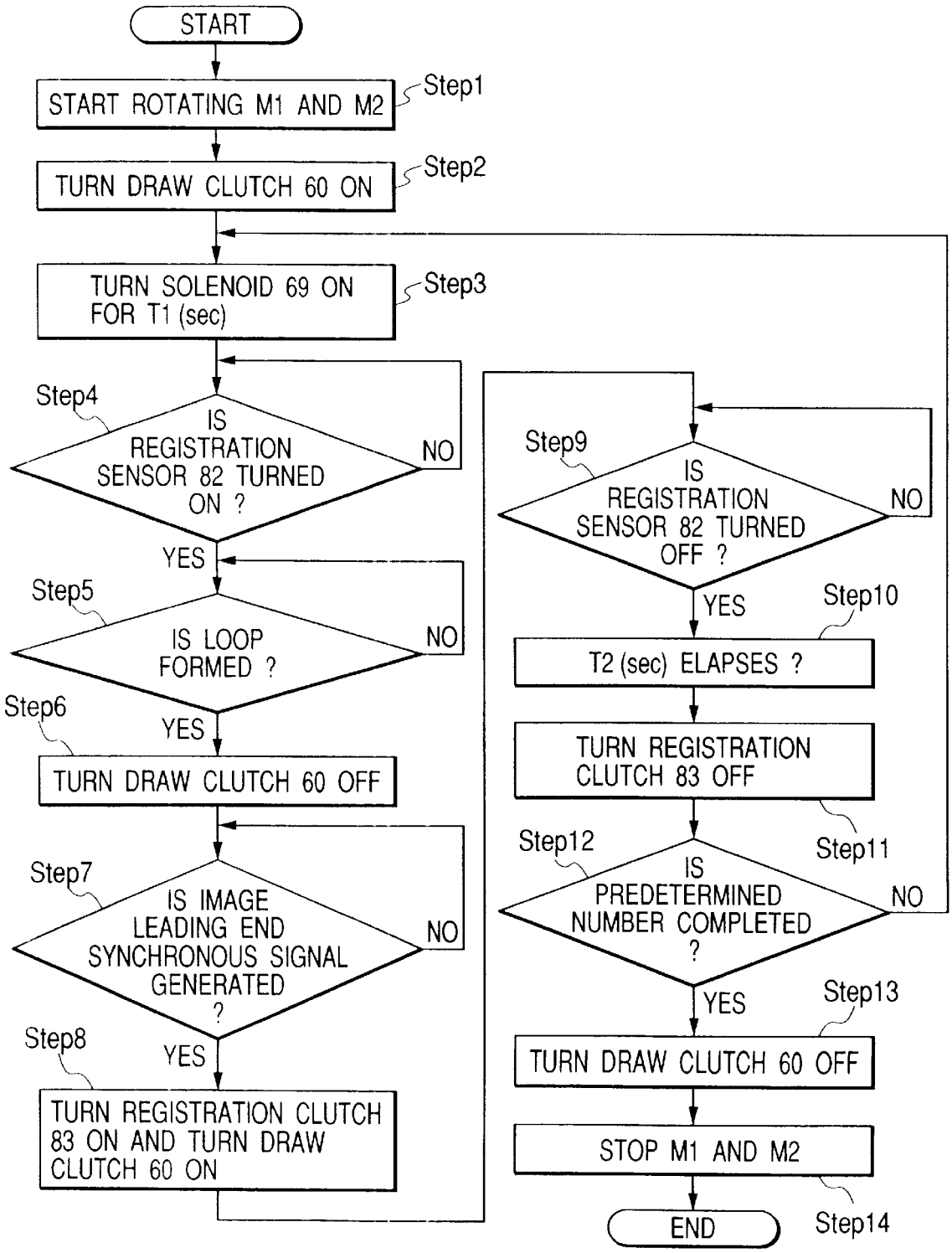
FIG. 6 is a flowchart showing a sheet feeding operation in an embodiment of the present invention.
Figure 7:
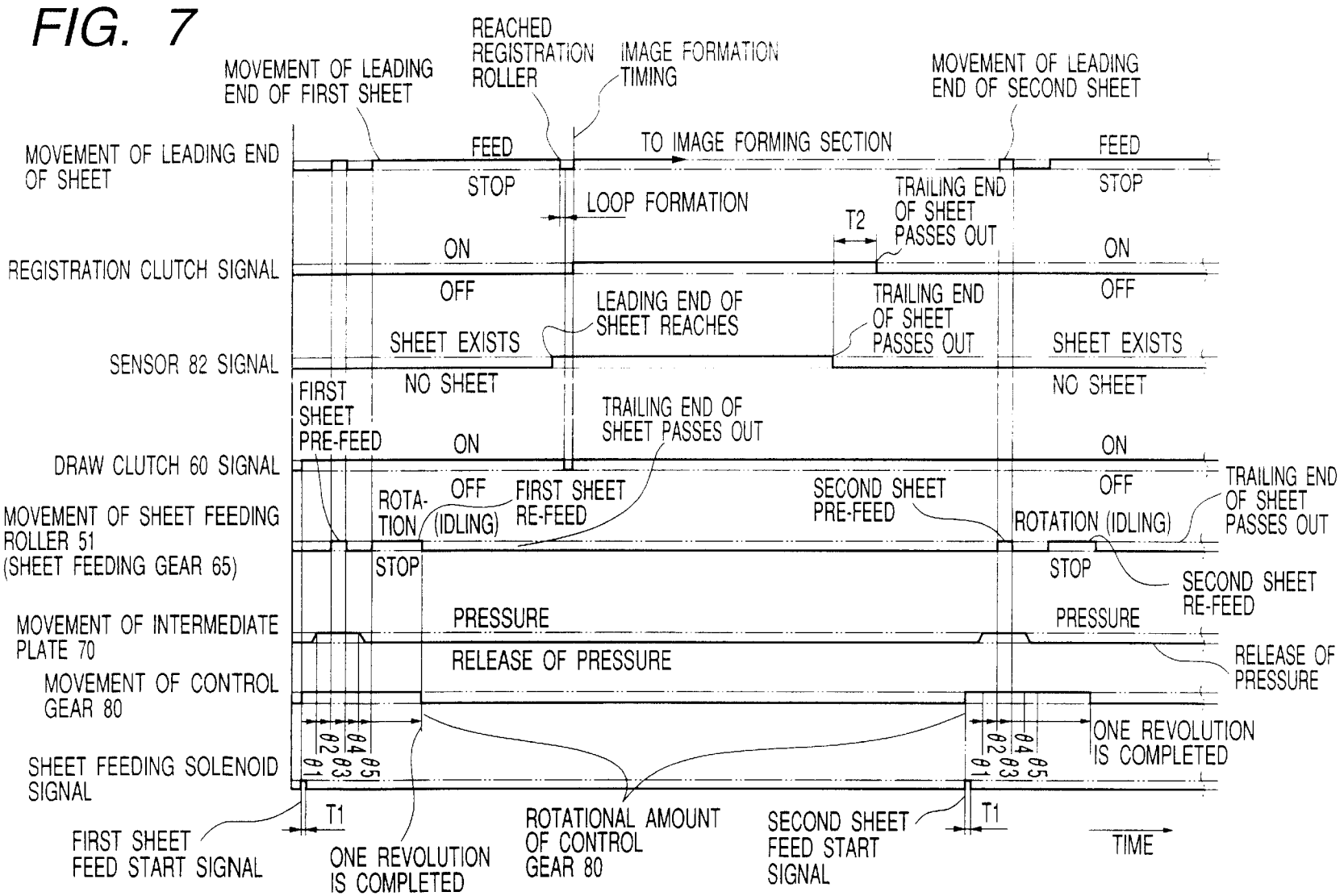
FIG. 7 is a timing chart showing a sheet feeding operation in an embodiment of the present invention.

Next, the sheet feeding operation using the multi sheet feeding portion will be explained with reference to a flowchart shown in FIG. 6 and a timing chart shown in FIG. 7.

In a state that the sheet bundle is resting on the sheet feeding tray 74, when a start button (not shown) is depressed, the draw motor M2 and the sheet feeding motor M1 start to rotate (step 1), and an ON signal of the draw clutch 60 is emitted from a CPU 40 (step 2).

As a result, as mentioned above, the pair of draw rollers 55 start to rotate in the sheet feeding direction and the drive shaft 54 of the separating roller 53 is rotated in the direction opposite to the sheet feeding direction, and the predetermined restoring force is generated in the separating roller 53 by torque generated by the torque limiter 62. However, the separation roller 53 is still maintained in the stopped state by the friction force between the separating roller 53 and the sheet feeding roller 51 rotation of which is regulated by the action of the one-way clutch 91.

Then, after a predetermined time period has elapsed, the solenoid 69 is turned ON by a time period T1 (sec) on the basis of a signal from the CPU 40 (step 3) to start control of one revolution of the control gear 80. By this operation, as mentioned above, first of all, the sheet bundle on the intermediate plate 70 abuts against the sheet feeding roller 51. Then, the sheet feeding roller 51 is rotated through the predetermined angle A° to feed out the uppermost sheet S in the sheet bundle rested on the tray 74 by the pressing force of the intermediate plate 70 and the friction force between the sheet and the sheet feeding roller 51 by the predetermined amount L1 (the pre-feeding operation).

Incidentally, the separation roller 53 is driven in the sheet feeding direction by the rotation of the sheet feeding roller 51. By the way, in the above-mentioned pre-feeding operation, if two or more sheets are fed in an overlapped state (i.e., if double-feed occurs), the separating roller 53 acts to restore the double-fed sheet(s). At this time, however, since the intermediate plate 70 urges the sheet feeding roller 51 via the intermediate plate spring 72, the separating operation of the separating roller 53 may be obstructed so as not to restore the double-fed sheet(s).

However, when the control gear 80 is further rotated, the sheet feeding roller 51 is stopped temporarily, thereafter the sheets on the intermediate plate 70 is released from the pressure of the sheet feeding roller 51 by the action of the cam 80*c* and the cam follower 70*c*. At this time, since the turned-ON state of the draw clutch 60 is maintained, the drive shaft 54 of the separating roller 53 continues to rotate in the direction opposite to the sheet feeding direction, and the restraint of the double-fed sheet(s) is released due to the pressure release.

At this point, the separating roller 53 starts to rotate in the restoring direction until the double-fed sheet(s) caused by the above sheet feeding operation do not exist in the nip between the sheet feeding roller 51 and the separating roller 53, thereby avoiding the double-feed certainly. Incidentally, in the state that only a single sheet is pinched by the nip between the sheet feeding roller 51 and the separating roller 53, the sheet feeding roller 51, the separating roller 53 and the sheet S can be maintained in the stationary state by the action of the one-way clutch 91 and the friction forces between the sheet S and the sheet feeding roller 51 and between the sheet S and the separating roller 53.

When the control gear 80 is further rotated, the sheet feeding roller 51 starts the re-feeding operation to re-feed the sheet S which is stopped temporarily so that the leading end of the sheet S is received by the pair of draw rollers 55. After the sheet is fed by the sheet feeding roller 51 by the predetermined distance L2 in the re-feeding operation, one revolution of the control gear 80 is completed to stop the sheet feeding roller 51. However, since the pair of draw rollers 55 continue to rotate, the sheet S is fed up to the pair of registration rollers 81.

At this time, since the first toothless portion 80a of the control gear 80 is opposed to the sheet feeding drive gear 65, any load does not act on the sheet feeding roller 51. Thus, the sheet feeding roller 51 is subjected to the rotational force from the sheet S fed by the pair of draw rollers 55, with the result that the sheet feeding roller 51 is rotatingly driven (idle rotation) until a trailing end of the sheet S leaves the nip between the sheet feeding roller 51 and the separating roller 53.

Incidentally, in this drawing operation, since the intermediate plate 70 is retracted from the sheet feeding roller 51, a succeeding sheet is not subjected to a friction force from the sheet S being drawn. Thus, the succeeding sheet is not likely to be double-fed. However, if the succeeding sheet S should be double-fed, during the operation of the pair of draw rollers 55, since the drive shaft 54 of the separating roller 53 is rotated in the direction opposite to the sheet feeding direction and the intermediate plate 70 is retracted from the sheet feeding roller 51 to release the pressure contact at that point, the separating roller 53 starts to rotate reversely to restore the double-fed sheet, thereby avoiding the double-feed certainly.

Due to the above operation, the leading end of the sheet S is fed toward the nip of the pair of registration rollers 81. The sheet detecting sensor 82 comprising a photo-interrupter or the like is disposed at an upstream side of the pair of registration rollers 81 so that, when the leading end of the sheet S is detected by the sensor (step 4), by timer means (not shown) of the CPU 40 for counting a time corresponding to the distance between the sensor 82 and the pair of registration rollers 81, a signal for controlling the stop timing of the draw clutch 60 to form a proper loop between the pair of draw rollers 55 and the pair of registration rollers 81 is generated (step 6).

It is well known that such a loop is formed in the sheet S to correct skew-feed of the sheet. Further, by rotating the pair of registration rollers 81 in response to an image leading end synchronous signal emitted from the photosensitive drum 12 or the optical system for exposing the image, the sheet S is fed again to be sent onto the photosensitive drum 12, where a toner image is transferred onto the sheet.

When a predetermined time period T2 (sec) is elapsed after the trailing end of the sheet S leaves the sheet detecting sensor 82 to ascertain the fact that the trailing end of the sheet S surely leaves the nip of the pair of registration rollers 81, a registration clutch 83 is turned OFF (steps 9, 10 and 11). Incidentally, the sheet S to which the toner image was transferred is sent to the fixing unit 22, where the image is fixed to the sheet. Thereafter, the sheet is discharged onto the discharge tray 25.

The above-mentioned operations are repeated by times corresponding to the set number of sheets to be treated (step 12). When the predetermined number is completed, the draw clutch 60 is turned OFF (step 13), and then the sheet feeding motor M1 and the draw motor M2 are stopped (step 14), and the program is ended.

As fully mentioned above, since the pre-fed sheet S is temporarily stopped and the pressure of the sheet on the intermediate plate 70 against the sheet feeding roller 51 is released and the storing force of the separating roller 53 can be utilized at that time, the sheet(s) double-fed in the pre-feeding operation can surely be restored, thereby effecting high accurate sheet feeding.

Further, by stopping the pre-fed sheet S temporarily, since dispersion of the position of the leading end of the sheet during the pressure releasing of the sheet on the intermediate plate 70 can be minimized, the distance from the nip between the sheet feeding roller 51 and the separating roller 53 to the pair of draw rollers 55 can be shortened. Therefore, the entire apparatus can be made more compact.

Further, when the sheet S is fed by the pair of draw rollers 55, since the pressure contact between the sheets on the intermediate plate 70 and the sheet feeding roller 51 is released, the pair of draw rollers 55 are not subjected to the feeding load due to pinching pressure generated by the pressure between the intermediate plate 70 and the sheet feeding roller 51. Thus, the service life of the draw rollers can be extended.

Further, in the initial state, since the intermediate plate 70 is retracted from the sheet feeding roller 51, the setting of the sheets effected by the operator is not obstructed. When the operator sets the sheets, he may merely abut the leading end of the sheet bundle against the abutment plate 78. Thus, since the setting operation is very easy, occurrence of sheet jam and skew-feed due to poor setting can be reduced.

In addition, the interlocking operation between the intermediate plate 70 and the sheet feeding roller 51 is effected by the control gear 80 formed integrally with the cam 80*c* for controlling the intermediate plate 70 and the two toothless portions 80*a*, 80*b*. As a timing of pre-feeding the sheet, a timing of re-feeding the sheet, a timing of applying a pressure between the intermediate plate 70 and the sheet feeding roller 51, and a timing of releasing the pressure determined by the phase angles of the cam 80*c* and the toothless portions 80*a*, 80*b*, there are few factors for causing dispersion, with the result that the stable sheet feeding and separating operations can be effected with low cost.

Since the control for rotating and stopping the sheet feeding roller 51 and the application and release of the pressure of the intermediate plate 70 can be effected by one ON signal and one OFF signal for the solenoid 69, the control is very easy and the severe control accuracy is not requested.

Further, since the pair of draw rollers 55 are synchronous with the drive shaft 54 of the separating roller and the control thereof is effected by the single draw clutch 60, not only the apparatus can be simplified but also such control can be effected independently from the rotation of the sheet feeding roller 51. Thus, even in the state that the sheet feeding roller 51 is stopped, the restoring force of the separating roller 53 can be utilized, thereby providing the sheet feeding apparatus having high double-feed preventing ability.

Next, a multi sheet feeding portion of an image forming apparatus according to an alteration of the illustrated embodiment of the present invention will be explained.

Figure 8:
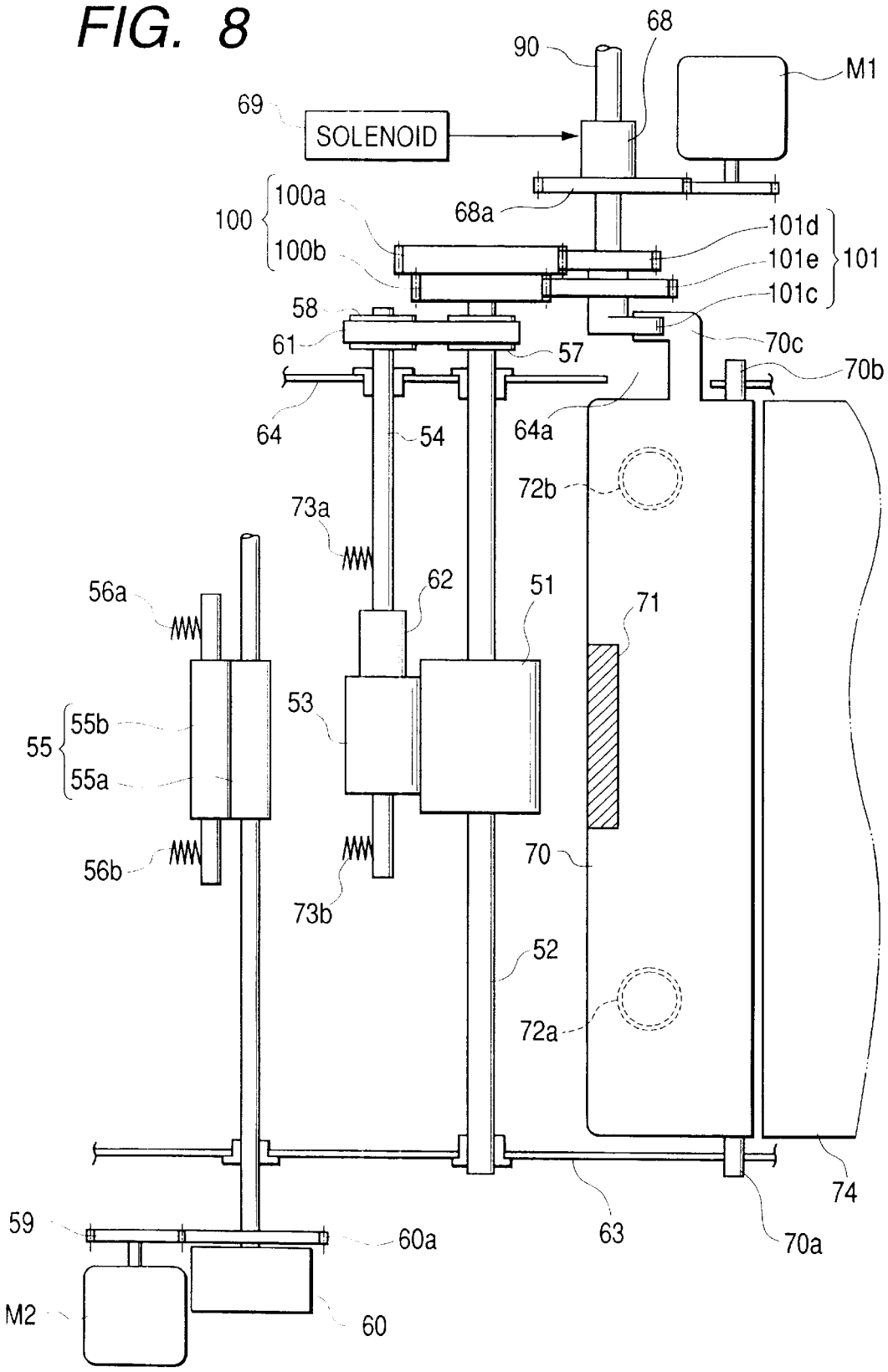
FIG. 8 is a drive development view (plan view) of a sheet feeding apparatus according to an alteration of the embodiment of the present invention.

FIG. 8 is a drive development view of a multi sheet feeding portion according to such an alteration. Incidentally, the same element as those in the above-mentioned illustrated embodiment are designated by the same reference numerals and explanation thereof will be omitted. In this alteration, a sheet feeding drive stage gear 100 as drive transmitting means comprising an integral forming of a large diameter gear 100*a* and a small diameter gear 100*b* is secured to the rear end of the support shaft 52 of the sheet feeding roller 51.

Further, a control gear (stage gear of the drive transmitting means) 101 having first and second sector gear portions 101*d*, 101*e* engageable with the large diameter gear 101*a* and the small diameter gear 100*b* of the sheet feeding drive stage gear 100 and two non-engagement portions 101*a*, 101*b* which are not engaged by the sheet feeding drive stage gear 100 is disposed in a confronting relationship to the large diameter gear 100*a* and the small diameter gear 100*b* of the sheet feeding drive stage gear 100. A cam (pressing and retracting means) 101*c* for bringing the sheets supported on the intermediate plate 70 into pressure contact with the sheet feeding roller (sheet feeding means) 51 and releasing the pressure contact is integrally formed with the control gear 101.

A cam follower 70*c* formed integrally with the rear end of the intermediate plate 70 and extending through a hole 64*a* of the rear side plate 64 up to an abutment position of the cam 101*c* can abut against the cam 101*c*. The control gear 101 is secured to a drive shaft 90 on which the spring clutch 68 is provided. One revolution (at a predetermined rotating speed) of the spring clutch 68 is controlled by transmitting the driving force of the sheet feeding motor M1 to the spring clutch 68 by turning ON the solenoid 69 for controlling the spring clutch 68 by a time of T1 (sec).

Further, a pulley (connecting means) 57 is secured to the rear end of the support shaft 52. Since a recipient pulley 58 to which a driving force is transmitted from a pulley 57 on the support shaft 52 through a belt 61 passed over the pulleys 57, 58 are secured to the shaft 54 of the separating roller 53, the shaft 54 of the separating roller 53 is rotated in the same direction as the support shaft 52 in synchronous with the rotation of the support shaft 52.

Phase angles of the spring clutch 68 and the non-engagement portion 101*a* are selected so that the non-engagement portion 101*a* of the control gear 101 is normally opposed to the sheet feeding drive stage gear 100. Further, in this alteration, the one-way clutch 91 disposed between the front side plate 63 and the support shaft 52 and used in the above-mentioned illustrated embodiment is omitted.

Thus, in the initial stage, although slight rotational load of the torque limiter 62 acts on the sheet feeding drive stage gear 100, the support shaft 52 and the sheet feeding roller 51, the sheet feeding drive stage gear 100, the support shaft 52 and the sheet feeding roller 51 can be rotated both in the sheet feeding direction and in the opposite direction.

Since the pair of draw rollers 55 disposed at the downstream side of the sheet feeding roller 51 in the sheet feeding direction and the members for driving the pair of draw rollers are the same as those in the above-mentioned embodiment, explanation thereof will be omitted. Further, since the setting of the torque value of the torque limiter 62 provided on the drive shaft 54 of the separating roller 53 is the same as the above-mentioned embodiment, explanation thereof will also be omitted.

The rotating speed of the draw motor M2 the outer diameter of the sheet feeding roller 51 and the number of teeth of the gears are selected so that the feeding speed of the pair of draw rollers 55 becomes a second feeding speed $V_2$ substantially equal to the feeding speed of the pair of registration rollers 81 (disposed at the downstream side of the pair of draw rollers 55 in the sheet feeding direction) for correcting the skew-feed of sheet and for synchronizing the sheet with the toner image on the photosensitive drum.

Next, the drive transmitting means and the pressing and retracting means for the sheet feeding roller 51 and the intermediate plate 70 will be fully explained with reference to FIGS. 9A to 9G and FIGS. 10A to 10H. As mentioned above, the control gear 101 formed integrally with the first and second sector gear portions 101*d*, 101*e* engageable with the large diameter gear 100*a* and the small diameter gear 100*b* of the sheet feeding drive stage gear 100, the two non-engagement portions 101*a*, 101*b* which are not engaged by the sheet feeding drive stage gear 100, and the cam 101*c* for applying a pressure between the intermediate plate 70 and the sheet feeding roller 51 and releasing the pressure is disposed in a confronting relationship to the sheet feeding drive stage gear 100.

As is in the aforementioned control gear 80, one revolution of the control gear 101 can be controlled by the spring clutch 68 and the solenoid 69. Incidentally, since the construction of the spring clutch 68 does not relates to the present invention, detailed explanation thereof will be omitted.

Since the phase angle of the spring clutch 68 and the configuration and position of the first non-engagement portion 101*a* are selected so that the first non-engagement portion 101*a* of the control gear 101 is normally opposed to the sheet feeding drive stage gear 100, the sheet feeding roller support shaft 52 can be rotated both in the sheet feeding direction and in the opposite direction.

Further, the cam 101*c* abuts against the cam follower 70*c* provided at the end of the intermediate plate 70, and the configuration of the cam 101*c* and the phase angle between the cam 101*c* and the non-engagement portion 101*a* are selected so that the cam 101*c* normally separates the intermediate plate 70 from the sheet feeding roller 51 against the force of the compression spring 72. Thus, when the operator sets the sheet bundle, since the intermediate plate 70 is retracted from the sheet feeding roller 51, the sheet bundle can easily be inserted until the sheet bundle abuts against the abutment plate 78.

Next, the sheet feeding and separating operations by using the drive transmitting means and the pressing and retracting means will be explained.

When the solenoid 69 is turned ON by the time T1 (sec), the control gear 101 starts to rotate under the action of the spring clutch 68. When the control gear 101 is rotated in an anti-clockwise direction in FIG. 9A, first of all, the cam 101*c* is rotated from the intermediate plate retracting position to the intermediate plate pressing position θ1. During this rotation, the cam 101*c* is separated from the cam follower 70*c*, thereby moving the intermediate plate 70 to be urged against the sheet feeding roller 51.

Figure 9A:
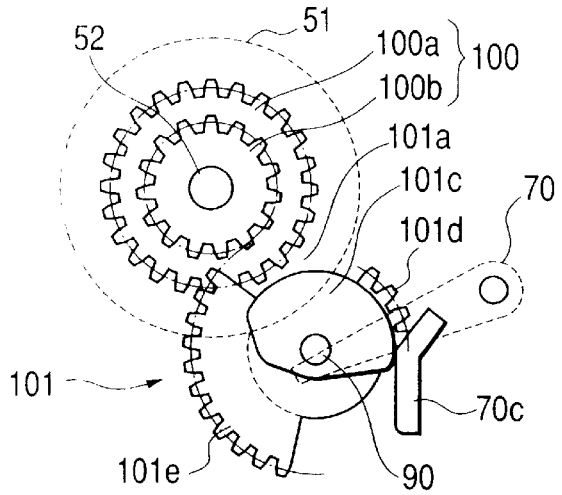
FIGS. 9A, 9B, 9C, 9D, 9E, 9F and 9G are views showing an operation of a control gear in the alteration.
Figure 9B:
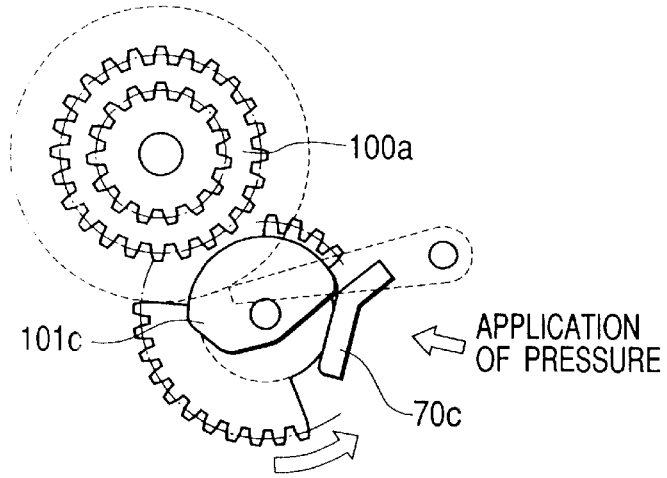
Figure 9C:
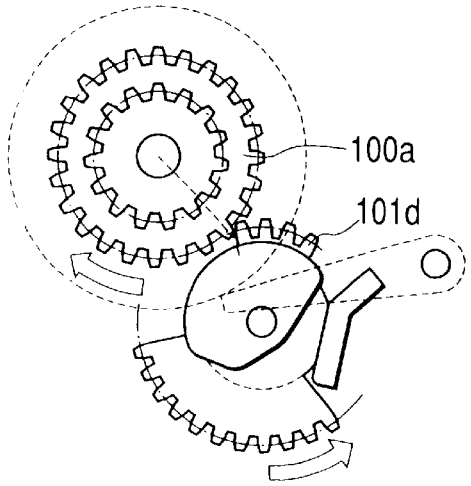
Figure 10A:
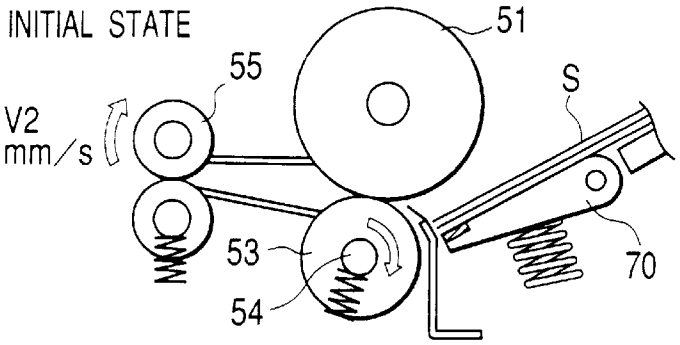
FIGS. 10A, 10B, 10C, 10D, 10E, 10F, 10G and 10H are views showing operations of a roller and an intermediate plate in the alteration.
Figure 10B:
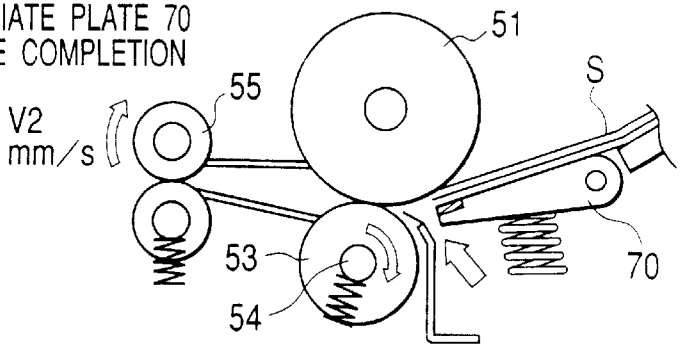
Figure 10C:
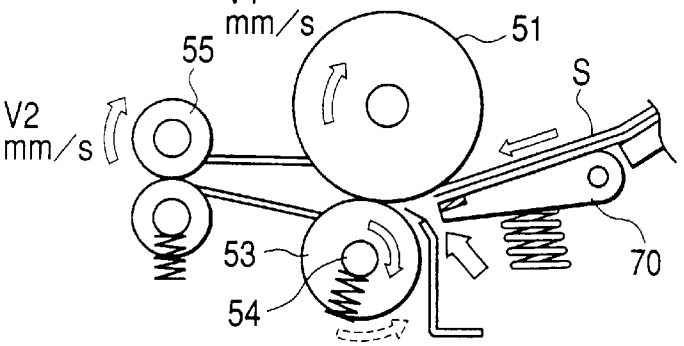
Figure 10D:
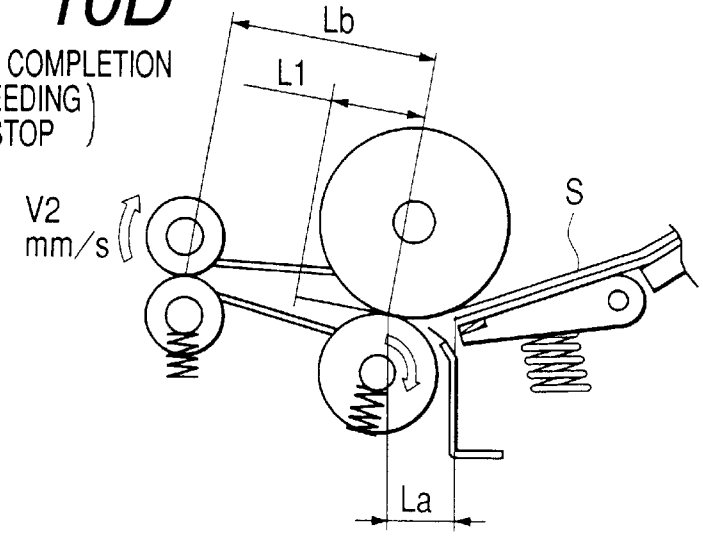
Figure 10F:
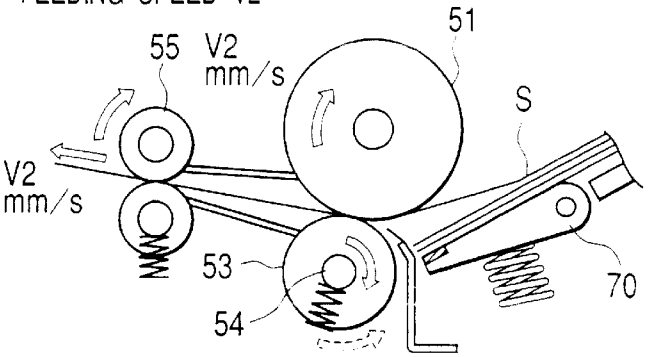
Figure 10H:
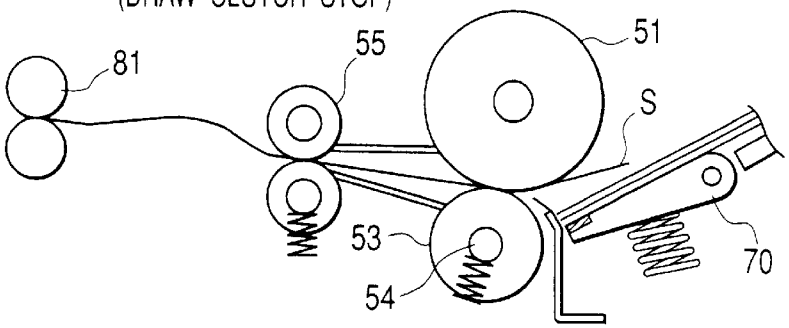

As a result, the uppermost sheet S in the sheet bundle rested on the sheet feeding tray 74 abuts against the sheet feeding roller 51 (FIGS. 9B and 10B).

When the control gear 101 is further rotated up to a position θ2, the first sector gear portion 101*d* of the control gear 101 is engaged by the large diameter gear portion 100*a* of the sheet feeding drive stage gear 100, thereby rotating the sheet feeding drive stage gear 100 through the predetermined angle E°.

Incidentally, the rotating speed of the sheet feeding motor M1 the outer diameter of the sheet feeding roller 51 and the number of teeth of the gears are selected so that the feeding speed of the sheet feeding roller 51 at this time becomes a first feeding speed V1 lower than the second feeding speed V2 provided by the pair of registration rollers 81 and the pair of draw rollers 55.

In response to this rotation, the sheet feeding roller 51 is rotated through the predetermined angle E° to feed out the uppermost sheet S in the sheet bundle by the predetermined amount L1 (this sheet feeding operation is referred to as "pre-feeding" operation) (FIGS. 9C, 9D, 10C and 10D).

Incidentally, when it is assumed that an outer diameter of the sheet feeding roller 51 is D, the feeding amount L1 in the pre-feeding operation is represented by the following expression:

$$L1=E^\circ\times\pi\times D/360^\circ \qquad \text{(expression C)}$$

The number of teeth of the first sector gear portion 101*d* is selected so that the sheet feeding amount $L_1$ in the pre-feeding operation becomes greater than a distance La from the sheet abutment plate 78 to the nip between the sheet feeding roller 51 and the separating roller 53 and smaller than a distance Lb from the nip to the pair of draw rollers 55.

When the control gear 101 continues to rotate up to a position θ3 to bring the second non-engagement portion 101*b* to a position opposite to the sheet feeding drive stage gear 100 (FIGS. 9D and 10D), the driving force is not transmitted to the sheet feeding drive stage gear 100, thereby stopping the sheet feeding roller 51 temporarily.

Incidentally, since the number of teeth of the large diameter gear 100*a* and the first sector gear portion 101*d* is selected as mentioned above, regardless of the sheet feeding start position of the sheet S, the leading end of the sheet S fed by the amount L1 in the pre-feeding operation can surely be stopped temporarily between the nip and the pair of draw rollers 55.

Figure 9E:
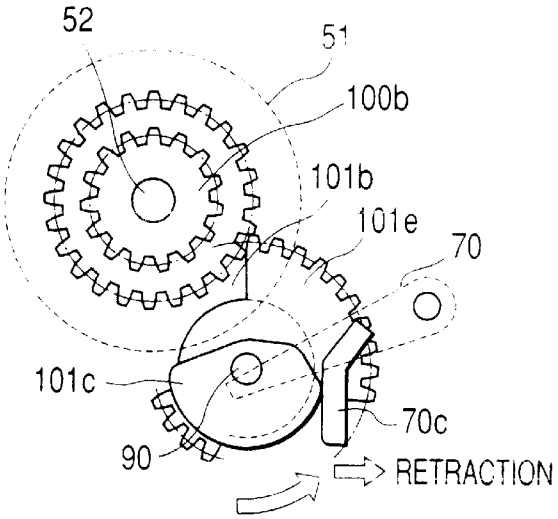
Figure 10E:
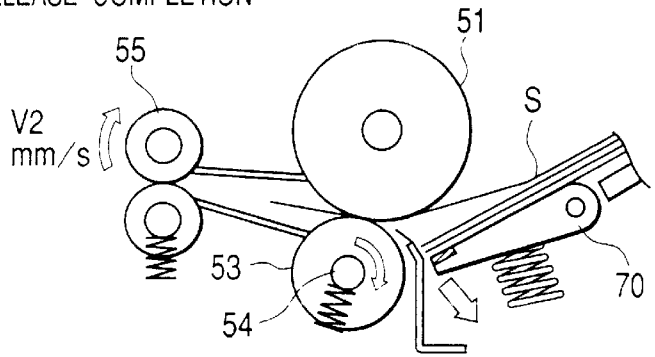

Thereafter, when the control gear 101 is rotated up to a position θ4 to restore the cam 101*c* to the intermediate plate retracting position, the cam 101*c* is engaged by the cam follower 70*c*, with the result that the intermediate plate 70 is moved to be retracted from the sheet feeding roller 51 so that the pressure of the sheet on the intermediate plate 70 against the sheet feeding roller 51 is released (FIGS. 9E and 10E).

When the control gear 101 is further rotated up to a position θ5 to engage the second sector gear portion 101*e* of the control gear 101 with the small diameter gear portion 100*b* of the sheet feeding drive stage gear 100 (FIGS. 9F and 10F), the rotation of the sheet feeding drive stage gear 100 is started again, with the result that the sheet feeding drive stage gear 100 is rotated through a predetermined angle F°, thereby starting the sheet feeding operation of the sheet feeding roller 51 again (the sheet feeding operation after the pre-feeding operation is referred to as "re-feeding" hereinafter).

Incidentally, the sheet feeding amount L2 of the sheet feeding roller 51 at this time becomes:

$$L2=F^\circ\times\pi\times D/360^\circ \qquad \text{(Expression D)}$$

The feeding amount L2 in the re-feeding operation is selected by setting the number of teeth of the second sector gear portion 101*e* so that the leading end of the sheet S fed in front of the pair of draw rollers 55 in the pre-feeding operation is surely received by at least the pair of draw rollers 55 and does not reach the pair of registration rollers 81.

Further, the diameter of the sheet feeding roller 51, a rotating speed of the sheet feeding motor M1 and the number of teeth of the gears are selected so tat the second feeding speed V2 of the sheet feeding roller 51 at this time becomes substantially equal to the feeding speeds of the pair of registration rollers 81 and the pair of draw rollers 55.

Figure 9G:
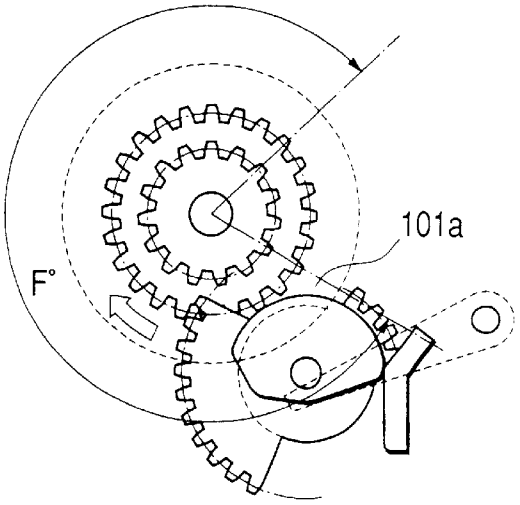
Figure 9D:
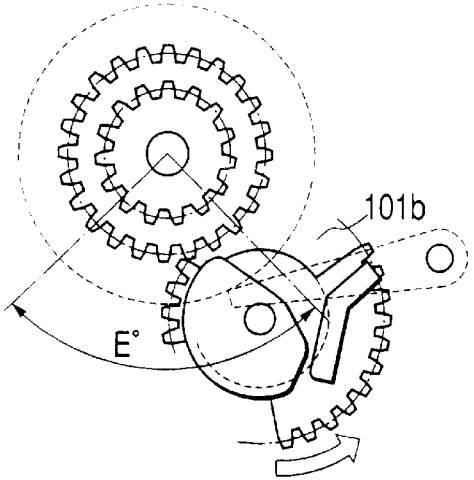
Figure 9F:
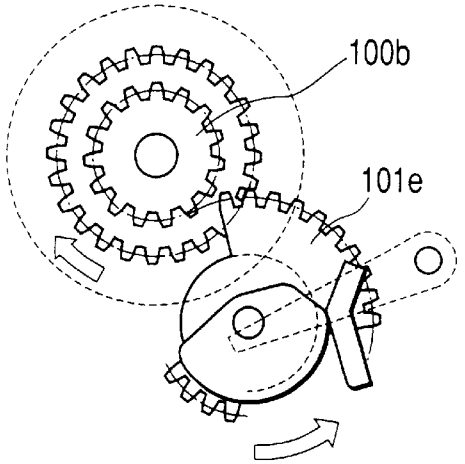
Figure 10G:
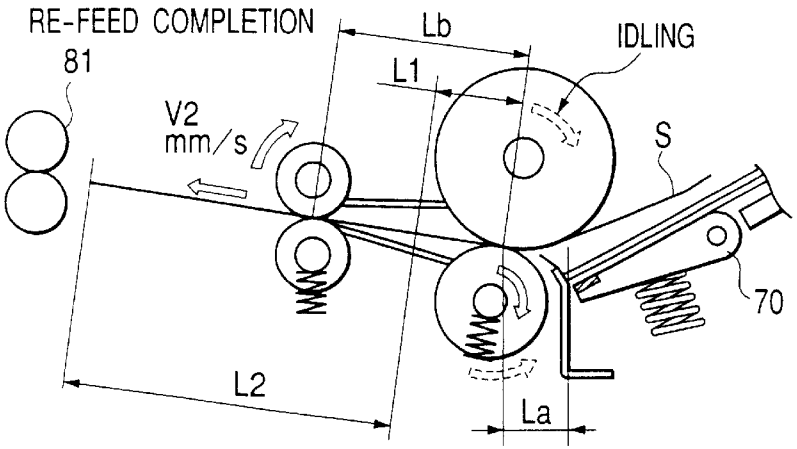

Further, when the rotation of the control gear 101 is continued to bring the first non-engagement portion 101*a* to a position opposite to the small diameter gear portion 100*b* of the sheet feeding drive stage gear 100, the driving force is not transmitted to the sheet feeding drive stage gear 100, thereby stopping the sheet feeding roller 51. The rotation of the control gear 101 is finished and the control gear is stopped at the initial position (FIGS. 9G and 10G). Since the reason for temporarily stopping the pre-fed sheet S in front of the pair of draw rollers 55 is the same as the aforementioned reason, explanation thereof will be omitted.

Figure 11:
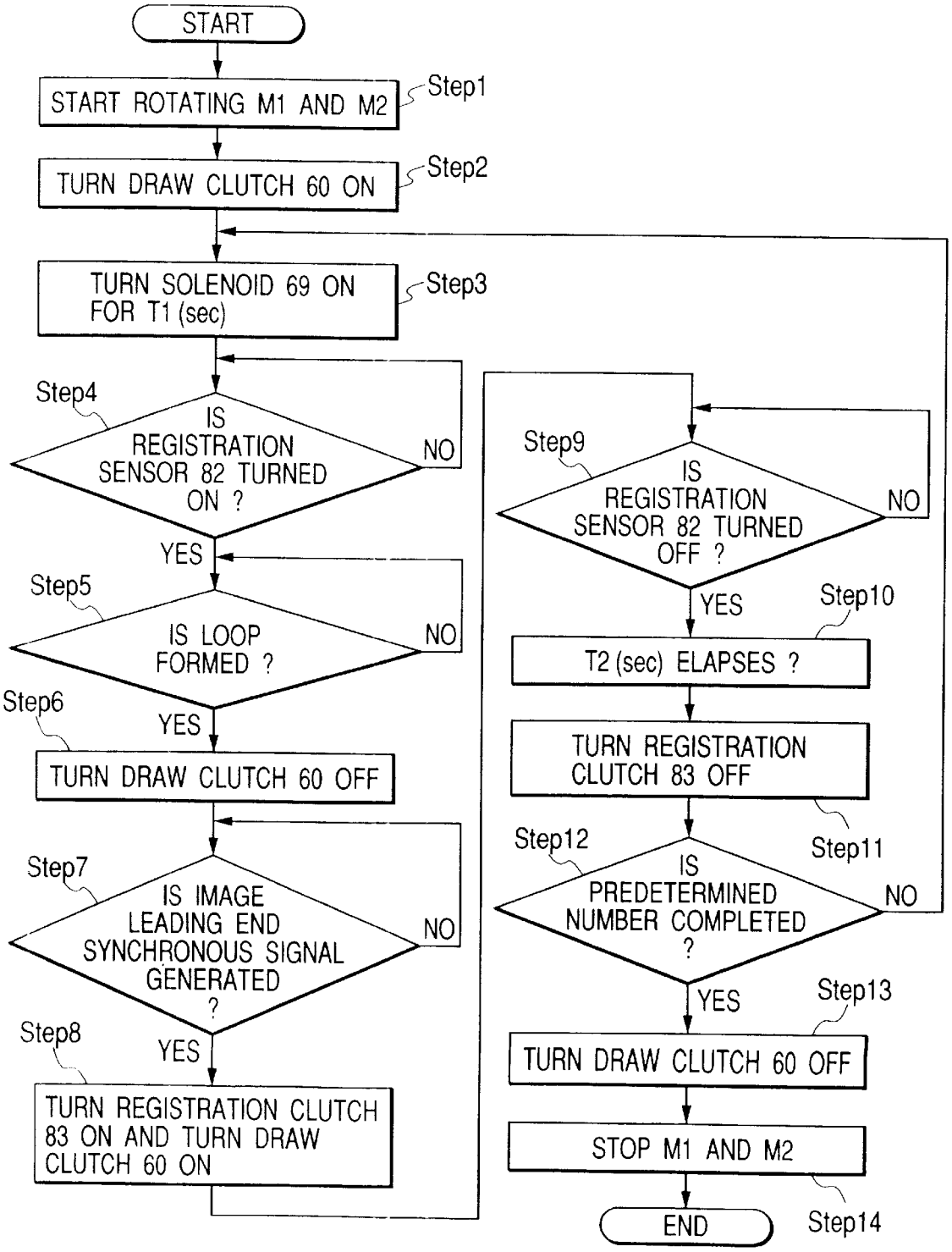
FIG. 11 is a flowchart showing a sheet feeding operation in the alteration.
Figure 12:
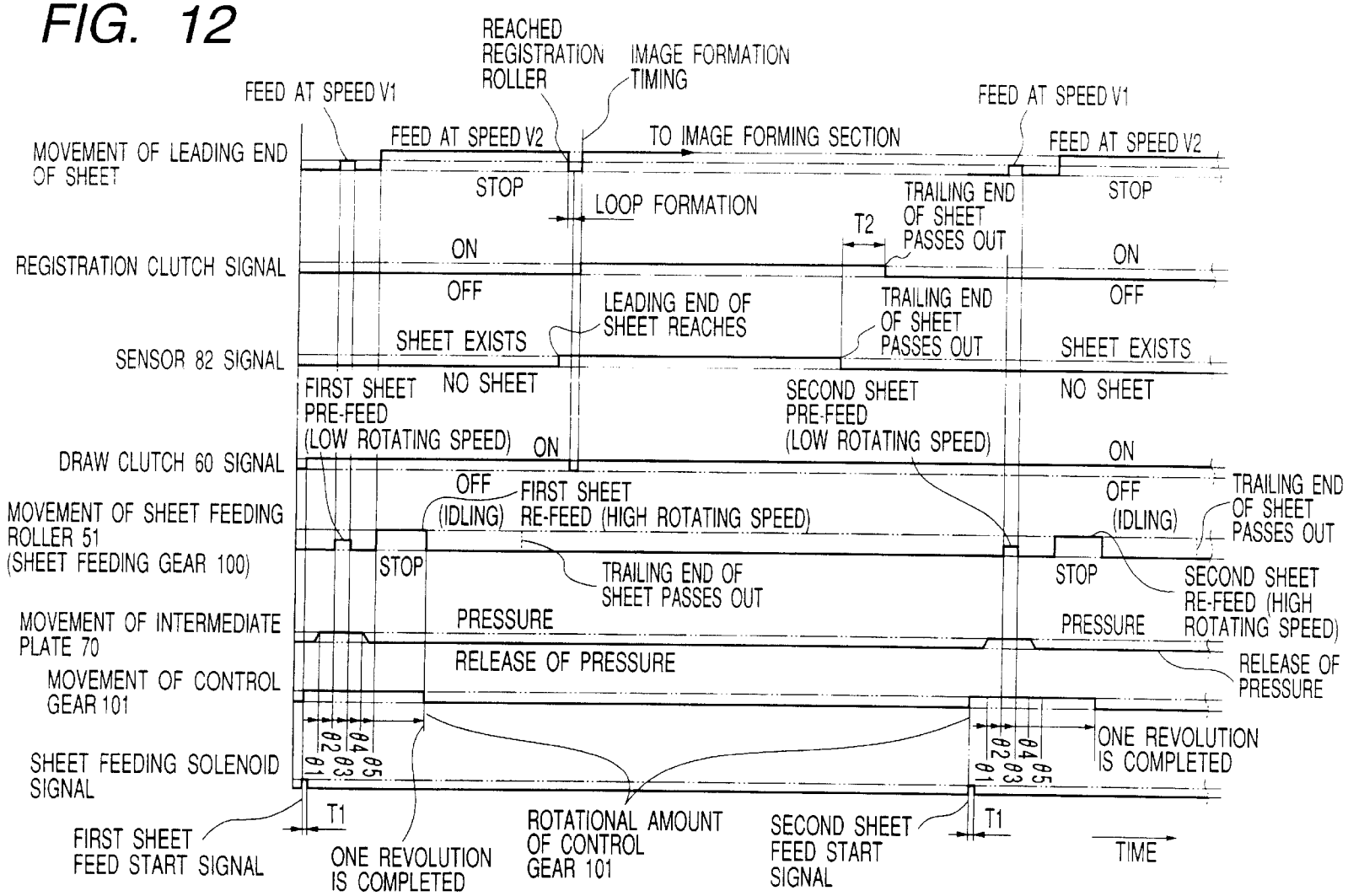
FIG. 12 is a timing chart showing a sheet feeding operation in the alteration.

Next, the sheet feeding operation of the multi sheet feeding portion will be explained with reference to a flowchart shown in FIG. 11 and a timing chart shown in FIG. 12.

In a state that the sheet bundle is rested on the sheet feeding tray 74, when a start button (not shown) is depressed, the draw motor M2 and the sheet feeding motor M1 start to rotate (step 1), and an ON signal of the draw clutch 60 is emitted from a CPU 40 (step 2).

Then, after a predetermined time period is elapsed, the solenoid 69 is turned ON by a time period T1 (sec) on the basis of a signal from the CPU 40 (step 3) to start control of one revolution of the control gear 101. By this operation, as mentioned above, first of all, the intermediate plate 70 is moved to be urged against the sheet feeding roller 51, with the result that the sheet bundle supported on the intermediate plate 70 abuts against the sheet feeding roller 51. Then, the sheet feeding roller 51 is rotated through the predetermined angle E° to feed out the uppermost sheet S in the sheet bundle rested on the tray 74 by the predetermined amount L1 at the first feeding speed V1 by the pressing force of the intermediate plate 70 and the friction force between the sheet and the sheet feeding roller 51 (the pre-feeding operation).

At this time, the separation roller 53 is driven in the sheet feeding direction by the rotation of the sheet feeding roller 51. By the way, in the above-mentioned sheet feeding operation, if two or more sheets S are fed in an overlapped state (i.e., if double-feed occurs), the separating roller 53 acts to restore the double-fed sheet(s). At this time, however, since the intermediate plate 70 urges the sheet feeding roller 51 via the intermediate plate spring 72, the separating operation of the separating roller 53 may be obstructed not to restore the double-fed sheet(s).

However, when the control gear 101 is further rotated, the sheet feeding roller 51 is stopped temporarily, thereafter the intermediate plate 70 is released from the pressure and retracted from the sheet feeding roller 51 by the engagement between the cam 101*c* and the cam follower 70*c*. Incidentally, as mentioned above, since the first feeding speed V1 during the pre-feeding operation is lower than the second feeding speed V2 provided by the pair of registration rollers 81 and the pair of draw rollers 55, in the pre-feeding operation, the double-feed is hard to occur and any slip of the sheet feeding roller 51 is also hard to occur, thereby providing the stable sheet feeding operation.

Since the slip is hard to occur as mentioned above, the pressing force of the intermediate plate 70 against the sheet feeding roller 51 can be set to a smaller value. Thus, the double-feed is further hard to occur.

When the control gear 101 is further rotated, the sheet feeding roller 51 starts the re-feeding operation for the sheet S which is temporarily stopped to feed the sheet S at the second feeding speed V2, and the leading end of the sheet S is received by the pair of draw rollers 55 which are rotated at the second feeding speed V2. After the sheet is fed by the sheet feeding roller 51 by the predetermined amount Lb in the re-feeding operation, the control of one revolution of the control gear 101 is completed and the sheet feeding roller 51 is stopped. However, since the pair of draw rollers 55 continue to rotate, the sheet S is fed up to the pair of registration rollers 81.

At this time, since the first non-engagement portion 101*a* of the control gear 101 is opposed to the sheet feeding drive stage gear 100, the sheet feeding roller 51 is not subjected any load. Thus, the sheet feeding roller 51 is rotatingly driven (idle rotation) by the sheet S being fed by the pair of draw rollers 55 until the trailing end of the sheet S leaves the nip between the sheet feeding roller 51 and the separating roller 53.

In this drawing operation, since the intermediate plate 70 is retracted from the sheet feeding roller 51, a succeeding sheet is not subjected to a friction force from the sheet S being draw. Thus, the succeeding sheet is hard to be double-fed. However, if the succeeding sheet should be double-fed, since the drive shaft 54 of the separating roller 53 connected to the support shaft 52 is rotated in the direction opposite to the sheet feeding direction during the rotation of the sheet feeding roller 51 and since the intermediate plate 70 is released from the pressure of the sheet feeding roller 51 to release the pressure on the sheets supported on the intermediate plate 70, at that point, the separating roller 53 starts to rotate reversely by the action of the torque limiter 62 to restore the double-fed sheet, thereby avoiding the double-feed certainly.

If the sheet is jammed in the nip between the sheet feeding roller 51 and the separating roller 53 or if the sheet is caught by the nip of the pair of draw rollers 55 for any reason, in this alteration, since the sheet feeding roller 51 can be rotated both in the sheet feeding direction and in the opposite direction, the jammed sheet can be pulled in the direction opposite to the sheet feeding direction, thereby facilitating the sheet jam treatment.

This can be achieved because the control gear 101 has the non-engagement portions not engaged by the sheet feeding drive stage gear 100 and because there is no need for providing means such as a one-way clutch for connecting the driving between the sheet feeding roller 51 and the separating roller 53 to regulate the rotation.

That is to say, when the control gear 101 is disengaged from the sheet feeding drive stage gear 100, the sheet feeding roller support shaft 52 can freely be rotated both in the sheet feeding direction and in the opposite direction. Thus, the jammed sheet can be pulled in the direction opposite to the sheet feeding direction.

Further, when the sheet is draw by the pair of draw rollers 55 in the sheet feeding direction, the sheet feeding roller 51 is rotatingly driven, and the rotation of the sheet feeding roller 51 is transmitted to the shaft 54 of the separating roller 53 through the pulleys 57, 58 and the belt 61, with the result that the shaft 54 of the separating roller 53 can always be rotated in the sheet restoring direction. Namely, even if a plurality of sheets are fed into the nip between the sheet feeding roller 51 and the separating roller 53, under the action of the torque limiter 62, the separating roller 53 can be rotated to restore the sheet onto the intermediate plate 70.

The leading end of the sheet S is fed at the second feeding speed V2 toward the pair of registration rollers 81 which are stopped, by the above-mentioned operation. A sheet detecting sensor 82 comprising a photo-interrupter or the like is disposed at an upstream side of the pair of registration rollers 81 so that, when the leading end of the sheet S is detected by the sensor (step 4), by timer means (not shown) of the CPU 40 for counting a time corresponding to the distance between the sensor 82 and the pair of registration rollers 81, a signal for controlling the stop timing of the draw clutch 60 to form a proper loop between the pair of draw rollers 55 and the pair of registration rollers 81 is generated (step 6).

It is well known that such a loop is formed in the sheet S to correct skew-feed of the sheet. Further, by rotating the pair of registration rollers 81 in response to an image leading end synchronous signal emitted from the photosensitive drum 12 or the optical system for exposing the image, the sheet S is fed again at the second feeding speed V2 to be sent onto the photosensitive drum 12 rotated at the second feeding speed V2, where the toner image is transferred onto the sheet.

When a predetermined time period T2 (sec) is elapsed after the trailing end of the sheet S leaves the sheet detecting sensor 82 to ascertain the fact that the trailing end of the sheet surely leaves the nip of the pair of registration rollers 81, a registration clutch 83 is turned OFF (steps 9, 10 and 11). Incidentally, the sheet S to which the toner image is transferred is sent to the fixing unit 22, where the image is fixed to the sheet. Thereafter, the sheet is discharged onto the discharge tray 25. The above-mentioned operations are repeated by times corresponding to the set number of sheets to be treated (step 12). When the predetermined number is completed, the draw clutch 60 is turned OFF (step 13), and then the sheet feeding motor M1 and the draw motor M2 are stopped (step 14), and the program is ended.

As fully mentioned above, in this alteration, since the first feeding speed V1 in the pre-feeding operation is lower than the second feeding speed V2 provided by the pair of draw rollers 55 and the pair of registration rollers 81, in the first sheet feeding operation, the double-feed is hard to occur and the slip between the sheet feeding roller 51 and the sheet S is also hard to occur, thereby providing the stable sheet feeding operation.

Further, since the pre-fed sheet S is temporarily stopped and since the pressure of the sheet supported on the intermediate plate 70 against the sheet feeding roller 51 is released and since the storing force of the separating roller 53 can be utilized at that time, the sheet(s) S double-fed in the pre-feeding operation can surely be restored, thereby effecting high accurate sheet feeding.

Furthermore, since the double-feed preventing arrangement is used, the torque value (sheet restoring force of the sheet separating roller 53) of the torque limiter 62 can be set to a smaller value. Further, since occurrence of the slip during the pre-feeding operation can be reduced, the pressing force of the intermediate plate 70 against the sheet feeding roller 51 can be set to a smaller value, thereby improving the service lives of the sheet feeding roller 51 and the separating roller 53. Thus, a sheet feeding apparatus having low maintenance cost can be provided.

Further, by stopping the pre-fed sheet S temporarily, dispersion of the position of the leading end of the sheet S on releasing the pressure of the intermediate plate 70 can be minimized, thus, the distance from the nip between the sheet feeding roller 51 and the separating roller 53 to the pair of draw rollers 55 can be shortened. Therefore, the entire apparatus can be made more compact.

Further, when the sheet S is fed by the pair of draw rollers 55, since the intermediate plate 70 is already retracted from the sheet feeding roller 51, the pair of draw rollers 55 are not subjected to the feeding load due to the pressure of the intermediate plate. Thus, the service life of the draw rollers 55 can be extended.

Further, in the initial state, since the intermediate plate 70 is retracted from the sheet feeding roller 51, the setting of the sheet bundle effected by the operator is not obstructed. When the operator sets the sheets, he may merely abut the leading end of the sheet bundle against the abutment plate 78. Thus, since the setting operation is very easy, occurrence of sheet jam and skew-feed due to poor setting can be reduced.

In addition, since the interlocking operation between the intermediate plate 70 and the sheet feeding roller 51 is effected by the control gear 101 formed integrally with the cam 101*c* for controlling the intermediate plate 70 and the two non-engagement portions 101*a*, 101*b* and since the timings for pre-feeding the sheet, for re-feeding the sheet and for applying and releasing a pressure between the intermediate plate 70 and the sheet feeding roller 51 are determined by the phase angles of the non-engagement portions 101*a*, 101*b* and the cam 101*c*, there are few factors for causing dispersion, with the result that the stable sheet feeding and separating operations can be effected with low cost.

Since the control for rotation and stoppage of the sheet feeding roller 51 and the complication and release of the pressure of the intermediate plate 70 can be effected by one ON signal and one OFF signal for the solenoid 69, the control is very easy and the severe control accuracy is not requested.

Further, by connecting the shaft 54 of the separating roller 53 to the sheet feeding roller support shaft 52, means such as a one-way clutch for regulating the rotational direction which was required in the conventional sheet feeding apparatuses can be omitted, thereby making the sheet feeding apparatus inexpensive. In addition, since the shaft 54 of the separating roller 53 can always be rotated in the sheet restoring direction by rotatingly driving the sheet feeding roller 51 by the sheet drawn by the pair of draw rollers 55, the separating ability can be improved.

In this alteration, when the non-engagement portions 101*a*, 101*b* of the control gear 101 is opposed to the sheet feeding drive stage gear 100, although slight rotational resistance of the torque limiter 62 acts on the sheet feeding roller 51 and the separating roller 53, these rollers can freely be rotated in both directions. Thus, if the sheet is jammed in the sheet feeding portion, the jammed sheet can be pulled both in the sheet feeding direction and in the opposite direction, thereby greatly improving the jam treating ability.

Incidentally, in the alteration, while an example that the pulley 57, 58 are provided on the sheet feeding roller support shaft 52 and the separating roller shaft 54, respectively and the pulleys 57, 58 are interconnected through the belt 61 to transmit the driving force from the sheet feeding motor M1 is explained, a connecting gear may be provided on the sheet feeding roller support shaft 52 and a separating roller gear may be provided on the shaft 54 of the separating roller 53 and a driving force may be transmitted through a gear train including idler gear(s) which engages with the connecting gear and the separating roller gear. This construction can also have the same technical advantage as the above alteration.

Next, a multi sheet feeding portion of the image forming apparatus according to a further alteration of the embodiment of the present invention will be fully explained.

Figure 13:
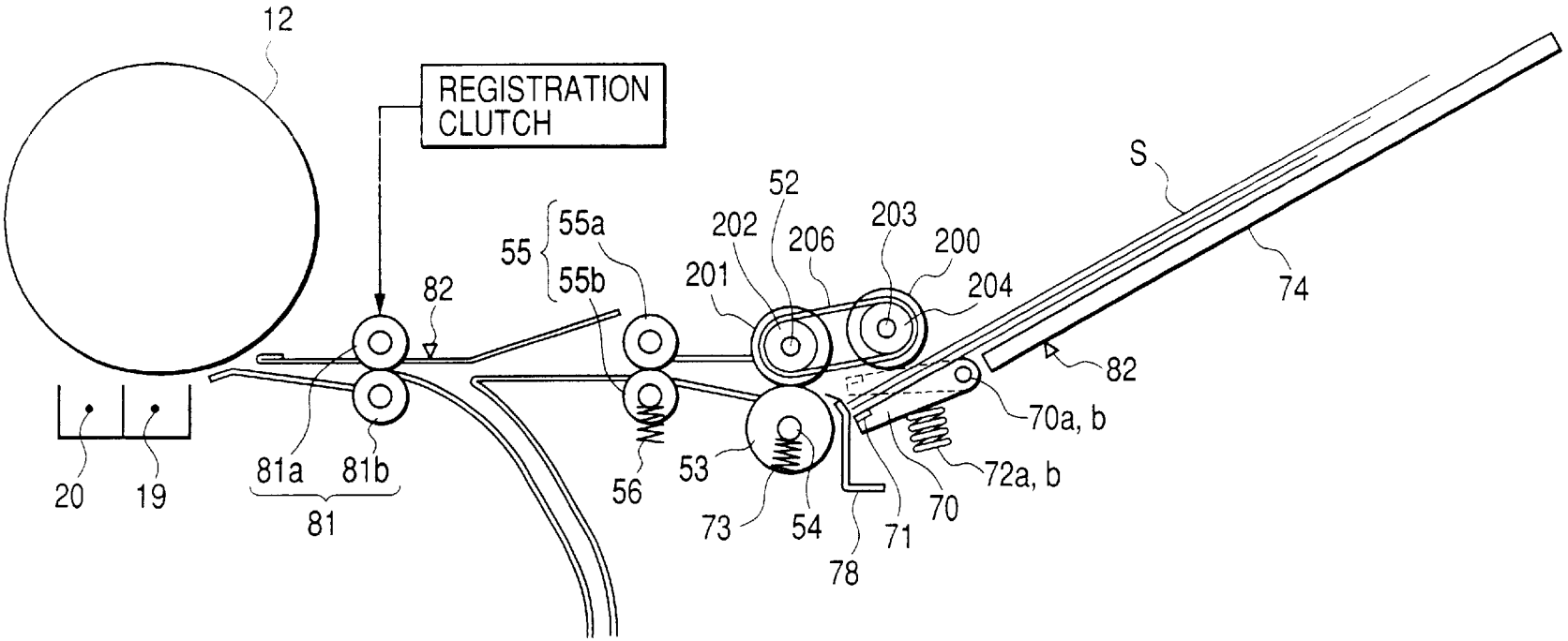
FIG. 13 is a sectional view of a sheet feeding apparatus according to an alteration of the embodiment of the present invention.
Figure 14:
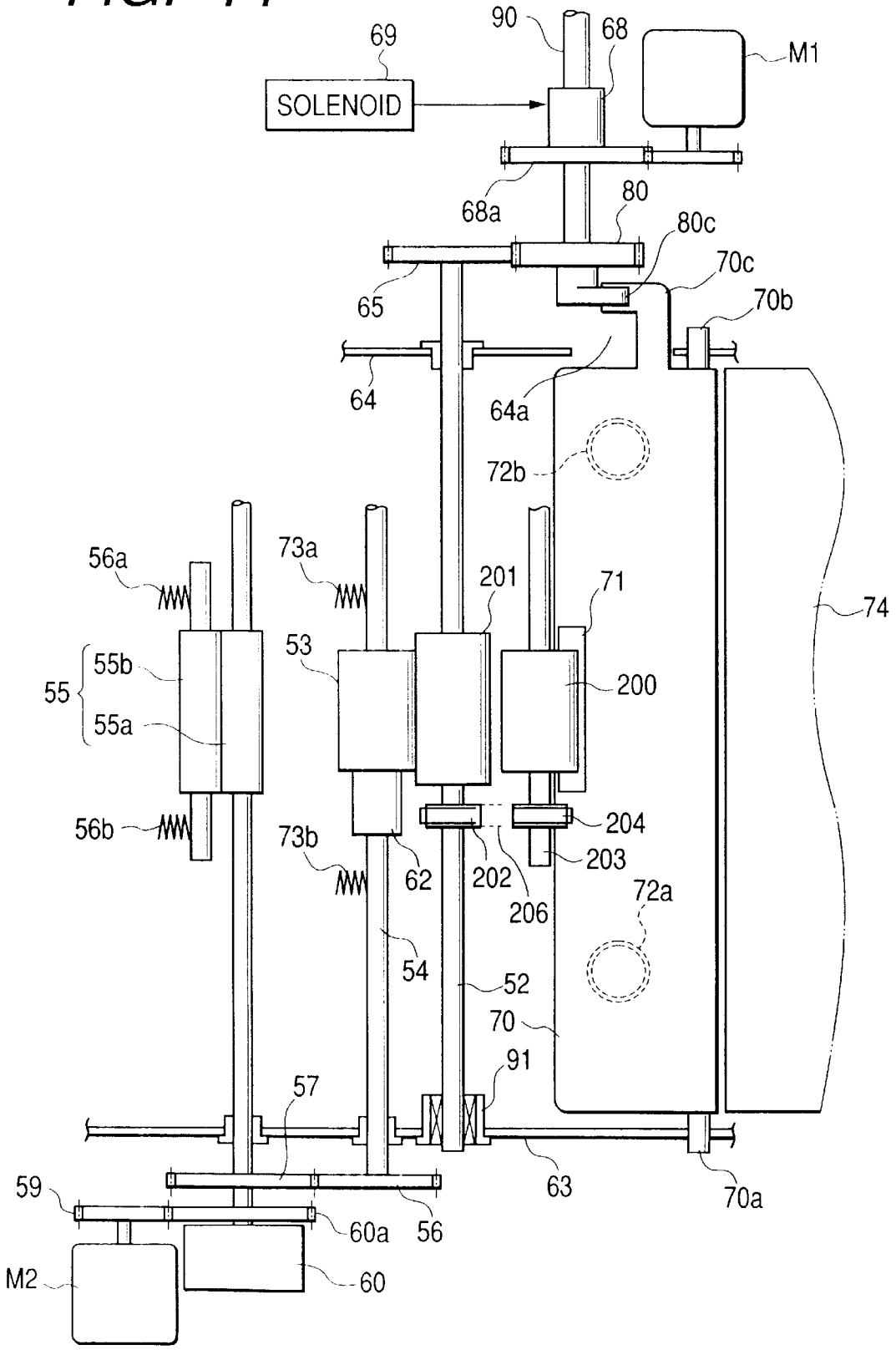
FIG. 14 is a drive development view (plan view) of a sheet feeding apparatus according to the alteration.

FIG. 13 is a sectional view of a sheet feeding apparatus according to the further alteration, and FIG. 14 is a drive development view of the sheet feeding apparatus according to the further alteration. Incidentally, the elements same as those in the above-mentioned embodiment and alteration are designated by the same reference numerals, and explanation thereof will be omitted.

In this alteration, a pick-up roller (sheet feeding means) 200 is provided on a pick-up roller shaft 203 opposite to the intermediate plate 70. Further, a pick-up roller pulley 204 is also secured to the pick-up roller shaft 203. The pick-up roller shaft 203 is rotatably supported by the front and rear side plates 63, 64 via bearings (not shown).

The intermediate plate 70 is urged in a clockwise direction (FIG. 13) (direction along which the intermediate plate 70 presses the pick-up roller 200) by compression springs 72*a*, 72*b* so that the sheet supported by the intermediate plate can be brought into pressure contact with (as shown by the broken line in FIG. 13) and released from the pressure contact against (as shown by the solid line in FIG. 13) the pick-up roller 200 by a pressing portion which will be described later. Further, a felt 71 for preventing double-feed of sheets S and for relieving shock on pressing the intermediate plate 70 against the pick-up roller 200 is provided on an abutment portion (against the pick-up roller 200) of a distal end of the intermediate plate 70.

A sheet feeding roller 201 having an outer diameter same as that of the pick-up roller 200 and a sheet feeding roller pulley 202 having the number of teeth same as that of the pick-up roller pulley 204 are secured to a support shaft 52, and the support shaft 52 is rotatably supported by the front and rear side plates 63, 64 in such a manner that the support shaft 52 is not rotated reversely (in an anti-clockwise direction in FIG. 13) by the action of a one-way clutch 91 disposed between the front side plate 63 and the support shaft 52.

The sheet feeding roller pulley 202 and the pick-up roller pulley 204 are interconnected by a drive belt 206 so that a driving force of the sheet feeding roller 201 can be transmitted to the pick-up roller 200. Thus, the sheet feeding roller 201 and the pick-up roller 200 can be synchronized and be rotated at the same peripheral speed.

Incidentally, in this alteration, while an example that the outer diameter of the pick-up roller 200 is same as that of the sheet feeding roller 201 and the number of teeth of the pick-up roller pulley 204 is same as that of the sheet feeding roller pulley 202 and the sheet feeding apparatus is constituted by these members was explained, the present invention is not limited to such an example, but, outer diameters of the pick-up roller 200 and the sheet feeding roller 201 and the number of teeth of the pulleys may be selected so that a sheet feeding speed of the pick-up roller 200 becomes the same as a sheet feeding speed of the sheet feeding roller 201.

Further, a sheet feeding drive gear (drive transmitting means) 65 is secured to a rear end of the support shaft 52. Further, a control gear (drive transmitting means) 80 engageable with the sheet feeding drive gear 65 and having two toothless portions 80*a*, 80*b* is opposed to the sheet feeding drive gear 65. Further, a cam (pressing and retracting means) 80*c* for applying and releasing a pressure between the sheets supported by the intermediate plate 70 and the pick-up roller 200 is integrally formed with the control gear 80.

Since the cam 80*c* and a cam follower (pressing and retracting means) 70*c* provided on the intermediate plate 70 have the same constructions as those in the above-mentioned embodiment, explanation thereof will be omitted. Further, explanation of a pair of draw rollers 55 disposed at a downstream side of the sheet feeding roller 201 in the sheet feeding direction, members for driving the draw rollers 55, and setting of a torque value of a torque limiter 62 provided on a separating roller drive shaft 54 will also be omitted for the similar reason.

Next, the sheet feeding operation and the separating operation effected by the drive transmitting means and the pressing and retracting means for the sheet feeding roller 201, the pick-up roller 200 and the intermediate plate 70 will be fully explained with reference to FIGS. 15A to 15G and FIGS. 16A to 16H. However, since the constructions of the sheet feeding drive gear 65 and the control gear 80 are the same as those in the above-mentioned embodiment, explanation thereof will be omitted.

Figure 15A:
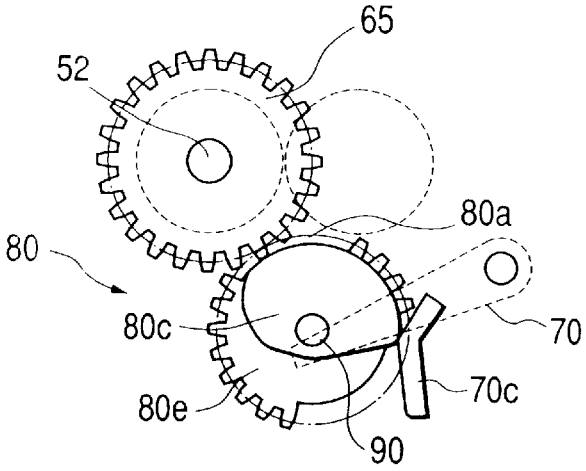
FIGS. 15A, 15B, 15C, 15D, 15E, 15F and 15G are views showing an operation of a control gear in the alteration.
Figure 15B:
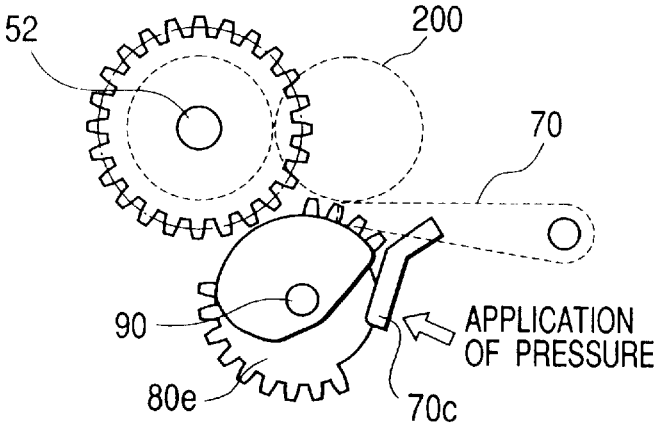
Figure 15C:
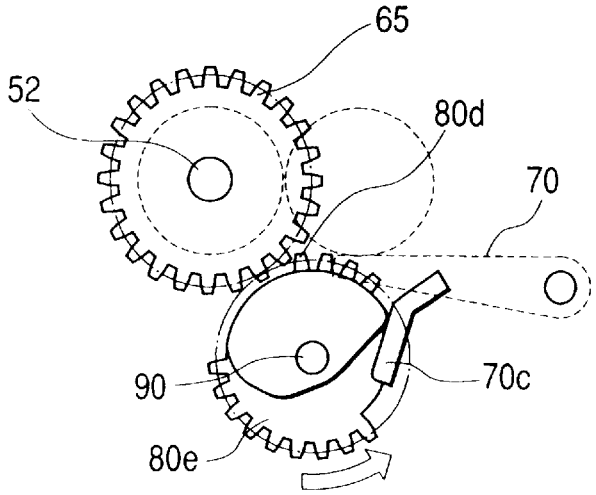
Figure 16A:
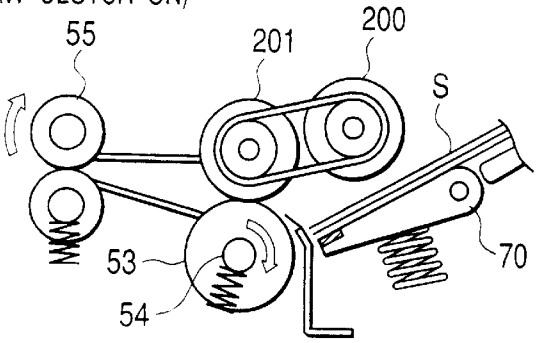
FIGS. 16A, 16B, 16C, 16D, 16E, 16F, 16G and 16H are views showing operations of a roller and an intermediate plate in the alteration.
Figure 16B:
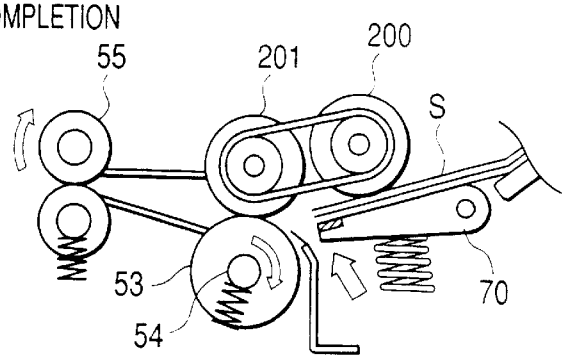
Figure 16C:
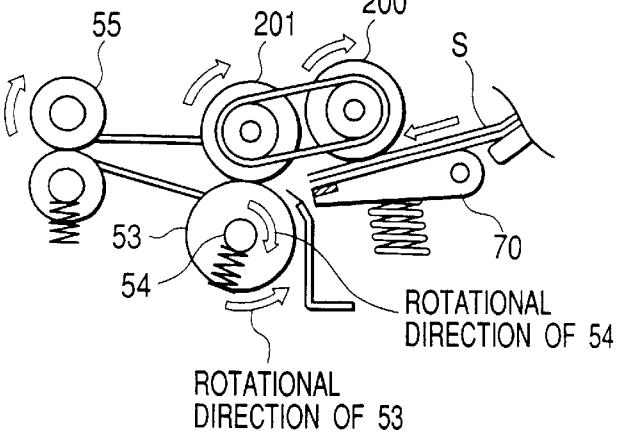
Figure 16D:
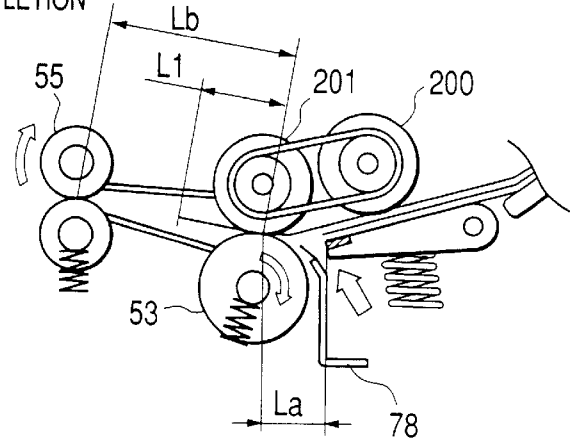

When the solenoid 69 is turned ON by the time of T1 (sec), under the action of the spring clutch 68, the control gear 80 is rotated by one revolution. The control gear 80 is rotated in an anti-clockwise direction in FIG. 15A to rotate the cam 80*c* from an intermediate plate retracting position to an intermediate plate pressing position θ1. This rotation is followed by the cam follower 70*c* to move the intermediate plate 70 to be urged against the pick-up roller 200. As a result, an uppermost sheet S in the sheet bundle rested on the sheet feeding tray 74 is urged against the pick-up roller 200 (FIGS. 15B and 16B).

When the control gear 80 is rotated up to a position θ2, the first gear portion 80*d* of the control gear 80 is engaged by the sheet feeding drive gear 65, thereby rotating the sheet feeding drive gear 65 through a predetermined angle A°. In response to this rotation, the pick-up roller 200 is rotated through the angle A°. After the uppermost sheet S in the sheet bundle is fed out by the pick-up roller 200, the sheet is fed by a predetermined amount L1 by the sheet feeding roller 201 (the sheet feeding operation till now is referred to as "pre-feeding operation" hereinafter) (FIGS. 15C, 15D and 16C, 16D).

Incidentally, when it is assumed that outer diameters of pick-up roller 200 and the sheet feeding roller 201 are R, the feeding amount L1 in the pre-feeding operation is represented by the following expression:

$$L1 = A° \times \pi \times R/360° \quad \text{(Expression A)}$$

The number of teeth of the first gear 80*d* is selected so that the sheet feeding amount L1 in the pre-feeding operation becomes greater than a distance La from the sheet abutment plate 78 to a nip between the sheet feeding roller 201 and the separating roller 53 and smaller than a distance Lb from the nip to the pair of draw rollers 55.

Further, the rotating speed of the sheet feeding drive gear 65 at this time is selected by determining the rotating speed of the sheet feeding motor M1 and the number of teeth of the gears and the diameters of rollers so that the sheet feeding speed provided by the pick-up roller 200 and the sheet feeding roller 201 becomes substantially equal to the sheet feeding speeds provided by the pair of draw rollers 55 and a pair of registration rollers 81.

When the control gear 80 continues to rotate up to a position $\theta_3$ to bring the second toothless portion 80*b* to a position opposite to the sheet feeding drive gear 65 (FIGS. 15D and 16D), the driving force is not transmitted to the sheet feeding drive gear 65, thereby stopping the pick-up roller 200 and the sheet feeding roller 201 temporarily. Incidentally, since the number of teeth of the first gear 80*d* is selected as mentioned above, regardless of the sheet feeding start position of the sheet S, the leading end of the sheet S fed by the amount L1 in the pre-feeding operation can surely be stopped temporarily between the nip and the pair of draw rollers 55.

Figure 15E:
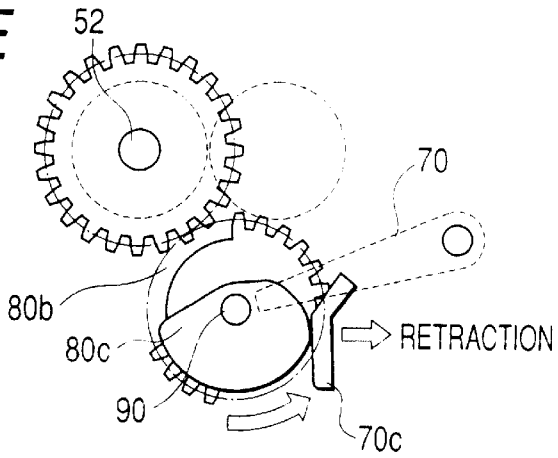
Figure 16E:
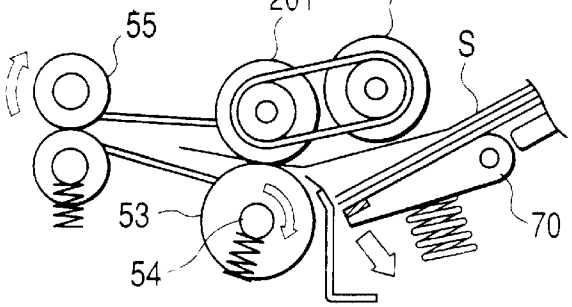
Figure 16F:
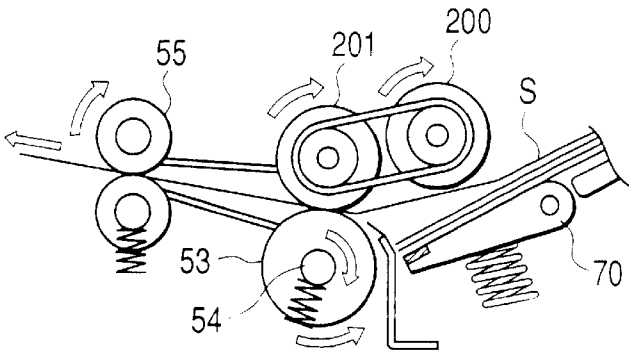

Thereafter, when the control gear 80 is rotated up to a position θ4 to restore the cam 80*c* to the intermediate plate retracting position, the movement is followed by the cam follower 70*c*, with the result that the pressure of the intermediate plate 70 against the pick-up roller 200 is released to separate the supported sheet from the pick-up roller 200 (FIGS. 15E and 16E). Incidentally, a time period for stopping the pick-up roller 200 and the sheet feeding roller 201 after the pre-feeding operation is set as a separating operation time for surely restoring the sheet double-fed by the amount $L_1$ in the pre-feeding operation onto the intermediate plate 70.

When the control gear 80 is further rotated up to a position θ5 to engage the second gear portion 80*e* of the control gear 80 with the sheet feeding drive gear 65 (FIGS. 15F and 16F), the rotation of the sheet feeding drive gear 65 is started again, with the result that the sheet feeding drive gear 65 is rotated through a predetermined angle B°, thereby starting the sheet feeding operation of the sheet feeding roller 201 (the sheet feeding operation after the pre-feeding operation is referred to as "re-feeding" hereinafter).

Incidentally, the sheet feeding amount L2 of the sheet feeding roller 201 at this time becomes:

$$L2=B^{\circ}\times\pi\times R/360^{\circ} \quad \text{(Expression B)}$$

The feeding amount $L_2$ in the re-feeding is selected by setting the number of teeth of the second gear portion 80*e* so that the leading end of the sheet S fed in front of the pair of draw rollers 55 in the pre-feeding operation is surely received by the pair of draw rollers 55 and does not reach the pair of registration rollers 81.

Further, when the rotation of the control gear 80 is continued to bring the first toothless portion 80*a* to a position opposite the sheet feeding drive gear 65, the driving force is not transmitted to the sheet feeding drive gear 65, thereby stopping the pick-up roller 200 and the sheet feeding roller 201.

Figure 15G:
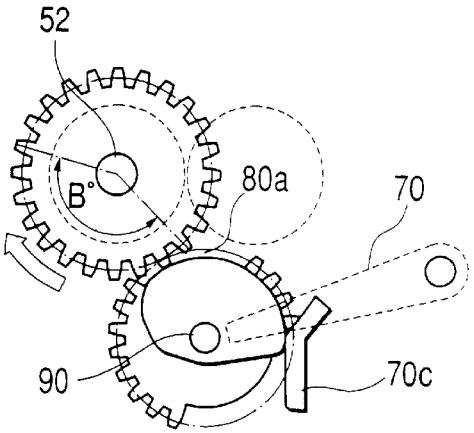
Figure 15D:
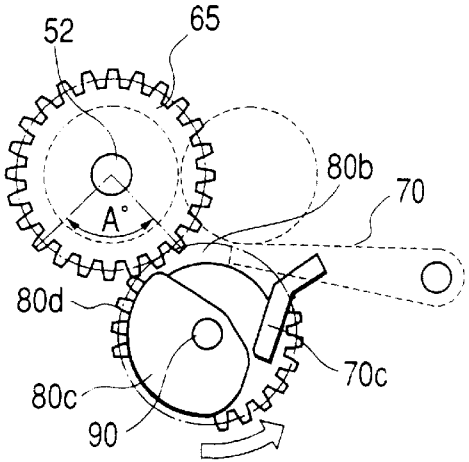
Figure 15F:
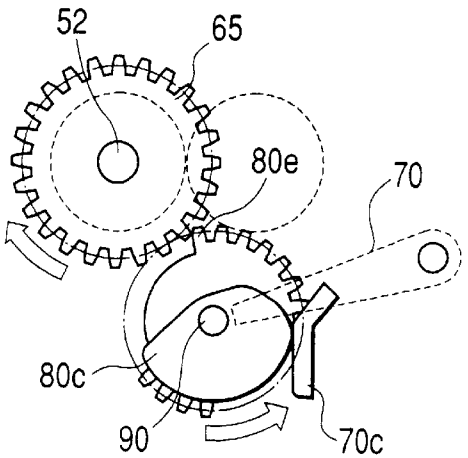
Figure 16G:
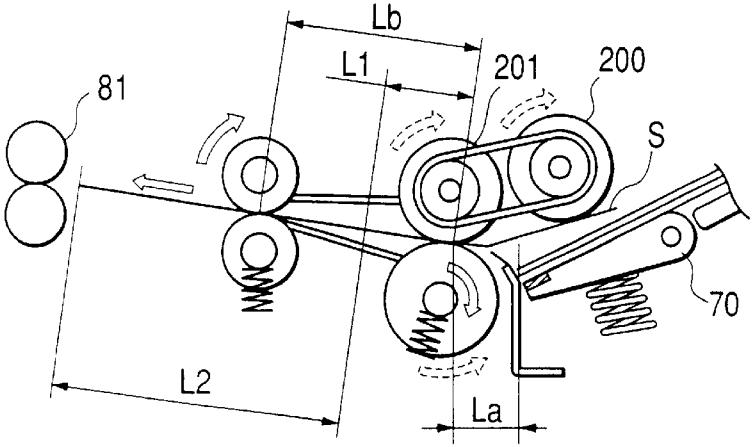
Figure 16H:
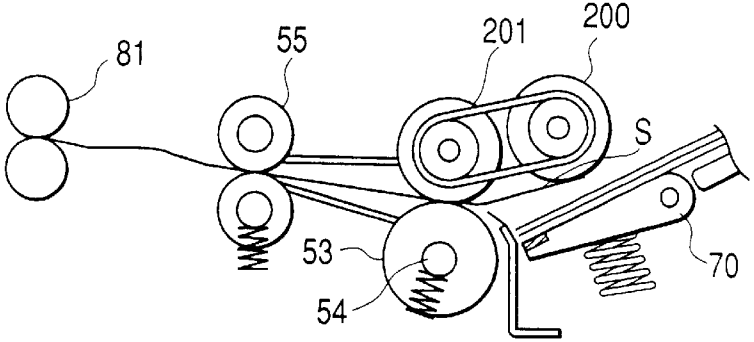

The rotation of the control gear 80 is finished and the control gear is stopped at the initial position (FIGS. 15G and 16G). Since the reason for temporarily stopping the pre-fed sheet S in front of the pair of draw rollers 55 is the same as that in the above-mentioned embodiment, explanation thereof will be omitted.

Next, a sheet feeding operation from the multi sheet feeding portion will be explained with reference to the flowchart shown in FIG. 6 and the timing chart shown in FIG. 7 again.

In a state that the sheet bundle is rested on the sheet feeding tray 74, when a start button (not shown) is depressed, the draw motor M2 and the sheet feeding motor M1 start to rotate (step 1), and an ON signal of the draw clutch 60 is emitted from the CPU 40 (step 2). As a result, as mentioned above, the pair of draw rollers 55 start to rotate in the sheet feeding direction and the separating roller drive shaft 54 is rotated in the direction opposite to the sheet feeding direction, and the predetermined restoring force is generated in the separating roller 53 by the torque limiter 62.

However, the separation roller 53 is still maintained in the stopped state by the friction force between the separating roller 53 and the sheet feeding roller 201 rotation of which is regulated by the action of the one-way clutch 91. Then, after a predetermined time period is elapsed, the solenoid 69 is turned ON by a time period T1 (sec) on the basis of a signal from the CPU 40 (step 3) to start control of one revolution of the control gear 80. By this operation, as mentioned above, first of all, the sheet bundle supported on the intermediate plate 70 abuts against the pick-up roller 200. Then, the sheet feeding drive gear 65 is rotated through the predetermined angle A° to feed out the uppermost sheet S in the sheet bundle rested on the tray 74 in the sheet feeding direction by the pressing force of the intermediate plate 70 and the friction force between the sheet and the pick-up roller 200. Thereafter, the sheet is fed by the predetermined amount L1 by the sheet feeding roller 201 (the pre-feeding operation).

Incidentally, the separation roller 53 is driven in the sheet feeding direction by the rotation of the sheet feeding roller 201. By the way, in the above-mentioned pre-feeding operation, if two or more sheets are fed in an overlapped condition (i.e., if double-feed occurs), the separating roller 53 acts to return or restore the double-fed sheet(s). At this time, however, since the intermediate plate 70 is urged against the pick-up roller 200 via the intermediate plate spring 72, the separating operation of the separating roller 53 may be obstructed not to restore the double-fed sheet(s).

However, when the control gear 80 is further rotated, after the pick-up roller 200 and the sheet feeding roller 201 are stopped temporarily, the intermediate plate 70 is released from the pressure against the pick-up roller 200 by the action of the cam 80*c* and the cam follower 70*c*. At this time, since the draw clutch 60 is maintained in the turned-ON state, the separating roller drive shaft 54 continues to rotate in the direction opposite to the sheet feeding direction, and the restraint of the double-fed sheet(s) is released due to the pressure release of the intermediate plate 70.

At this point, the separating roller 53 starts to rotate in the restoring direction until the double-fed sheet(s) caused by the above pre-feeding operation do not exist in the nip between the sheet feeding roller 201 and the separating roller 53, thereby preventing the double-feed surely. Incidentally, in the state that only a single sheet is pinched by the nip between the sheet feeding roller 201 and the separating roller 53, the sheet feeding roller 201, the separating roller 53 and the sheet S can be maintained in the stationary state by the action of the one-way clutch 91 and the friction forces between the sheet S and the sheet feeding roller 201 and between the sheet S and the separating roller 53.

When the control gear 80 is further rotated, the sheet feeding roller 201 starts the re-feeding operation to re-start the feed of the sheet S which is temporarily stopped, with the result that the leading end of the sheet S is received by the pair of draw rollers 55.

After the predetermined amount L2 of the sheet feeding roller 201 in the re-feeding operation is fed, one revolution of the control gear 80 is completed to stop the pick-up roller 200 and the sheet feeding roller 201. However, since the pair of draw rollers 55 continue to rotate, the sheet S is fed up to the pair of registration rollers 81.

At this time, since the first toothless portion 80*a* of the control gear 80 is opposed to the sheet feeding drive gear 65, any load does not act on the sheet feeding roller 201.

Thus, the sheet feeding roller 201 is subjected to the rotational force from the sheet S fed by the pair of draw rollers 55, with the result that the sheet feeding roller 201 is rotatingly driven (idle rotation) until a trailing end of the sheet S leaves the nip between the sheet feeding roller 201 and the separating roller 53.

Incidentally, in this drawing operation, since the intermediate plate 70 is retracted from the sheet feeding roller 201, a succeeding sheet is not subjected to a friction force from the sheet S being drawn. Thus, the succeeding sheet is hard to be double-fed. However, if the succeeding sheet S should be double-fed, during the operation of the pair of draw rollers 55, since the separating roller drive shaft 54 is rotated in the direction opposite to the sheet feeding direction and since the intermediate plate 70 is released the pressure and retracted from the pick-up roller 200, at that point, the separating roller 53 starts to rotate reversely to restore the double-fed sheet, thereby avoiding the double-feed certainly.

Due to the above operation, the leading end of the sheet S is fed toward the nip of the pair of registration rollers 81 which are now stopped. Since the sheet feeding operation and the image forming operation after the step 4 are the same as those in the above-mentioned embodiment, explanation thereof will be omitted.

As fully mentioned above, since the pre-fed sheet S is temporarily stopped and since the pressure of the intermediate plate 70 against the pick-up roller 200 is released and since the storing force of the separating roller 53 can be utilized at that time, the sheet(s) double-fed in the pre-feeding operation can surely be restored, thereby effecting high accurate sheet feeding.

Further, by stopping the pre-fed sheet S temporarily, dispersion of the position of the leading end of the sheet on releasing the pressure of the intermediate plate 70 can be minimized so that the feeding distance from the nip between the sheet feeding roller 201 and the separating roller 53 to the pair of draw rollers 55 can be shortened. Therefore, the entire apparatus can be made more compact.

Further, by providing the pick-up roller 200 effecting the sheet feeding operation in synchronous with the sheet feeding roller 201, the diameter of the sheet feeding roller can be made smaller than those in the above-mentioned two embodiments so that a further compact sheet feeding apparatus can be provided.

Furthermore, when the sheet S is fed by the pair of draw rollers 55, the intermediate plate 70 is already out of pressure contact with the pick-up roller 200 so that the pair of draw rollers 55 are not subjected to the feeding load due to pinching pressure generated by the pressure contact between the intermediate plate 70 and the pick-up roller 200. Thus, the service life of the draw rollers can be extended.

Further, in the initial state, since the intermediate plate 70 is released from the pressure contact and retracted from the pick-up roller 200, the setting of the sheets effected by the operator is not obstructed. When the operator sets the sheet bundle, he may merely abut the leading end of the sheet bundle against the abutment plate 78. Thus, since the setting operation is very easy, occurrence of sheet jam and skew-feed due to poor setting can be reduced.

In addition, since the interlocking operation between the intermediate plate 70 and pick-up roller 200 and the sheet feeding roller 201 is effected by the control gear 80 having the cam 80*c* for controlling the intermediate plate 70 and the two toothless portions 80*a,* 80*b* and since the pre-feeding timing, the re-feeding timing and the timing for applying and releasing the pressure between the intermediate plate 70 and the pick-up roller 200 are determined by the phase angles of the toothless portions 80*a,* 80*b* and the cam 80*c,* there are few factors for causing dispersion, with the result that the stable sheet feeding and separating operations can be effected with low cost.

Since the control for rotation and stoppage of the pick-up roller 200 and the sheet feeding roller 201 and for applying and releasing the pressure of the intermediate plate 70 can be effected by one ON signal and one OFF signal for the solenoid 69, the control is very easy and the severe control accuracy is not requested.

Further, since the pair of draw rollers 55 are synchronous with the separating roller drive shaft 54 and since the control thereof is effected by the single draw clutch 60, not only the apparatus can be simplified but also such control can be effected independently from the rotations of the pick-up roller 200 and the sheet feeding roller 201. Thus, even in the state that the sheet feeding roller 201 is stopped, the restoring force of the separating roller 53 can be utilized, thereby providing the sheet feeding apparatus having high double-feed preventing ability.

Incidentally, in this alteration, while an example that the sheet feeding apparatus is made more compact by providing the pick-up roller in the sheet feeding apparatus according to the aforementioned embodiment is explained, a pick-up roller similar to that in this alteration can be provided in the aforementioned alteration. Now, an example that a pick-up roller is provided in the sheet feeding apparatus according to the aforementioned alteration will be briefly described with reference to the accompanying drawings.

Figure 17:
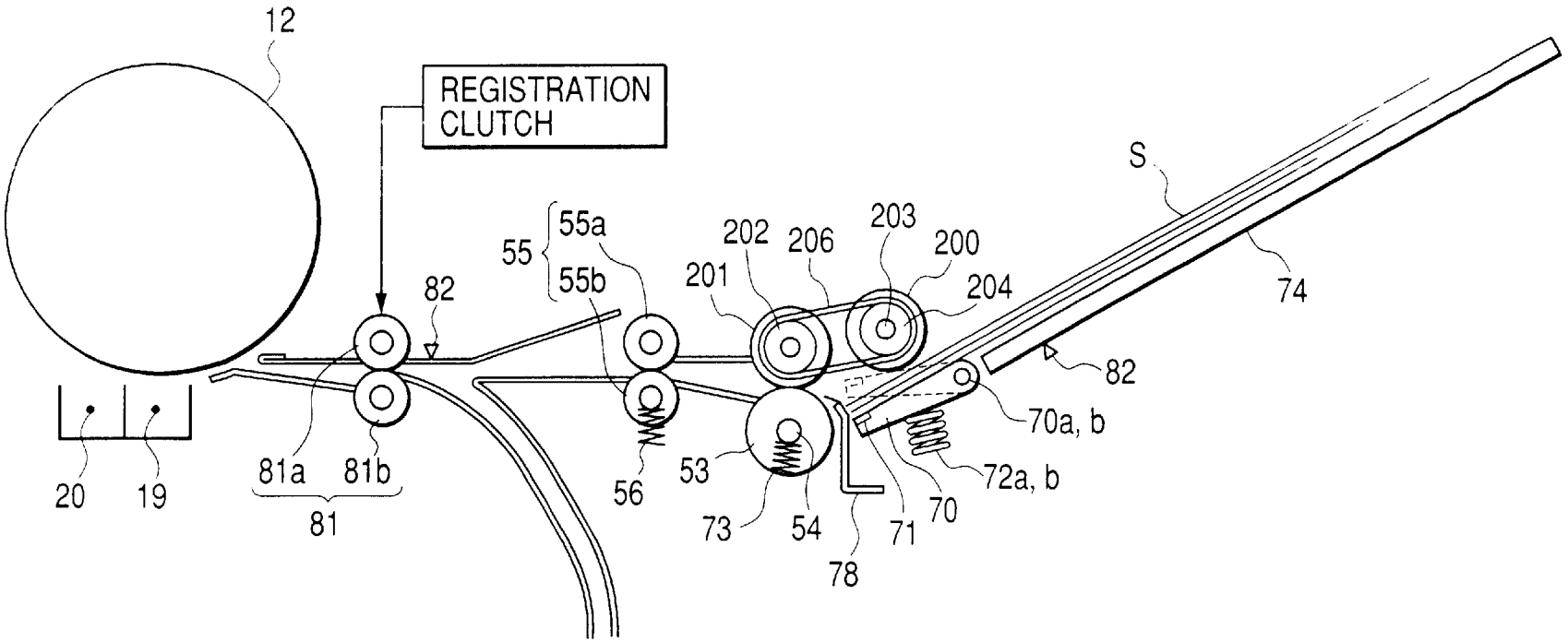
FIG. 17 is a sectional view of a sheet feeding apparatus according to an alteration of the embodiment of the present invention.
Figure 18:
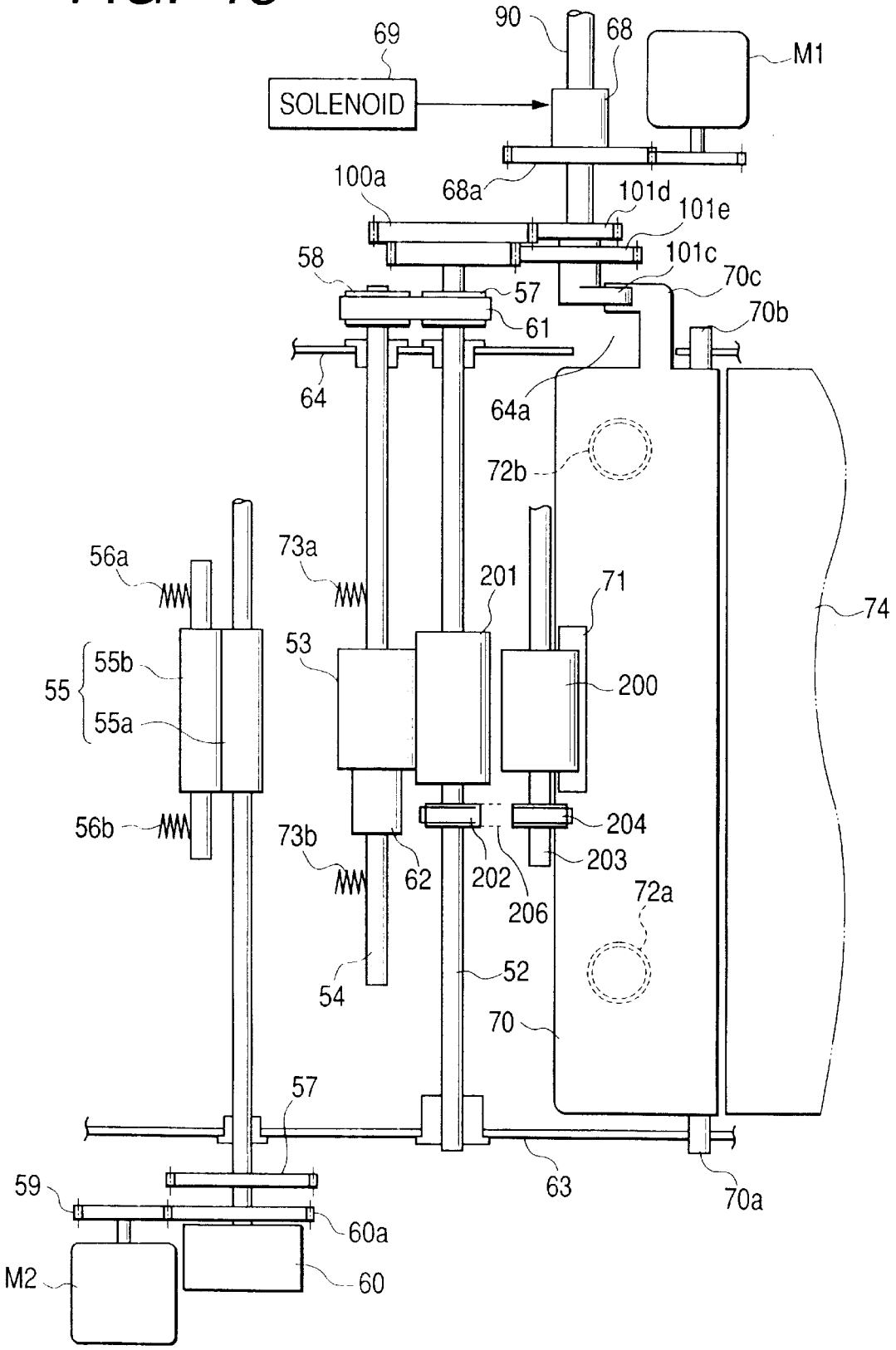
FIG. 18 is a drive development view (plan view) of a sheet feeding apparatus according to the alteration.
Figure 19A:
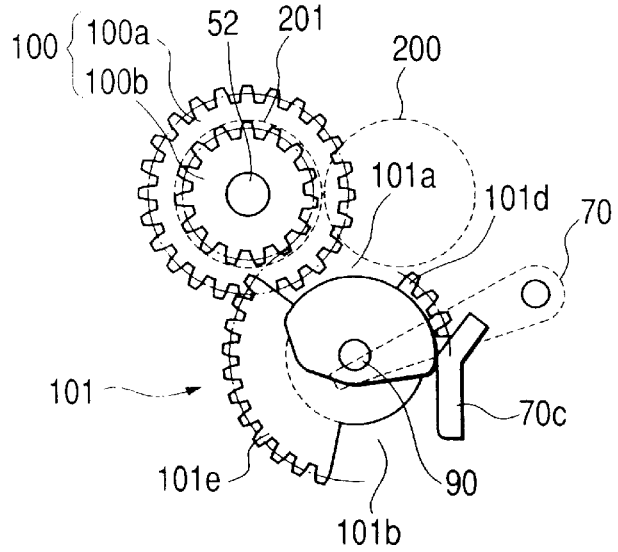
FIGs. 19A, 19B, 19C, 19D, 19E, 19F and 19G are views showing an operation of a control gear in the alteration.
Figure 19B:
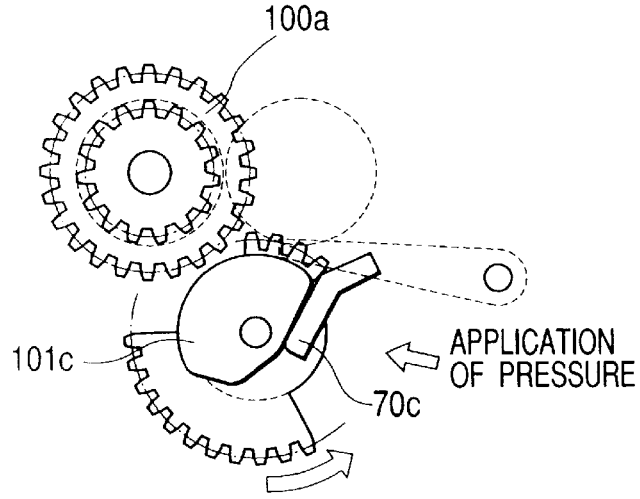
Figure 19C:
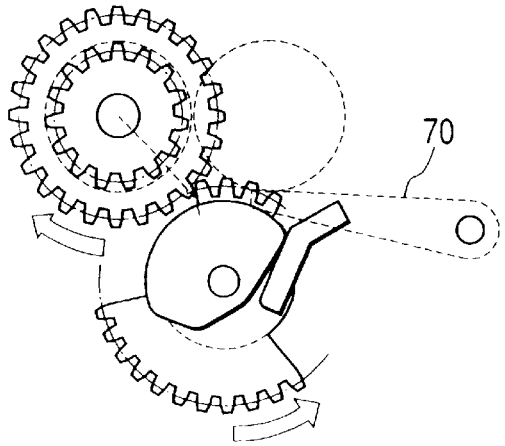
Figure 19E:
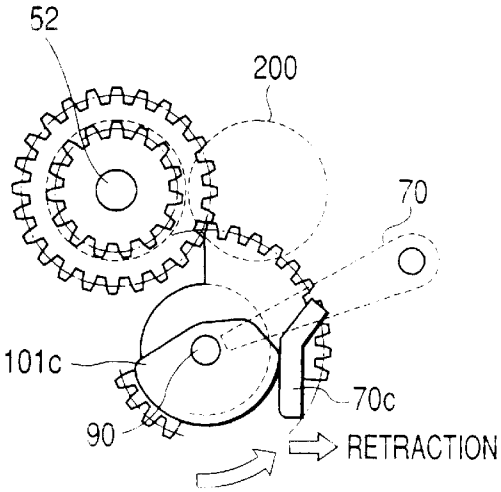
Figure 19G:
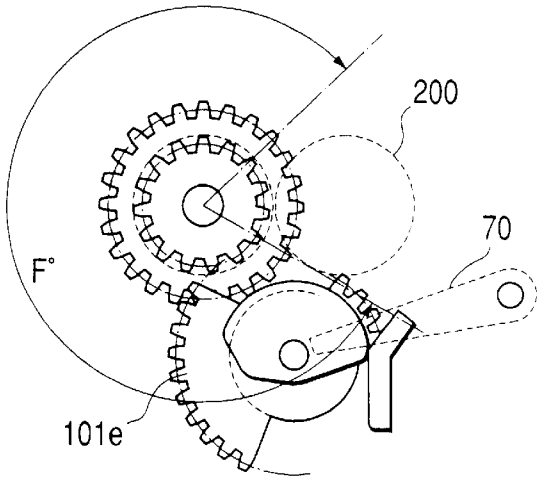
Figure 19D:
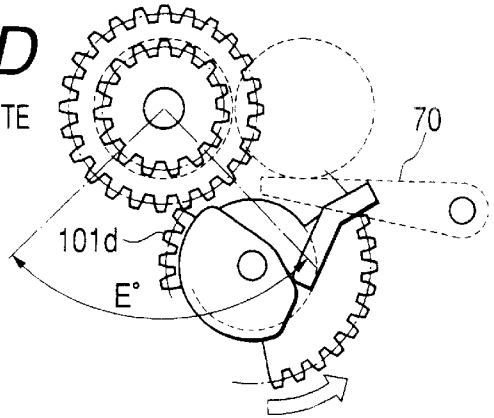
Figure 19F:
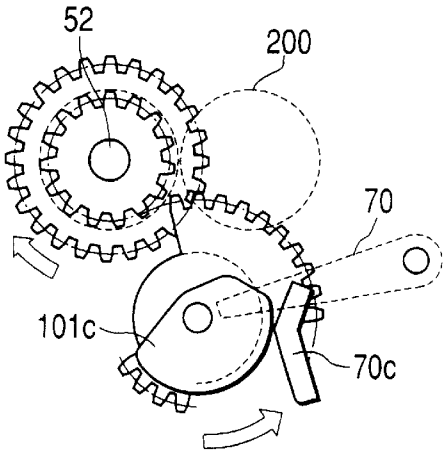
Figure 20B:
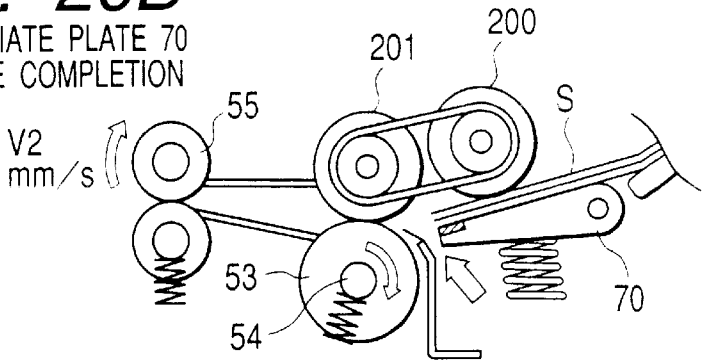
Figure 20A:
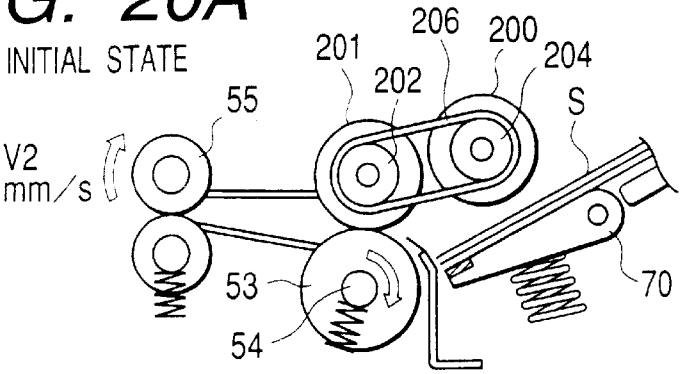
Figure 20D:
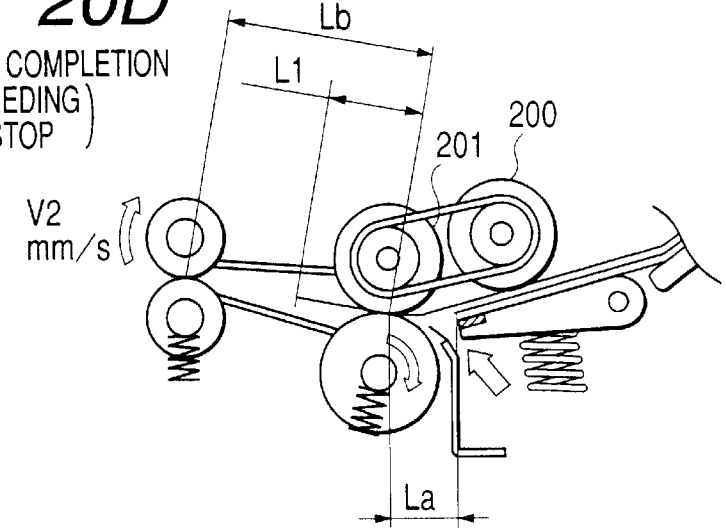
Figure 20C:
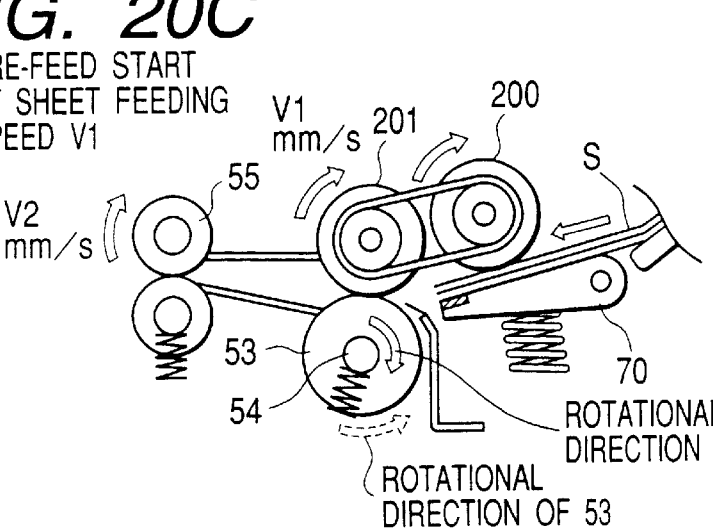

FIG. 17 is a sectional view of a sheet feeding apparatus in which a pick-up roller is provided in the sheet feeding apparatus according to the aforementioned alteration, and FIG. 18 is a drive development view of such a sheet feeding apparatus. As is in the above-mentioned another alteration, the driving force is transmitted to the pick-up roller through the drive belt 206 and pulleys provided on the shafts of the sheet feeding roller 201 and the pick-up roller 200, and the pick-up roller is disposed in a position where the intermediate plate 70 can abut against the pick-up roller when the intermediate plate 70 is in the pressurized state. Since the other elements are the same as those in the above-mentioned another alteration, explanation thereof will be omitted.

FIGS. 19A to 19G are views showing an operation of the control gear 101, and FIGS. 20A to 20H are views showing operation of the pick-up roller 200 and the intermediate plate 70. The control gear 101 having first and second sector gear portions 101*d,* 101*e* engageable with the large diameter gear 100*a* and the small diameter gear 100*b* of the sheet feeding drive stage gear 100 and two non-engagement portions 101*a,* 101*b* which are not engaged by the sheet feeding drive stage gear 100 for rotating the sheet feeding roller 201 is disposed in a confronting relationship to the large diameter gear 100*a* and the small diameter gear 100*b* of the sheet feeding drive stage gear 100. The cam 101*c* for applying and releasing the pressure between the intermediate plate 70 and the pick-up roller 200 is integrally formed with the control gear 101.

Further, as mentioned above, since the driving force is transmitted to the pick-up roller 200 through the sheet feeding roller 201, the pulleys 202, 204 and the drive belt 206, the pick-up roller 200 is rotated always in synchronous with the sheet feeding roller 201. As shown in FIGS. 19A to 19G and FIGS. 20A to 20H, the timing for effecting rotation and stoppage of the sheet feeding roller 201 provided by the sheet feeding drive stage gear 100 and the control gear 101 and the timing for applying and releasing the pressure between the intermediate plate 70 and the pick-up roller 200 provided by the cam 101*c* and the cam follower 70*c* are the same as those in the above-mentioned another alteration. Namely, the same sheet feeding ability and separating ability as those in the above-mentioned another alteration can be achieved.

Further, by using the pick-up roller 200 to feed out the sheets S stacked on the intermediate plate 70, a diameter of the sheet feeding roller 201 can be made smaller. Thus, with this arrangement, by using the pick-up roller 200, the sheet feeding apparatus can be made more compact due to the small diameter of the sheet feeding roller 201, and occurrence of double-feed and slip can be minimized due to low speed pre-feeding, thereby stabilizing the sheet feeding ability.

Figure 21:
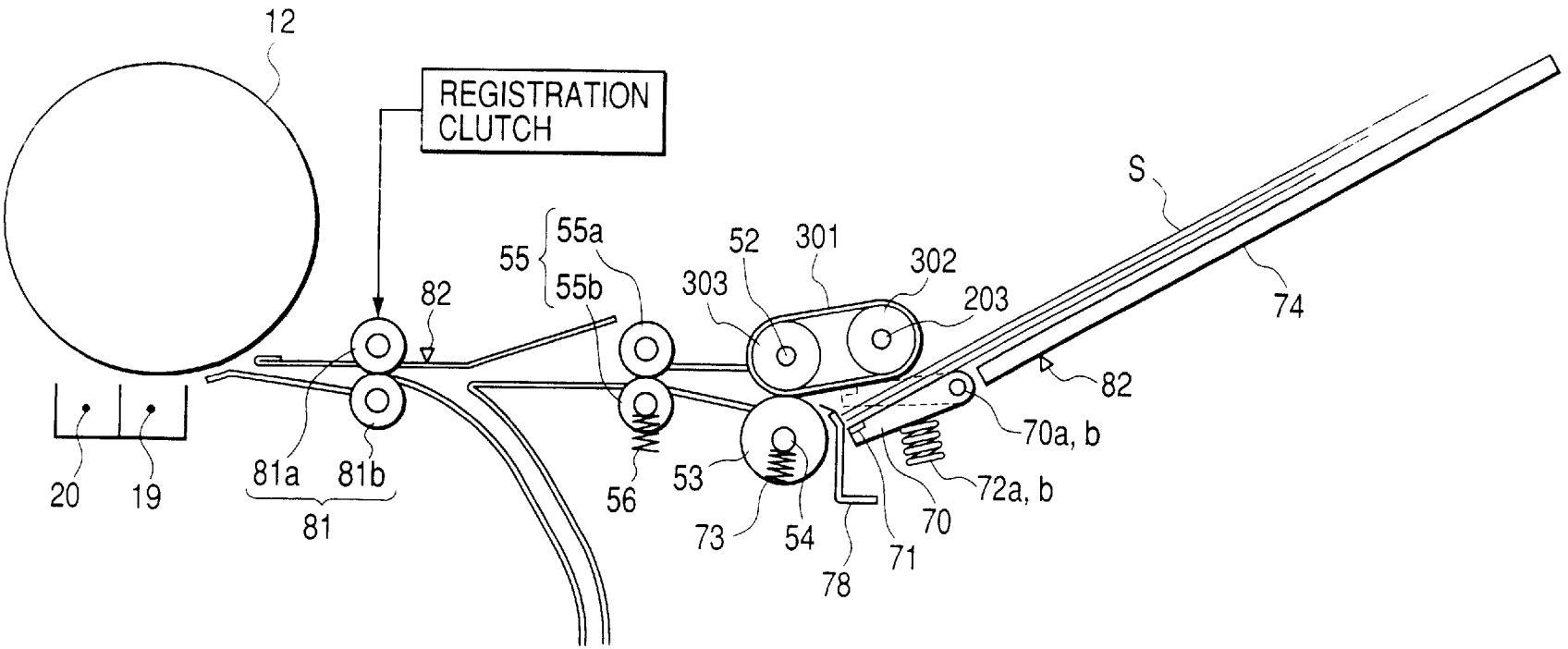
FIG. 21 is a constructural view showing a sheet feeding roller and a pick-up roller in an alteration of the embodiment of the present invention.

Incidentally, according to this example, in the sheet feeding means, while the interlocking operation is achieved by the drive belt 206 and the pulleys 202, 204 provided on the shafts of the sheet feeding roller 201 and the pick-up roller 200, as shown in FIG. 21, the sheet feeding operation may be effected by using a feed belt 301. The feed belt 301 are passed over pulleys 302, 303. In this arrangement, not only the same effect as that in the above-mentioned embodiment can be obtained, but also the apparatus can be further made inexpensive because the drive belt 206 can be omitted.

Next, a difference in appropriate sheet feeding area between the earlier technologies and the present invention will be explained with reference to the accompanying drawings.

Figure 22:
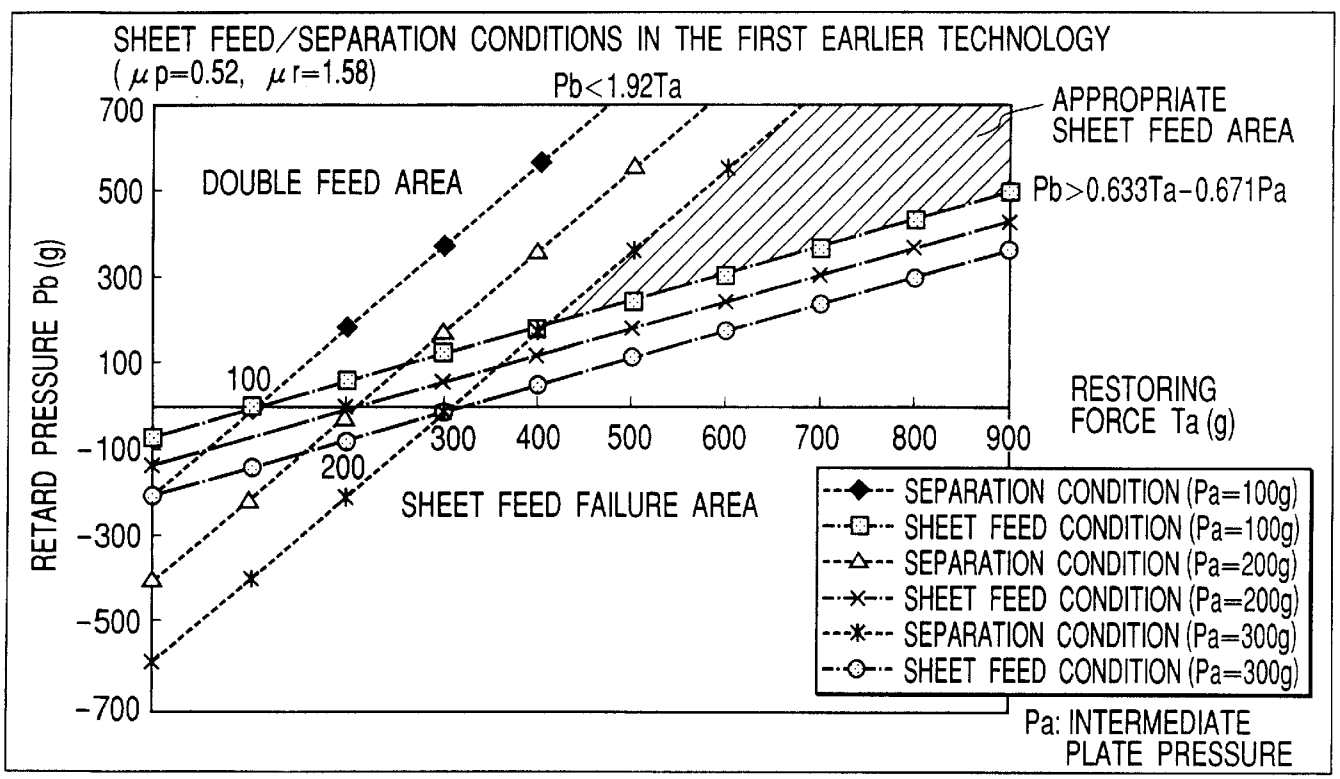
FIG. 22 is a graph showing an appropriate sheet feeding area in a first earlier technology ($\mu p$=0.52, $\mu r$=1.58)
Figure 24:
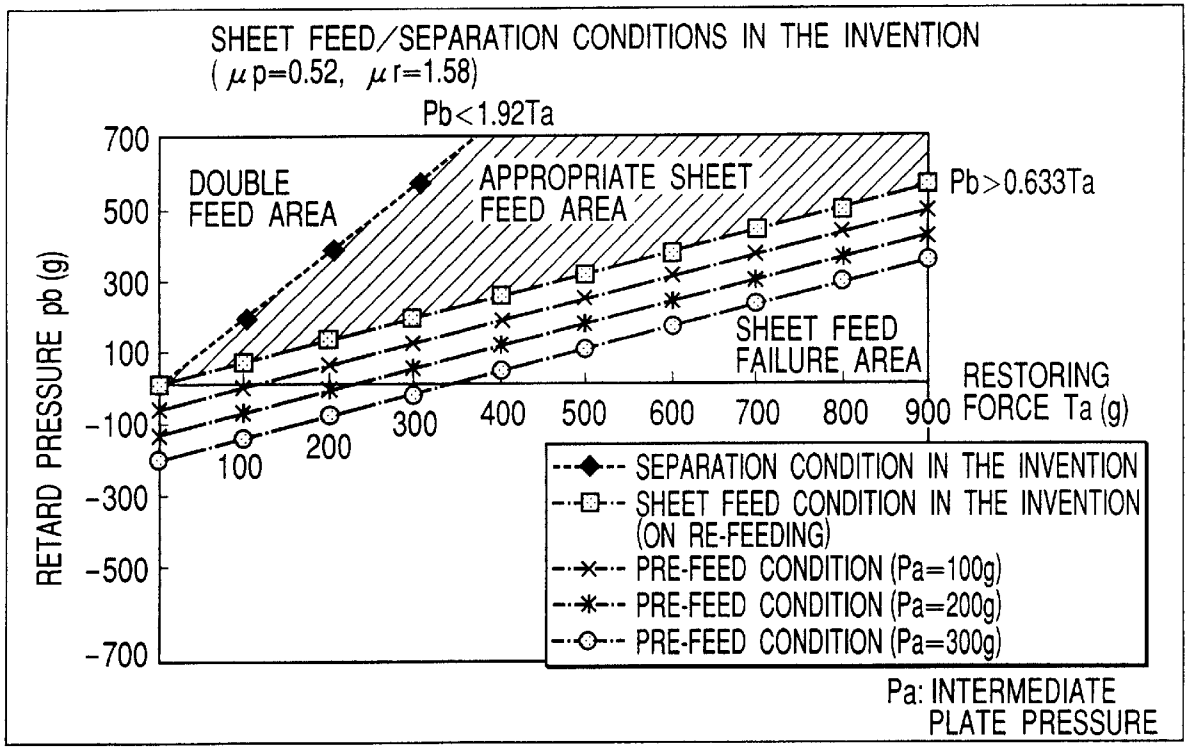
FIG. 24 is a graph showing an appropriate sheet feeding area in the present invention ($\mu p$=0.52, $\mu r$=1.58)

The appropriate sheet feeding area of the sheet feeding apparatus according to the present invention is shown in FIG. 24. Further, as mentioned above, FIG. 22 shows the appropriate sheet feeding area of the sheet feeding apparatus according to the first earlier technology (values are calculated values). Incidentally, the numerical values and formulae (expressions) used in FIG. 22 are quoted from those used in the first earlier technology. Such expressions are as follows:

Expression of sheet feed condition $$Pb>Ta/\mu r+((\mu p/\mu r)-1)Pa \quad \text{Expression (1)}$$

Expression of separation condition $$Pb<Ta/\mu p-2Pa \quad \text{Expression (2)}$$

here, Pb is retard pressure, Ta is a sheet restoring (returning) force of the separating roller, Pa is intermediate plate pressure, $\mu p$ is a coefficient of friction between the sheets, and $\mu r$ is a coefficient of friction between the sheet and the sheet feeding roller or the separating roller.

Incidentally, Ta is a value obtained from the following equation:

$$Ta=(\text{torque of a torque limiter})/(\text{radius of a separating roller})$$

In FIGS. 22 and 24, a relationship between the sheet restoring force Ta, the intermediate plate pressure Pa and the retard pressure Pb is formulated as mentioned above, and the sheet feed condition and the separation condition are sought regarding Pa=100 g, 200 g, 300 g, respectively. However, when the present invention is used, in the separating operation and in the re-feeding operation, since the intermediate plate is retracted from the sheet feeding roller or the pick-up roller, the intermediate plate pressure Pa is not generated. Thus, the sheet feed condition (in the re-feeding operation) and the separation condition are expressed as a function of only the restoring force Ta and the retard pressure Pb. The pre-feed condition, the sheet feed condition and the separation condition in the present invention are as follows:

Expression of Pre-Feed Condition $$Pb>Ta/\mu r+((\mu p/\mu r)-1)Pa \quad \text{Expression (3)}$$

Expression of sheet feed condition $$Pb>Ta/\mu r \quad \text{Expression (4)}$$

Expression of separation condition $$Pb<Ta/\mu p \quad \text{Expression (5).}$$

Incidentally, assuming that the frictional coefficient $\mu p$ between the sheets and the frictional coefficient $\mu r$ between the sheet and the sheet feeding roller or the pick-up roller are 0.52 and 1.58, respectively in accordance with the first earlier technology, the calculation is performed.

In case of the first earlier technology in which the intermediate plate is urged against the sheet feeding roller in the separating operation and the re-feeding operation, the relationship between the restoring force Ta of the separating roller and the retard pressure Pb is greatly influenced by the intermediate plate pressure Pa; and, when the restoring force Ta<400 g, there is no appropriate sheet feeding area. Since the intermediate plate pressures Pa vary with the number of sheets stacked on the intermediate plate, it is considered that it is very difficult to stabilize the appropriate sheet feeding area and to widen the range of the appropriate sheet feeding area in the first earlier technology.

To the contrary, in case of the present invention, since the intermediate plate is retracted from the sheet feeding roller or the pick-up roller in the separating operation and the re-feeding operation, the relationship between the restoring force Ta of the separating roller and the retard pressure Pb is not influenced by the intermediate plate pressure Pa at all. Thus, the appropriate sheet feeding area can be maintained with a wide range.

Figure 23:
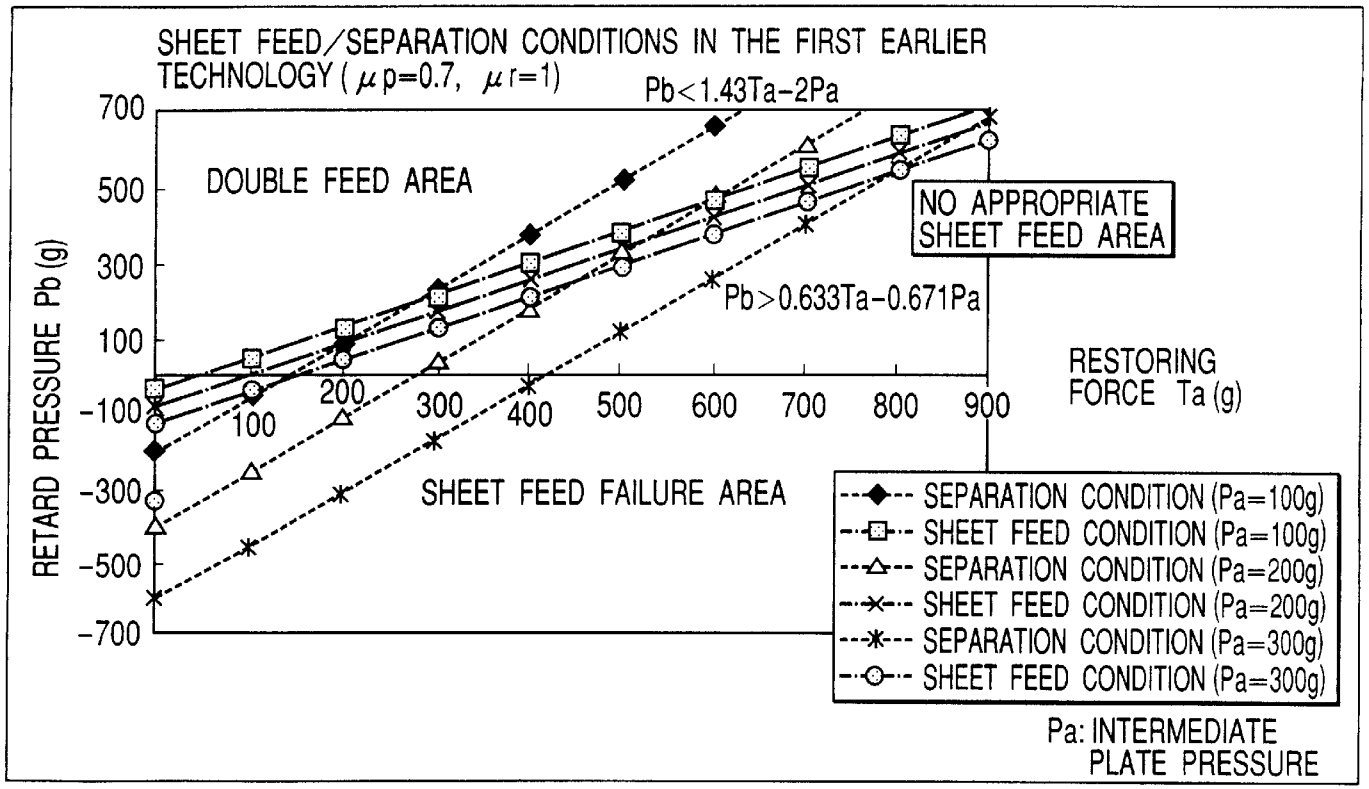
FIG. 23 is a graph showing an appropriate sheet feeding area in a first earlier technology ($\mu p$=0.7, $\mu r$=1.0)
Figure 25:
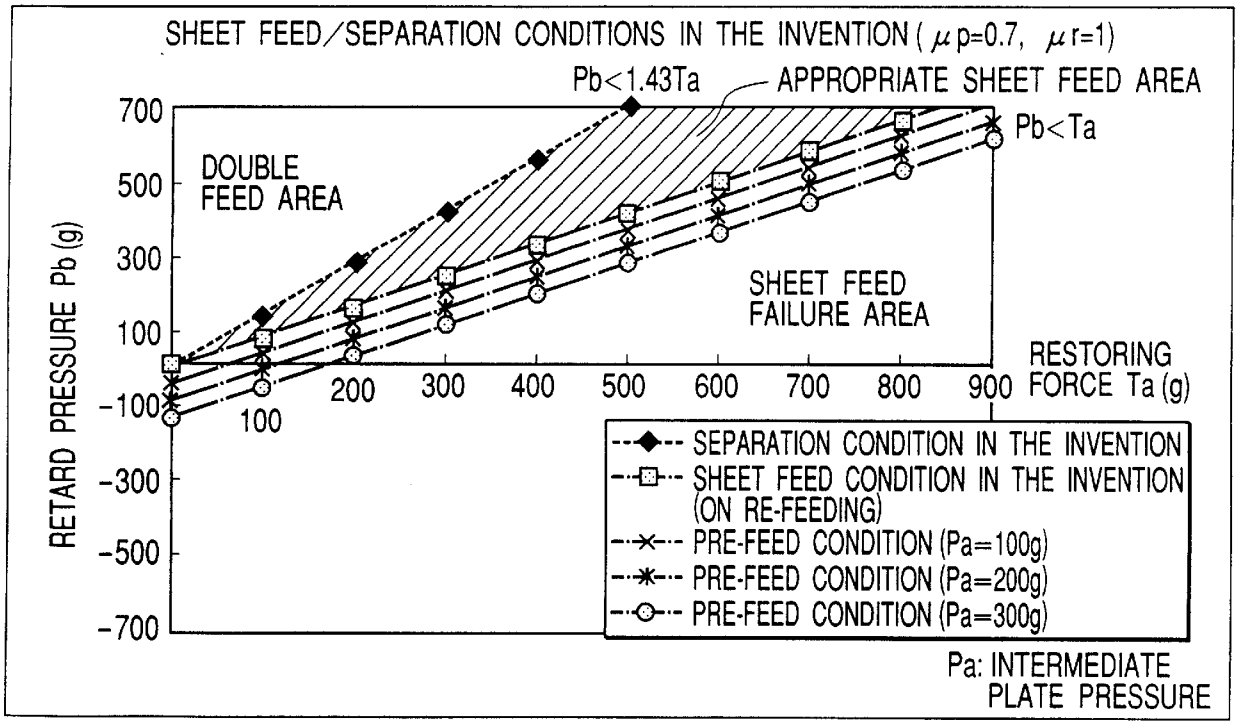
FIG. 25 is a graph showing an appropriate sheet feeding area in the present invention ($\mu p$=0.7, $\mu r$=1.0)
Figure 26:
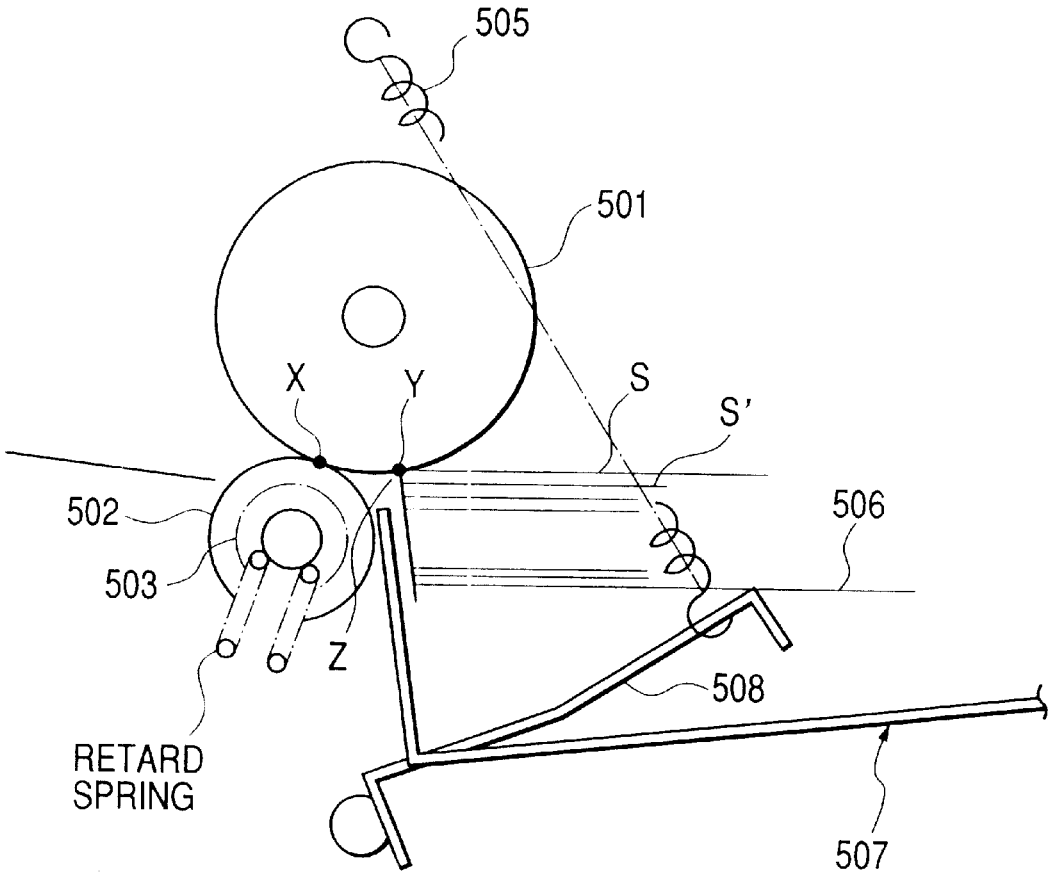
FIG. 26 is a schematic side view showing a first earlier technology.
Figure 27:
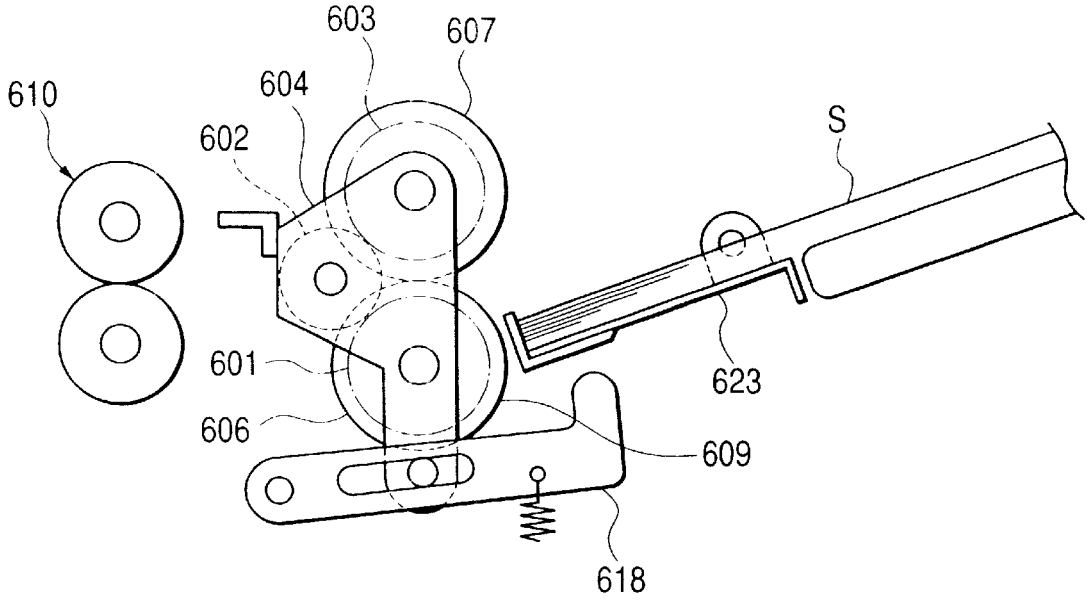
FIG. 27 is a schematic side view showing a second earlier technology (initial state)
Figure 28:
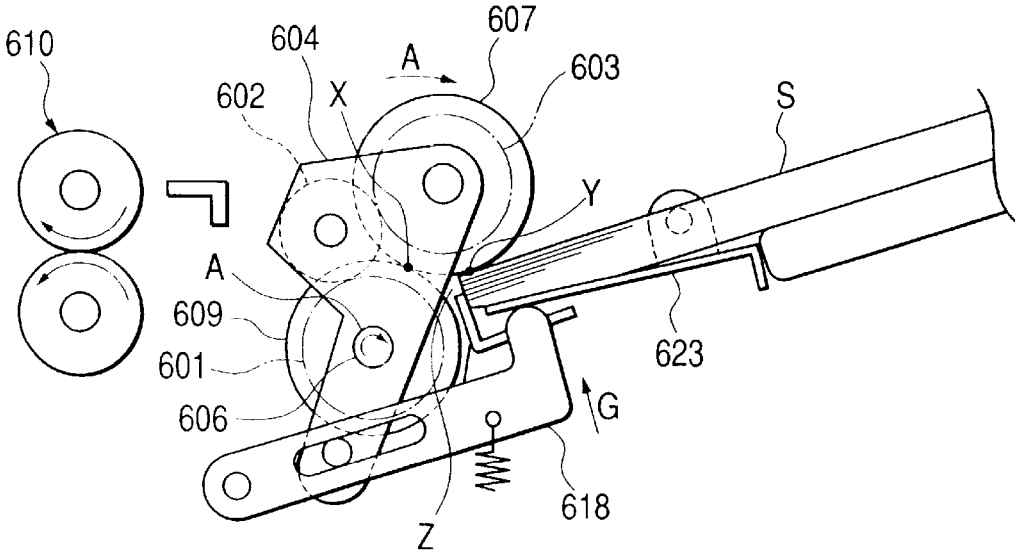
FIG. 28 is a schematic side view showing the second earlier technology (sheet feeding state).

FIGS. 23 and 25 show a relationship between the restoring force Ta of the separating roller and the retard pressure Pb when a sheet having great frictional coefficient between the sheet is fed and separated by a worn sheet feeding roller. As $\mu p$ and $\mu r$, numerical values 0.7 and 1.0 are used, respectively. The other numerical values and expressions are the same as above-mentioned ones.

As shown in FIG. 23 showing the relationship between Ta and Pb in the first earlier technology, in a range of the restoring force Ta<900 g, it can be seen that there is no appropriate sheet feeding area. In this condition, it is very difficult to effect the stable sheet feeding and separating operations. However, in FIG. 16 showing the relationship between Ta and Pb in the present invention, there is the appropriate sheet feeding area. Thus, without greatly influenced by the material of the sheet and wear of the rollers, the stable sheet feeding and separating operations can be performed. The difference in appropriate sheet feeding area between FIG. 14 and FIG. 16 depends upon the presence/absence of the intermediate plate pressure Pa.

Although not shown, a relationship between the restoring force and the retard pressure in the second earlier technology is substantially the same as that in the first earlier technology. The reason is that the sheet feeding pressure of the sheet feeding roller is released from the sheets stacked on the intermediate plate by entering the fed sheet into the nip of the pair of draw rollers in the second earlier technology. This means that the intermediate plate is still urged against the sheet feeding roller in the separating operation.

That is to say, there is the separating operation similar to that in the first earlier technology in which the intermediate plate pressure Pa affects an influence upon the relationship between the restoring force Ta of the separating roller and the retard pressure Pb during the separating operation. Thus, the relationship between the restoring force and the retard pressure in the second earlier technology becomes similar to that in the first earlier technology.

As mentioned above regarding the difference in appropriate sheet feeding area between the earlier technologies and the present invention, the present invention can widen the appropriate sheet feeding area in comparison with the earlier technologies. Thus, the reliable and stable sheet feeding and separating operations can be realized.

Further, since the pre-fed sheet S can be temporarily stopped and since the intermediate plate 70 can be retracted from the sheet feeding roller 51 (or the pick-up roller 200) and, in this case, since the restoring force of the separating roller 53 can be applied to the sheet, the sheet(s) double-fed in the pre-feeding operation can surely be restored, thereby achieving high reliable sheet feeding.

Further, by stopping the pre-feed sheet S temporarily, since dispersion of the position of the leading end of the sheet S on releasing the pressure of the intermediate plate 70 can be minimized, the feeding distance from the nip between the sheet feeding roller 51 or 201 and the separating roller 53 to the pair of draw rollers 55 can be shortened. Therefore, the entire apparatus can be made more compact.

When the sheet S is fed by the pair of draw rollers 55, since the intermediate plate 70 is already retracted from the sheet feeding roller 51 or the pick-up roller 200, the feeding load due to the intermediate plate pressure does not act on the pair of draw rollers 55, thereby improving the service life of the draw rollers.

Further, in the normal state, since the intermediate plate 70 is retracted from the sheet feeding roller 51 or the pick-up roller 200, when the operator sets the sheet bundle, the setting is not obstructed. When the operator sets the sheets, since he may merely abut the leading end of the sheet bundle against the abutment plate 78, the setting operation is very easy, thereby reducing sheet jam and skew-feed due to poor setting.

Since the interlocking operation between the intermediate plate 70 and the sheet feeding means is controlled by the control gear 80 integrally formed with the cam 80*c* for controlling the intermediate plate 70 and the two toothless portions 80*a,* 80*b* or the control gear 101 integrally formed with the cam 101*c* and the non-engagement portions 101*a,* 101*b* and since the pre-feeding timing, the re-feeding timing and the timing for applying and releasing the pressure of the intermediate plate 70 are determined by the phase angle between the toothless portions 80*a,* 80*b* and the cam 80*c* or the phase angle between the non-engagement portions 101*a,* 101*b* and the cam 101*c,* there is few factors for dispersion, thereby achieving the stable sheet feeding and separating operation with low cost.

Further, since the control for rotation and stoppage of the sheet feeding roller 51 or the sheet feeding roller 201 and the application and release of the pressure of the intermediate plate 70 can be effected by one ON signal and one OFF signal for the solenoid 69, the control is very easy and the severe control accuracy is not requested.

Furthermore, when the pair of draw rollers 55 are synchronized with the drive shaft 54 of the separating roller 53, since the control is effected by the single draw clutch 60, the apparatus can be simplified, and, since the rollers 55 and the shaft 54 can be driven independently from the rotation of the sheet feeding means, the restoring force of the separating roller 53 can be applied to the sheet even when the sheet feeding means is stopped, a sheet feeding apparatus having high double-feed preventing ability can be provided.

When the drive transmission between the sheet feeding roller 51 and the separating roller 53 is effected by using the connecting means, by drivingly connecting the shaft 54 of the separating roller 53 to the sheet feeding roller support shaft 52, means such as a one-way clutch for regulating the rotational direction can be omitted, thereby making the sheet feeding apparatus inexpensive; and, by rotatingly driving the sheet feeding roller 51 by the sheet drawn by the pair of draw rollers 55, since the shaft 54 of the separating roller 53 can always be rotated in the restoring direction, the separating ability can be improved.

Further, in the state that the non-engagement portions 101*a,* 101*b* of the control gear 101 is opposed to the sheet feeding drive stage gear 100, although the slight rotational resistance of the torque limiter 62 acts on the sheet feeding roller 51 and the separating roller 53, these rollers can freely be rotated in both directions. Thus, when the sheet is jammed in the sheet feeding section the jammed sheet can be pulled both in the sheet feeding direction and in the opposite direction, thereby improving the sheet jam treating ability greatly.

Incidentally, in the above-mentioned embodiment and its alteration, while an example that one revolution of the control gear 80 is controlled by the spring clutch 68 is explained, the present invention is not limited to such an example, but, for example, a stepping motor may be used as the sheet feeding motor $M_2$ to control one revolution.

Further, in the above-mentioned embodiment and its alteration, while an example that the sheet feeding means and the intermediate plate 70 are driven by the sheet feeding motor $M_1$ and the pair of draw rollers 55 and the separating roller 53 are driven by the draw motor $M_2$ is explained, the present invention is not limited to such an example, but the driving force may be distributed from motors for driving the photosensitive drum 12 and the fixing unit 22.

Further, in the above-mentioned embodiments and the alterations, while an example that the torque limiter 62 is provided on the separating roller 53 to apply to the separating roller 53 the predetermined torque directing toward the direction opposite to the sheet feeding direction is explained, the present invention is not limited to the torque limiter 62 so long as such torque can be applied to the separating roller 53.

In the above-mentioned embodiment and its alteration, while an example that the present invention is applied to the multi sheet feeding porion is explained, of course, the present invention can be applied to a cassette sheet feeding portion or a deck sheet feeding portion.

Lastly, in the above-mentioned embodiment and its alteration, while an example that the sheet feeding apparatus according to the present invention is applied to the copying machine as the image forming apparatus is explained, the present invention is not limited to such an example, but, for example, the present invention can be applied to an image reading apparatus by providing an image reading portion at a downstream side of the sheet feeding apparatus according to the present invention in the sheet feeding direction.

What is claimed is:

1. A sheet feeding apparatus comprising:

movable sheet supporting means for supporting a sheet;

sheet feeding means for urging against the sheet supported by said sheet supporting means and rotating in a sheet feeding direction to feed the sheet;

a separating roller rotatable in a sheet restoring direction to separate the sheet fed from said sheet feeding means wherein said separating roller urges against said sheet feeding means;

conveying means disposed downstream of a separating portion, in which said sheet feeding means is in pressure contact with said separating roller, in the sheet feeding direction for conveying the sheet fed from said sheet feeding means;

drive transmitting means for transmitting a drive to said sheet feeding means, said drive transmitting means stopping rotation of said sheet feeding means after a leading end of the sheet fed out from said sheet supporting means by said sheet feeding means reaches said separating portion and before the leading end of the sheet reaches said conveying means and then for transmitting a drive to rotate said sheet feeding means in the sheet feeding direction after stopping rotation of said sheet feeding means; and pressing and retracting means for moving said sheet supporting means to place the sheet into pressure contact with said sheet feeding means and to release the pressure contact between said sheet feeding means and the sheet after the leading end of the sheet fed out from said sheet supporting means by said sheet feeding means reaches said separating portion and before the leading end of the sheet reaches said conveying means.

2. A sheet feeding apparatus according to claim 1, wherein said drive transmitting means stops transmission of a drive to said sheet feeding means after the leading end of the sheet fed out from said sheet supporting means by said sheet feeding means reaches said separating portion and before the leading end of the sheet reaches said conveying means, and, thereafter, said pressing and retracting means moves said sheet supporting means to release pressure contact between said sheet feeding means and the sheet.

3. A sheet feeding apparatus according to claim 1, wherein a time period for stopping the sheet after reaching said separating portion and before reaching said conveying means is set as a separating operation time required for restoring a sheet double-fed by said separating roller in said sheet supporting means.

4. A sheet feeding apparatus according to claim 1, wherein said drive transmitting means comprises a partially toothless gear and for rotating said sheet feeding means, and wherein said partially toothless gear is rotated so as to engage with said sheet feeding drive gear so that said sheet feeding means is rotated and stopped.

5. A sheet feeding apparatus according to claim 4, further comprising connecting means for mechanically connecting said sheet feeding means to a separating roller shaft for rotatably supporting said separating roller to transmit a rotational force transmitted by said drive transmitting means to said separating roller to rotate said sheet feeding means.

6. A sheet feeding apparatus according to claim 5, wherein said connecting means comprises pulley members passed over said sheet feeding means and said separating roller shaft.

7. A sheet feeding apparatus according to claim 5, wherein said connecting means comprises a gear train including a connecting gear provided on said sheet feeding means, a separating roller gear provided on said separating roller shaft, and an idler gear engaged by said connecting gear and said separating roller gear.

8. A sheet feeding apparatus according to claim 4, wherein said pressing and retracting means comprises a cam rotatable integrally with said partially toothless gear and a cam follower provided on said sheet supporting means and engageable with and disengageable from said cam, and wherein said cam is rotated by rotation of said partially toothless gear to be disengaged from and engaged with said cam follower to bring the sheet supported by said sheet supporting means into pressure contract with said sheet feeding means and release the pressure contact.

9. A sheet feeding apparatus according to claim 8, wherein said pressing and retracting means comprises a rocking spring for imparting an urging force to said sheet supporting means in a direction urging said sheet supporting means against said sheet feeding means, and wherein when said cam is engaged with said cam follower, the pressure of the sheet supported on said sheet supporting means which is in pressure contact with said sheet feeding means is released against the urging force of said rocking spring, and, when said cam is disengaged from said cam follower, the sheet supported on said sheet supporting means is brought into pressure contact with said sheet feeding means by the urging force of said rocking spring.

10. A sheet feeding apparatus according to claim 1, wherein said drive transmitting means comprises a stage gear including first and second sector gears, and two sheet feeding drive gears rotatably integral with said sheet feeding means and engageable with the respective sector gears alternately, and wherein said sheet feeding means is rotated and stopped by transmitting a rotation of said stage gear to said sheet feeding drive gears, and a rotating speed of said sheet feeding means is changed as said sheet feeding means is rotated.

11. A sheet feeding apparatus according to claim 10, wherein said drive transmitting means comprises said stage gear including said first sector gear having a small diameter and a small angle and said second sector gear having a large diameter and a large angle, said two sheet feeding drive gears comprising a large diameter gear engageable with said first sector gear and a small diameter gear engageable with said second sector gear, and non-engagement portions provided on said stage gear and not engaged by both said large diameter gear and said small diameter gear, and wherein when said stage gear is rotated, said first sector gear is engaged with said large diameter gear to rotate said sheet feeding means at a first feeding speed thereby to feed out the sheet on said sheet supporting means and, thereafter said sheet feeding means is stopped by said non-engagement portion of said stage gear reaching a position opposite to said sheet feeding drive gears, and thereafter said second sector gear is engaged with said small diameter gear to rotate said sheet feeding means at a second feeding speed higher than the first feeding speed to thereby feed the fed-out sheet.

12. A sheet feeding apparatus according to claim 11, wherein said second feeding speed of said sheet feeding means provided by the engagement between said second sector gear of said drive transmitting means and said small diameter gear rotatably integral with said sheet feeding means is equal to a sheet conveying speed of said conveying means.

13. A sheet feeding apparatus according to claim 1, wherein said sheet feeding means comprises a sheet feeding roller urged against said separating roller and in pressure contact with the sheet supported by said sheet supporting means.

14. A sheet feeding apparatus according to claim 1, wherein said sheet feeding means comprises a pick-up roller contactable with the sheet supported by said sheet supporting means to feed out the sheet in the sheet feeding direction, and a sheet feeding roller disposed downstream of said pick-up roller in the sheet feeding direction and opposed to said separating roller.

15. A sheet feeding apparatus according to claim 14, wherein a rotational force of said pick-up roller is transmitted from said sheet feeding roller through a rotational force transmitting member of said sheet feeding means.

16. A sheet feeding apparatus according to claim 15, wherein said rotational force transmitting member comprises pulleys provided on said sheet feeding roller and said pick-up roller respectively, and a drive belt connecting between said pulleys.

17. A sheet feeding apparatus according to claim 1, wherein said separating roller has torque limiter means for applying predetermined torque to said separating roller.

18. A sheet feeding apparatus according to claim 1, wherein a driving force for driving said conveying means is transmitted to said separating roller to drive said separating roller.

19. A sheet feeding apparatus according to claim 1, wherein a driving force for driving said sheet feeding means is transmitted to said separating roller to drive said separating roller.

20. An image forming apparatus comprising:

movable sheet supporting means for supporting a sheet;

sheet feeding means for urging against the sheet supported by said sheet supporting means and rotating in a sheet feeding direction to feed the sheet;

a separating roller rotatable in a sheet restoring direction to separate the sheet fed from said sheet feeding means, wherein said separating roller urges against said sheet feeding means;

conveying means disposed downstream of a separating portion, in which said sheet feeding means is in pressure contact with said separating roller, in the sheet feeding direction for conveying the sheet fed from said sheet feeding means;

image forming means for forming an image on the sheet conveyed by said conveying means;

drive transmitting means for transmitting a drive to said sheet feeding means, said drive transmitting means stopping rotation of said sheet feeding means after a leading end of the sheet fed out from said sheet supporting means by said sheet feeding means reaches said separating portion and before the leading end of the sheet reaches said conveying means and then for transmitting a drive to rotate said sheet feeding means in the sheet feeding direction after stopping rotation of said sheet feeding means; and pressing and retracting means for moving said sheet supporting means to place the sheet into pressure contact with said sheet feeding means and to release the pressure contact between said sheet feeding means and the sheet after the leading end of the sheet fed out from said sheet supporting means by said sheet feeding means reaches said separation portion and before the leading end of the sheet reaches said conveying means.

21. An image reading apparatus comprising:

movable sheet supporting means for supporting a sheet;

sheet feeding means for urging against the sheet supported by said sheet supporting means and rotating in a sheet feeding direction to feed the sheet;

a separating roller rotatable in a sheet restoring direction to separate the sheet fed from said sheet feeding means, wherein said separating roller urges against said sheet feeding means;

conveying means disposed downstream of a separating portion, in which said sheet feeding means is in pressure contact with said separating roller, in the sheet feeding direction for conveying the sheet fed from said sheet feeding means;

image reading means for reading image information on the sheet conveyed by said conveying means;

drive transmitting means for transmitting a drive to said sheet feeding means, said drive transmitting means stopping rotation of said sheet feeding means after a leading end of the sheet fed out from said sheet supporting means by said sheet feeding means reaches said separating portion and before the leading end of the sheet reaches said conveying means and then for transmitting a drive to rotate said sheet feeding means in the sheet feeding direction after stopping rotation of said sheet feeding means; and pressing and retracting means for moving said sheet supporting means to place the sheet into pressure contact with said sheet feeding means and to release the pressure contact between said sheet feeding means and the sheet after the leading end of the sheet fed out from said sheet supporting means by said sheet feeding means reaches said separating portion and before the leading end of the sheet reaches said conveying means.

* * * * *

UNITED STATES PATENT AND TRADEMARK OFFICE

CERTIFICATE OF CORRECTION

PATENT NO. : 6,260,840 B1
DATED : July 17, 2001
INVENTOR(S) : Takeshi Suga et al.

It is certified that error appears in the above-identified patent and that said Letters Patent is hereby corrected as shown below:

Title page,
Item [56], References Cited, FOREIGN PATENT DOCUMENTS, "1-32134 6/1989 (JP)" and "6-64769 3/1994 (JP)" should be deleted.

Column 8,
Line 50, "relates" should read -- relate --.

Column 10,
Line 14, "$L_2 = \beta^o$ x II x d/360° --- (Expression B)" should read -- L2 = $\beta^o$ x II x d/360° --- (Expression B) --.

Column 15,
Line 6, "relates" should read -- relate --.
Line 66, "$L_1$" should read -- L1 --.

Column 22,
Line 57, "$L_1$" should read -- L1 --.

Column 23,
Line 5, "$L_2$" should read -- L2 --.

Column 25,
Line 7, "in" should be deleted.

Column 26,
Line 28, "in" should be deleted.

Column 29,
Line 20, "is" should read -- are --.
Line 64, "$M_2$" should read -- M2 --.

Column 30,
Line 1, "$M_1$" should read -- M1 --.
Line 2, "$M_2$" should read -- M2 --.

UNITED STATES PATENT AND TRADEMARK OFFICE

CERTIFICATE OF CORRECTION

PATENT NO. : 6,260,840 B1
DATED : July 17, 2001
INVENTOR(S) : Takeshi Suga et al.

It is certified that error appears in the above-identified patent and that said Letters Patent is hereby corrected as shown below:

Column 31,
Line 12, "and for" should read -- and a sheet feeding drive gear engageable with said partially toothless gear for --.

Signed and Sealed this

Sixteenth Day of April, 2002

*Attest:*

*Attesting Officer*

JAMES E. ROGAN
*Director of the United States Patent and Trademark Office*